US012281857B2

(12) United States Patent
Kawaguchi et al.

(10) Patent No.: US 12,281,857 B2
(45) Date of Patent: Apr. 22, 2025

(54) HEAT EXCHANGER

(71) Applicant: DENSO CORPORATION, Kariya (JP)

(72) Inventors: Syogo Kawaguchi, Kariya (JP); Isao Tamada, Kariya (JP); Yasuhiro Mizuno, Kariya (JP)

(73) Assignee: DENSO CORPORATION, Kariya (JP)

( * ) Notice: Subject to any disclaimer, the term of this patent is extended or adjusted under 35 U.S.C. 154(b) by 565 days.

(21) Appl. No.: 17/575,442

(22) Filed: Jan. 13, 2022

(65) Prior Publication Data

US 2022/0136745 A1 May 5, 2022

Related U.S. Application Data

(63) Continuation of application No. PCT/JP2020/027526, filed on Jul. 15, 2020.

(30) Foreign Application Priority Data

Jul. 16, 2019 (JP) ..... 2019-131333

(51) Int. Cl.
*F28D 9/00* (2006.01)
*F25B 39/04* (2006.01)
(Continued)

(52) U.S. Cl.
CPC ..... *F28D 9/005* (2013.01); *F25B 39/04* (2013.01); *F28D 9/02* (2013.01); *F28F 3/08* (2013.01)

(58) Field of Classification Search
CPC ... F28F 9/005; F28F 3/08; F28F 3/083; F25B 39/04; F28D 9/005; F28D 9/0068
See application file for complete search history.

(56) References Cited

U.S. PATENT DOCUMENTS 7,469,554 B2 * 12/2008 Martins ..... F28D 9/005 62/506
2013/0146265 A1 * 6/2013 Kim ..... F25B 39/04 165/166

(Continued)

FOREIGN PATENT DOCUMENTS

CN 104296586 A 1/2015
FR 3001796 A 8/2014

(Continued)

*Primary Examiner* — Jianying C Atkisson
*Assistant Examiner* — For K Ling
(74) *Attorney, Agent, or Firm* — Harness, Dickey & Pierce, P.L.C.

(57) ABSTRACT

A condensing portion is formed such that a first refrigerant flow path through which a gas-phase refrigerant flowing into a refrigerant inlet flows and a first heat-medium flow path through which a heat medium flows overlap each other in a stacking direction of plates. A gas-liquid separator separates the refrigerant into gas-phase refrigerant and liquid-phase refrigerant and discharges the liquid-phase refrigerant. A subcooling portion is disposed on one side in the stacking direction with respect to the condensing portion, is formed such that a second refrigerant flow path through which the liquid-phase refrigerant discharged from the gas-liquid separator flows toward a refrigerant outlet and a second heat-medium flow path through which the heat medium flows overlap each other in the stacking direction.

25 Claims, 39 Drawing Sheets

(51) Int. Cl.
*F28D 9/02* (2006.01)
*F28F 3/08* (2006.01)

(56) References Cited

U.S. PATENT DOCUMENTS

| | | | | |
|---|---|---|---|---|
| 2015/0226469 | A1 | 8/2015 | Hofmann et al. | |
| 2015/0323231 | A1 | 11/2015 | Citti et al. | |
| 2016/0010929 | A1 | 1/2016 | Takahashi et al. | |
| 2016/0161160 | A1* | 6/2016 | Hofmann | F28F 9/0253 62/509 |
| 2016/0320141 | A1 | 11/2016 | Barfknecht et al. | |
| 2017/0122669 | A1* | 5/2017 | Takahashi | F28F 3/08 |
| 2018/0135916 | A1* | 5/2018 | Sueyoshi | B60H 1/00342 |

FOREIGN PATENT DOCUMENTS

| | | | |
|---|---|---|---|
| FR | 3059400 | A1 * | 6/2018 |
| JP | 2014163639 | A | 9/2014 |
| JP | 2015059669 | A | 3/2015 |

* cited by examiner

HEAT EXCHANGER

CROSS REFERENCE TO RELATED APPLICATION

The present application is a continuation application of International Patent Application No. PCT/JP2020/027526 filed on Jul. 15, 2020, which designated the U.S. and claims the benefit of priority from Japanese Patent Application No. 2019-131333 filed on Jul. 16, 2019. The entire disclosures of all of the above applications are incorporated herein by reference.

TECHNICAL FIELD

The present disclosure relates to a heat exchanger in which heat is exchanged between a heat medium and a refrigerant.

BACKGROUND

An air conditioner is provided with a condensing portion that is a part of a refrigeration cycle. In a condenser, heat is radiated from a refrigerant by heat exchange with air, and the refrigerant changes from a gas phase to a liquid phase.

SUMMARY

According to an aspect of the present disclosure, a heat exchanger includes a plate stack in which a plurality of plates are stacked to form a condensing portion and a subcooling portion. The condensing portion is formed such that a first refrigerant flow path through which a gas-phase refrigerant flowing into a refrigerant inlet flows and a first heat-medium flow path through which a heat medium flows overlap each other in a stacking direction of the plurality of plates. The condensing portion radiates heat from the gas-phase refrigerant to the heat medium to condense the gas-phase refrigerant, and discharges the condensed refrigerant toward a gas-liquid separator. The gas-liquid separator separates the refrigerant condensed by the condensing portion into the gas-phase refrigerant and a liquid-phase refrigerant and discharges the liquid-phase refrigerant out of the gas-phase refrigerant and the liquid-phase refrigerant. The subcooling portion is disposed on one side in the stacking direction with respect to the condensing portion, is formed such that a second refrigerant flow path through which the liquid-phase refrigerant discharged from the gas-liquid separator flows toward a refrigerant outlet and a second heat-medium flow path through which the heat medium flows overlap each other in the stacking direction. The subcooling portion radiates heat from the liquid-phase refrigerant to the heat medium to subcool the liquid-phase refrigerant. Each of the refrigerant inlet and the refrigerant outlet is disposed on an opposite side of the subcooling portion with respect to the condensing portion or on an opposite side of the condensing portion with respect to the subcooling portion.

DESCRIPTION OF EMBODIMENTS

Figure 1:
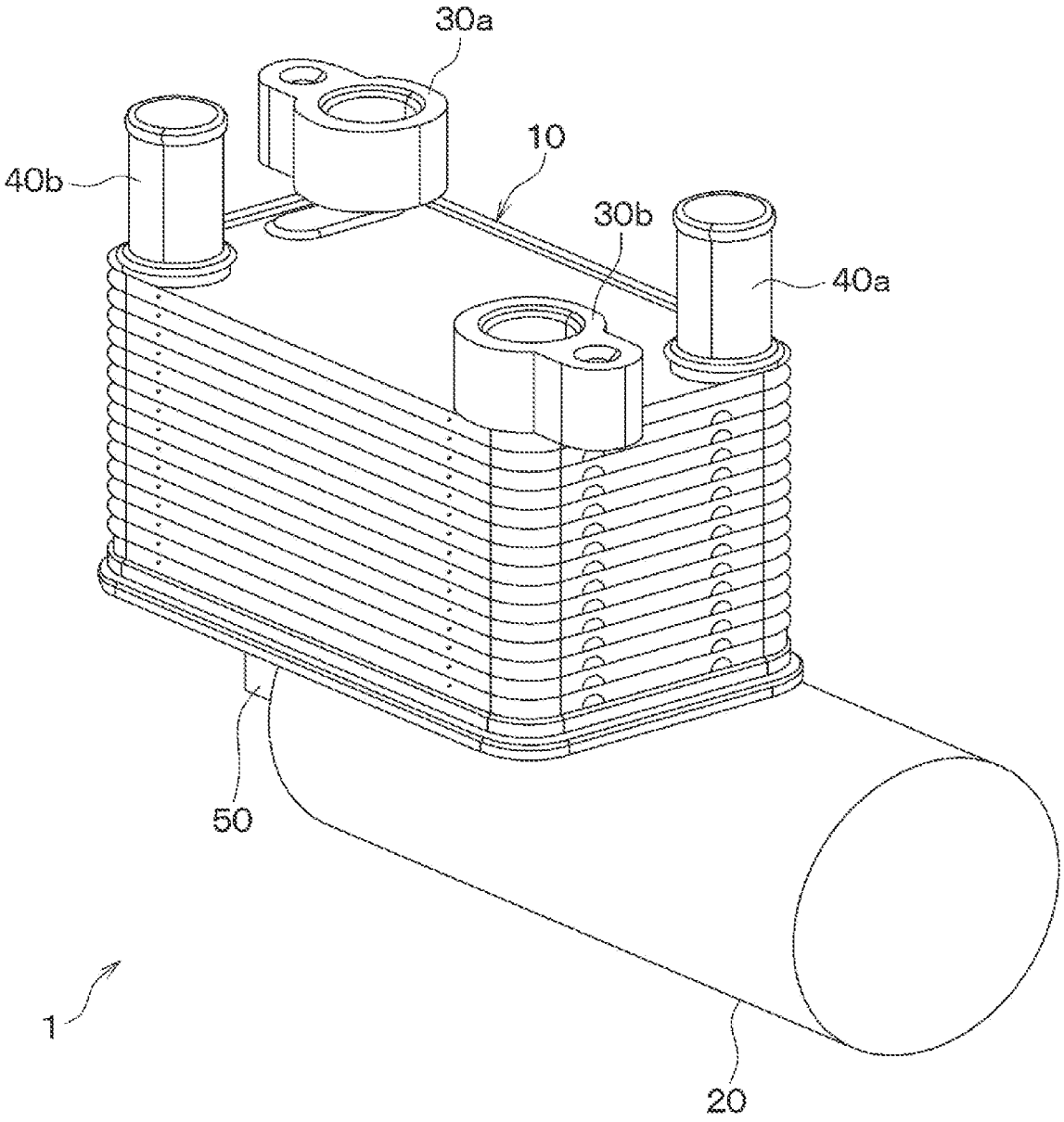
FIG. 1 is a perspective view illustrating an overall configuration of a heat exchanger according to a first embodiment.

To begin with, examples of relevant techniques will be described.

An air conditioner is provided with a condensing portion that is a part of a refrigeration cycle. In a condenser, heat is radiated from a refrigerant by heat exchange with air, and the refrigerant changes from a gas phase to a liquid phase.

In recent years, there has been a condenser configured to exchange heat between a refrigerant and cooling water for heat management. Here, the condenser is provided with a gas-liquid separator for separating the refrigerant having radiated heat into a liquid-phase refrigerant and a gas-phase refrigerant, and a subcooling portion for further cooling the liquid-phase refrigerant discharged from the gas-liquid separator.

A heat exchanger, as a condenser, includes a plate stack formed by stacking a plurality of plates, in which the plate stack includes a condensing portion and a subcooling portion.

Hereinafter, for convenience of description, a direction in which a plurality of plates are stacked is defined as a stacking direction, and a direction orthogonal to the stacking direction is defined as an orthogonal direction. The plate stack is configured such that the condensing portion and the subcooling portion are arranged in the orthogonal direction.

The present inventor has studied disposing a condensing portion on one side in a stacking direction of a plate stack with respect to a subcooling portion, in a heat exchanger including the plate stack in which a plurality of plates are stacked and heat exchange is performed between a refrigerant and cooling water.

The plate stack includes a refrigerant flow path and a cooling water flow path formed between two adjacent plates of the plurality of plates. The refrigerant in the refrigerant flow path and the cooling water in the cooling water flow path are subjected to heat exchange.

When the refrigerant inlet through which the refrigerant enters the condensing portion is disposed on one side in the stacking direction of the plate stack, and the refrigerant outlet through which the liquid-phase refrigerant is discharged from the subcooling portion is disposed on the other side in the stacking direction of the plate stack, the following occurs.

That is, in addition to connecting an inlet-side refrigerant pipe to the plate stack from one side in the stacking direction, it is necessary to connect an outlet-side refrigerant pipe to the plate stack from the other side in the stacking direction.

For this reason, the refrigerant pipes need to be connected to both sides of the plate stack such as one side in the stacking direction and the other side in the stacking direction, and hence the number of assembling steps increases in the manufacturing process.

On the other hand, an outlet for discharging the refrigerant from the condensing portion is defined as a discharge port, and an inlet for guiding the liquid-phase refrigerant from the gas-liquid separator to the subcooling portion is defined as an introduction port. When the discharge port is disposed on one side in the stacking direction of the plate stack, and the introduction port is disposed on the other side in the stacking direction of the plate stack, the following occurs.

That is, in order to connect the discharge port, the introduction port, and the gas-liquid separator, it is necessary to connect the refrigerant inlet of the gas-liquid separator to one side in the stacking direction of the plate stack and to connect the refrigerant outlet of the gas-liquid separator to the other side in the stacking direction of the plate stack.

This requires work for connecting the gas-liquid separator to both sides of the plate stack such as one side in the stacking direction and the other side in the stacking direction. Therefore, the number of assembling steps increases in the manufacturing process.

The present disclosure provides a heat exchanger that reduces the number of assembling steps.

According to an aspect of the present disclosure, a heat exchanger includes a plate stack in which a plurality of plates are stacked to form a condensing portion and a subcooling portion. The condensing portion is formed such that a first refrigerant flow path through which a gas-phase refrigerant flowing into a refrigerant inlet flows and a first heat-medium flow path through which a heat medium flows overlap each other in a stacking direction of the plurality of plates. The condensing portion radiates heat from the gas-phase refrigerant to the heat medium to condense the gas-phase refrigerant, and discharges the condensed refrigerant toward a gas-liquid separator. The gas-liquid separator separates the refrigerant condensed by the condensing portion into the gas-phase refrigerant and a liquid-phase refrigerant and discharges the liquid-phase refrigerant out of the gas-phase refrigerant and the liquid-phase refrigerant. The subcooling portion is disposed on one side in the stacking direction with respect to the condensing portion, is formed such that a second refrigerant flow path through which the liquid-phase refrigerant discharged from the gas-liquid separator flows toward a refrigerant outlet and a second heat-medium flow path through which the heat medium flows overlap each other in the stacking direction. The subcooling portion radiates heat from the liquid-phase refrigerant to the heat medium to subcool the liquid-phase refrigerant. Each of the refrigerant inlet and the refrigerant outlet is disposed on an opposite side of the subcooling portion with respect to the condensing portion or on an opposite side of the condensing portion with respect to the subcooling portion.

It is thus possible to connect the refrigerant pipe to the refrigerant inlet and the refrigerant outlet from the side opposite to the subcooling portion with respect to the condensing portion or from the side opposite to the condensing portion with respect to the subcooling portion.

Therefore, the number of assembling steps can be reduced as compared to a case where one of the refrigerant inlet and the refrigerant outlet is disposed on the opposite side of the subcooling portion with respect to the condensing portion and the other of the refrigerant inlet and the refrigerant outlet is disposed on the opposite side of the condensing portion with respect to the subcooling portion.

Here, the other of the refrigerant inlet and the refrigerant outlet means the remainder except for the one of the refrigerant inlet and the refrigerant outlet.

According to another aspect of the present disclosure, a heat exchanger includes a plate stack and a gas-liquid separator.

The plate stack includes: a first plate, a second plate, and a third plate formed in a plate shape spreading in a first direction and stacked in a second direction intersecting the first direction; and a fourth plate, a fifth plate, and a sixth plate that are disposed in the second direction with respect to the first plate, the second plate, and the third plate, are formed in a plate shape spreading in the first direction, and are stacked in the second direction.

A first refrigerant flow path through which the refrigerant flowing from the refrigerant inlet flows is formed between the first plate and the second plate, and a first heat-medium flow path through which the heat medium flows is formed between the second plate and the third plate.

The first plate, the second plate, and the third plate constitute a condensing portion that radiates heat from the refrigerant in the first refrigerant flow path to the heat medium in the first heat-medium flow path.

The gas-liquid separator separates the refrigerant discharged from the first refrigerant flow path into a gas-phase refrigerant and a liquid-phase refrigerant and discharges the liquid-phase refrigerant out of the gas-phase refrigerant and the liquid-phase refrigerant.

A second refrigerant flow path through which the liquid-phase refrigerant discharged from the gas-liquid separator flows toward a refrigerant outlet is formed between the fourth plate and the fifth plate.

A second heat-medium flow path through which the heat medium flows is formed between the fifth plate and the sixth plate.

The fourth plate, the fifth plate, and the sixth plate constitute a subcooling portion that radiates heat from the liquid-phase refrigerant in the second refrigerant flow path to the heat medium in the second heat-medium flow path, and the refrigerant inlet and the refrigerant outlet are disposed on an opposite side of the subcooling portion with respect to the condensing portion.

Accordingly, the refrigerant pipe can be connected to the refrigerant inlet and the refrigerant outlet from the side opposite to the subcooling portion with respect to the condensing portion. As a result, the number of assembling steps can be reduced as compared to a case where one of the refrigerant inlet and the refrigerant outlet is disposed on one side in a second direction and the other of the refrigerant inlet and the refrigerant outlet is disposed on the other side in the second direction.

Here, the other of the refrigerant inlet and the refrigerant outlet means the remainder except for the one of the refrigerant inlet and the refrigerant outlet.

According to another aspect of the present disclosure, a heat exchanger includes a plate stack and a gas-liquid separator.

The plate stack includes

- a first plate, a second plate, and a third plate formed in a plate shape spreading in a first direction and stacked in a second direction intersecting the first direction, and
- a fourth plate, a fifth plate, and a sixth plate that are disposed on one side in the second direction with respect to the first plate, the second plate, and the third plate, are formed in a plate shape spreading in the first direction, and are stacked in the second direction.

A discharge port and an introduction port are formed in the plate stack.

A first refrigerant flow path through which a refrigerant flowing from a refrigerant inlet flows toward the discharge port is formed between the first plate and the second plate, and a first heat-medium flow path through which a heat medium flows is formed between the second plate and the third plate.

The first plate, the second plate, and the third plate constitute a condensing portion that radiates heat from the refrigerant in the first refrigerant flow path to the heat medium in the first heat-medium flow path.

The gas-liquid separator separates the refrigerant discharged from the condensing portion into a gas-phase refrigerant and a liquid-phase refrigerant and discharges the liquid-phase refrigerant out of the gas-phase refrigerant and the liquid-phase refrigerant toward the introduction port.

A second refrigerant flow path through which the liquid-phase refrigerant from the introduction port flows toward a refrigerant outlet is formed between the fourth plate and the fifth plate.

A second heat-medium flow path through which the heat medium flows is formed between the fifth plate and the sixth plate.

The fourth plate, the fifth plate, and the sixth plate constitute a subcooling portion that radiates heat from the liquid-phase refrigerant in the second refrigerant flow path to the heat medium in the second heat-medium flow path.

The fourth plate, the fifth plate, and the sixth plate include a first through flow path that penetrates the fourth plate, the fifth plate, and the sixth plate to guide the refrigerant from the first refrigerant flow path to the discharge port.

The first plate, the second plate, and the third plate include a second through flow path that penetrates the first plate, the second plate, and the third plate to guide the liquid-phase refrigerant from the second refrigerant flow path to the refrigerant outlet, and the discharge port and the introduction port are disposed on an opposite side of the condensing portion with respect to the subcooling portion.

Accordingly, the refrigerant pipe can be connected to the refrigerant inlet and the refrigerant outlet from the side opposite to the subcooling portion with respect to the condensing portion. As a result, the number of assembling steps can be reduced as compared to a case where one of the refrigerant inlet and the refrigerant outlet is disposed on one side in a second direction and the other of the refrigerant inlet and the refrigerant outlet is disposed on the other side in the second direction.

According to another aspect of the present disclosure, a heat exchanger includes a plate stack and a gas-liquid separator.

The plate stack includes a first plate, a second plate, and a third plate that are formed in a plate shape spreading in a first direction and stacked in a second direction intersecting the first direction.

A refrigerant inlet through which a refrigerant flows and a refrigerant outlet through which the refrigerant is discharged are formed in the plate stack.

A first refrigerant flow path through which the refrigerant flowing from the refrigerant inlet flows toward the refrigerant outlet is formed between the first plate and the second plate, and a first heat-medium flow path through which a heat medium flows is formed between the second plate and the third plate.

The first plate, the second plate, and the third plate constitute a condensing portion that radiates heat from the refrigerant in the first refrigerant flow path to the heat medium in the first heat-medium flow path.

The refrigerant inlet and the refrigerant outlet are disposed on one side or the other side in the second direction with respect to the condensing portion.

Accordingly, the refrigerant pipe can be connected to the refrigerant inlet and the refrigerant outlet from one side or the other side in the second direction with respect to the condensing portion. As a result, the number of assembling steps can be reduced as compared to a case where one of the refrigerant inlet and the refrigerant outlet is disposed on one side in a second direction and the other of the refrigerant inlet and the refrigerant outlet is disposed on the other side in the second direction.

A parenthesized reference symbol attached to each component or the like shows an example of a correspondence of a component or the like and a specific component or the like described in embodiments to be described later.

Hereinafter, embodiments of the present disclosure will be described with reference to the drawings. In the following embodiments, the same or equivalent portions are denoted by the same reference numerals in the drawings in order to simplify the description.

First Embodiment

Hereinafter, a heat exchanger 1 of the present first embodiment will be described with reference to FIGS. 1 to 4 and the like.

The heat exchanger 1 of the present embodiment constitutes a refrigeration cycle of an in-vehicle air conditioner. The heat exchanger 1 is a radiator that radiates heat from a high-pressure refrigerant discharged from a refrigerant outlet of a compressor to cooling water by heat exchange between the high-pressure refrigerant and the cooling water and discharges the radiated refrigerant to a refrigerant inlet of a pressure reducing valve.

Figure 2:
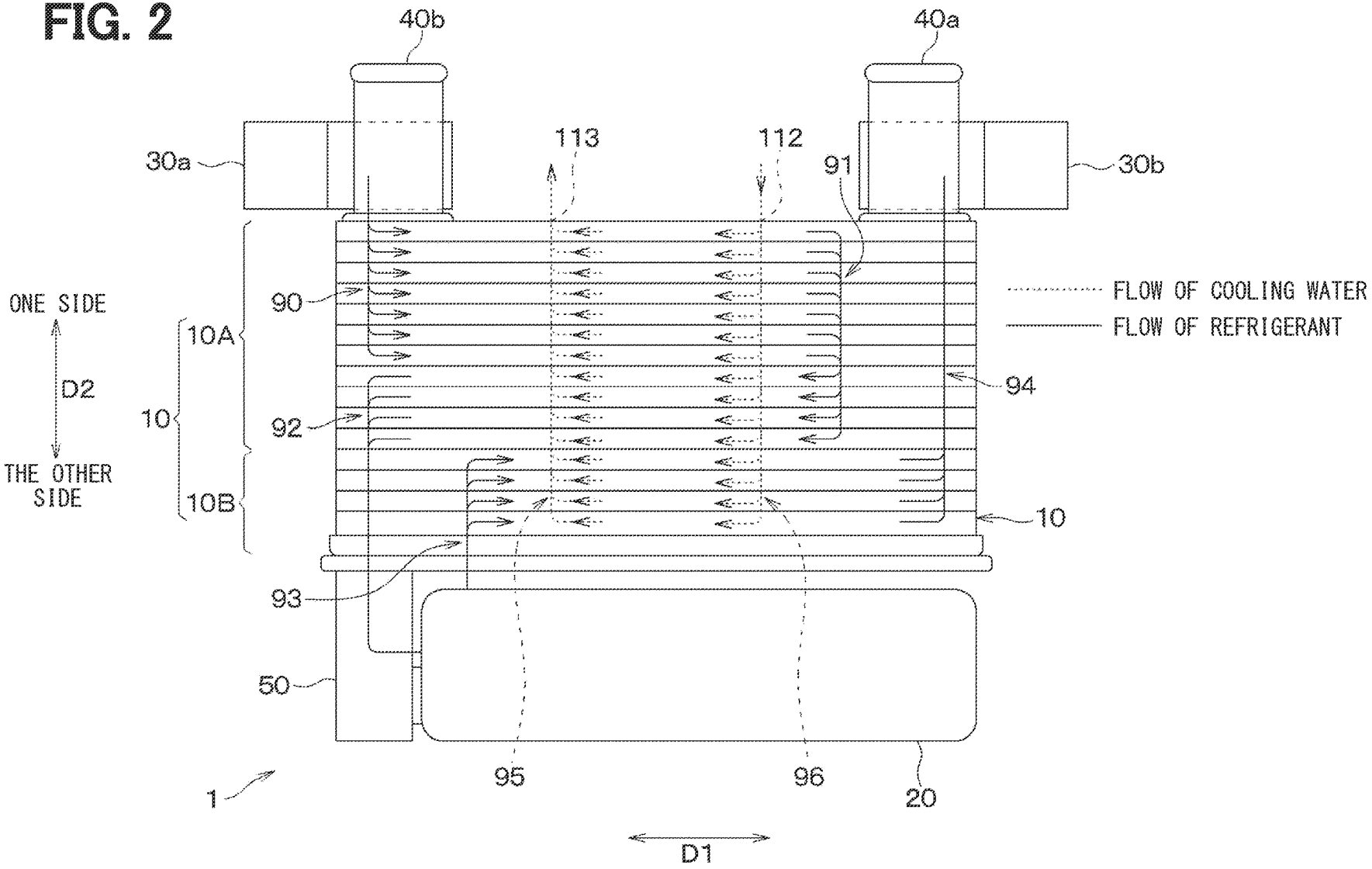
FIG. 2 is a schematic view illustrating an overall configuration of the heat exchanger of FIG. 1 and a flow of a refrigerant and a flow of cooling water in the heat exchanger.

As illustrated in FIG. 1, the heat exchanger 1 includes a plate stack 10, a gas-liquid separator 20, refrigerant connectors 30*a*, 30*b*, cooling water connectors 40*a*, 40*b*, and a receiver connector 50. As illustrated in FIG. 2, the plate stack 10 includes a condensing portion 10A and a subcooling portion 10B.

The condensing portion 10A is a heat exchange portion that radiates heat from a high-pressure refrigerant flowing from the compressor to cooling water by heat exchange between the high-pressure refrigerant and the cooling water. The subcooling portion 10B is a heat exchange portion that radiates heat from a liquid-phase refrigerant flowing out of the gas-liquid separator 20 to the cooling water by heat exchange between the liquid-phase refrigerant and the cooling water.

The gas-liquid separator 20 separates the refrigerant flowing out of the condensing portion 10A into a gas-phase refrigerant and a liquid-phase refrigerant and discharges the liquid-phase refrigerant out of the gas-phase refrigerant and the liquid-phase refrigerant. The condensing portion 10A of the present embodiment is disposed on one side in a second direction D2 with respect to the subcooling portion 10B (e.g., the upper side in FIG. 2).

The gas-liquid separator 20 is disposed on the other side (e.g., the lower side in FIG. 2) in the second direction D2 with respect to the subcooling portion 10B. The second direction D2 is a stacking direction in which plates to be described later are stacked. The refrigerant connector 30*a* and the refrigerant connector 30*b* are disposed on one side in the second direction D2 with respect to the condensing portion 10A.

The refrigerant connector 30*a* is a connector that connects the inlet-side refrigerant pipe and a refrigerant inlet 110 of the condensing portion 10A. The inlet-side refrigerant pipe is a refrigerant pipe for guiding the high-pressure refrigerant discharged from the compressor to the refrigerant inlet 110 of the heat exchanger 1.

The refrigerant connector 30*b* is a connector that connects a refrigerant outlet 111 of the subcooling portion 10B and the outlet-side refrigerant pipe. The outlet-side refrigerant pipe is a refrigerant pipe for guiding the refrigerant flowing from the refrigerant outlet 111 of the subcooling portion 10B to the refrigerant inlet of the pressure reducing valve.

The receiver connector 50 connects a discharge port 114 of the condensing portion 10A and a refrigerant inlet of the gas-liquid separator 20 and connects an introduction port 115 of the subcooling portion 10B and the refrigerant outlet of the gas-liquid separator 20.

That is, the gas-liquid separator 20 is connected to the plate stack 10 via the discharge port 114 and the introduction port 115. The gas-liquid separator 20 is disposed on the opposite side of the condensing portion 10A with respect to the subcooling portion 10B.

Thereby, the refrigerant flowing from the discharge port 114 of the condensing portion 10A is guided to the refrigerant inlet of the gas-liquid separator 20, and the liquid-phase refrigerant flowing from the refrigerant outlet of the gas-liquid separator 20 is guided to the introduction port 115 of the subcooling portion 10B.

Figure 3:
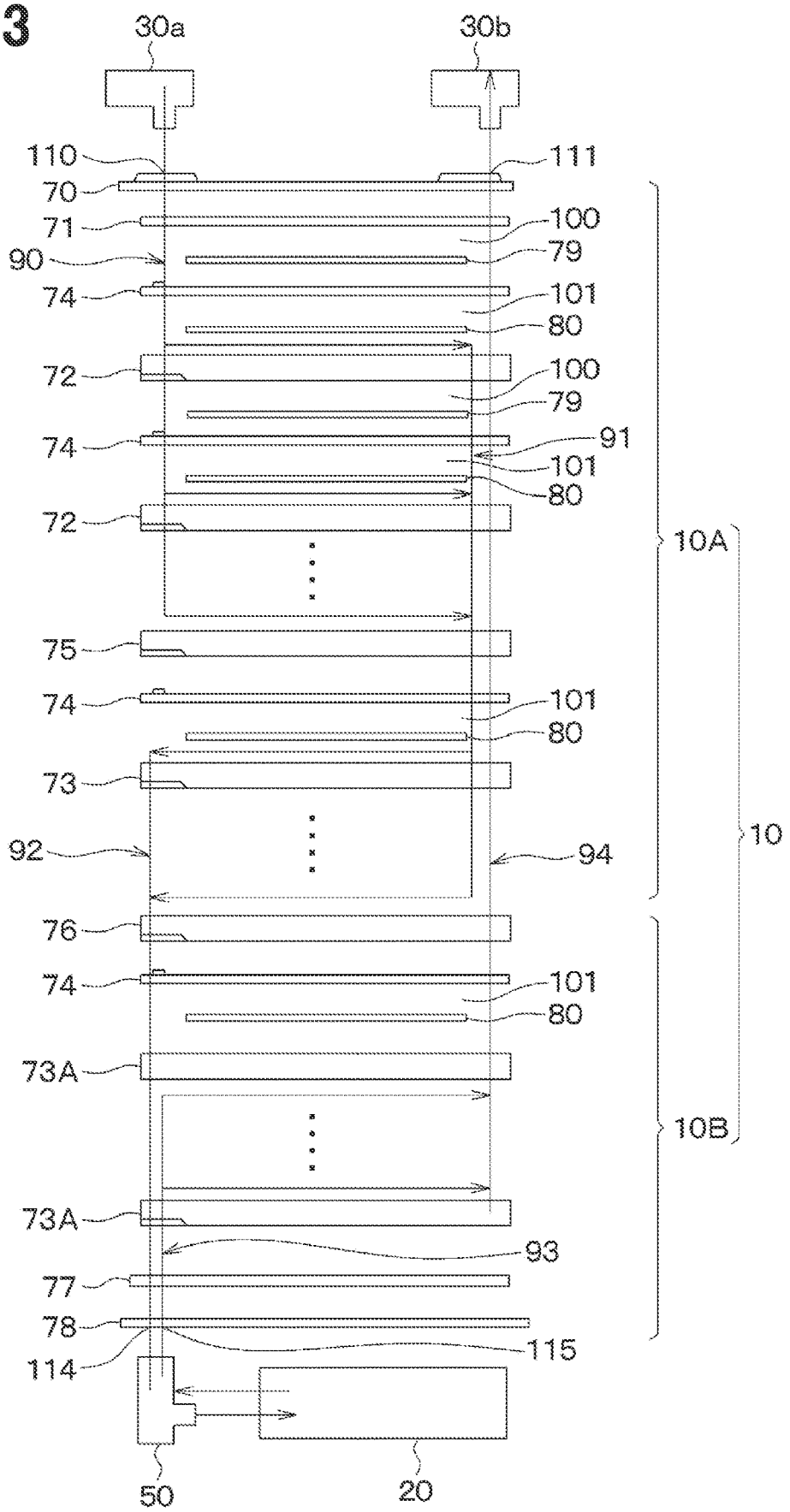
FIG. 3 is a view illustrating a placement relationship between a top plate, a top outer plate, first outer plates, second outer plates, inner plates, a first partition outer plate, and the like constituting the heat exchanger of FIG. 1 and refrigerant through-holes.

The discharge port 114 of the condensing portion 10A and the introduction port 115 of the subcooling portion 10B in the present embodiment are disposed on the other side in the second direction D2 with respect to the subcooling portion 10B (e.g., the lower side in FIG. 3). The second direction D2 is a stacking direction in which a plurality of plates 70, 71, 72, 73, 73A, 74, 75, 76, and the like constituting the plate stack 10 are stacked.

The plate stack 10 of FIG. 3 includes a top plate 70, a top outer plate 71, a plurality of first outer plates 72, a plurality of second outer plates 73, a plurality of inner plates 74, a first partition outer plate 75, and a second partition outer plate 76.

In addition, the plate stack 10 of FIG. 3 is provided with a plurality of reverse second outer plates 73A, a bottom plate 77, a bracket 78, a plurality of cooling water fins 79, and a plurality of refrigerant fins 80.

Figure 4:
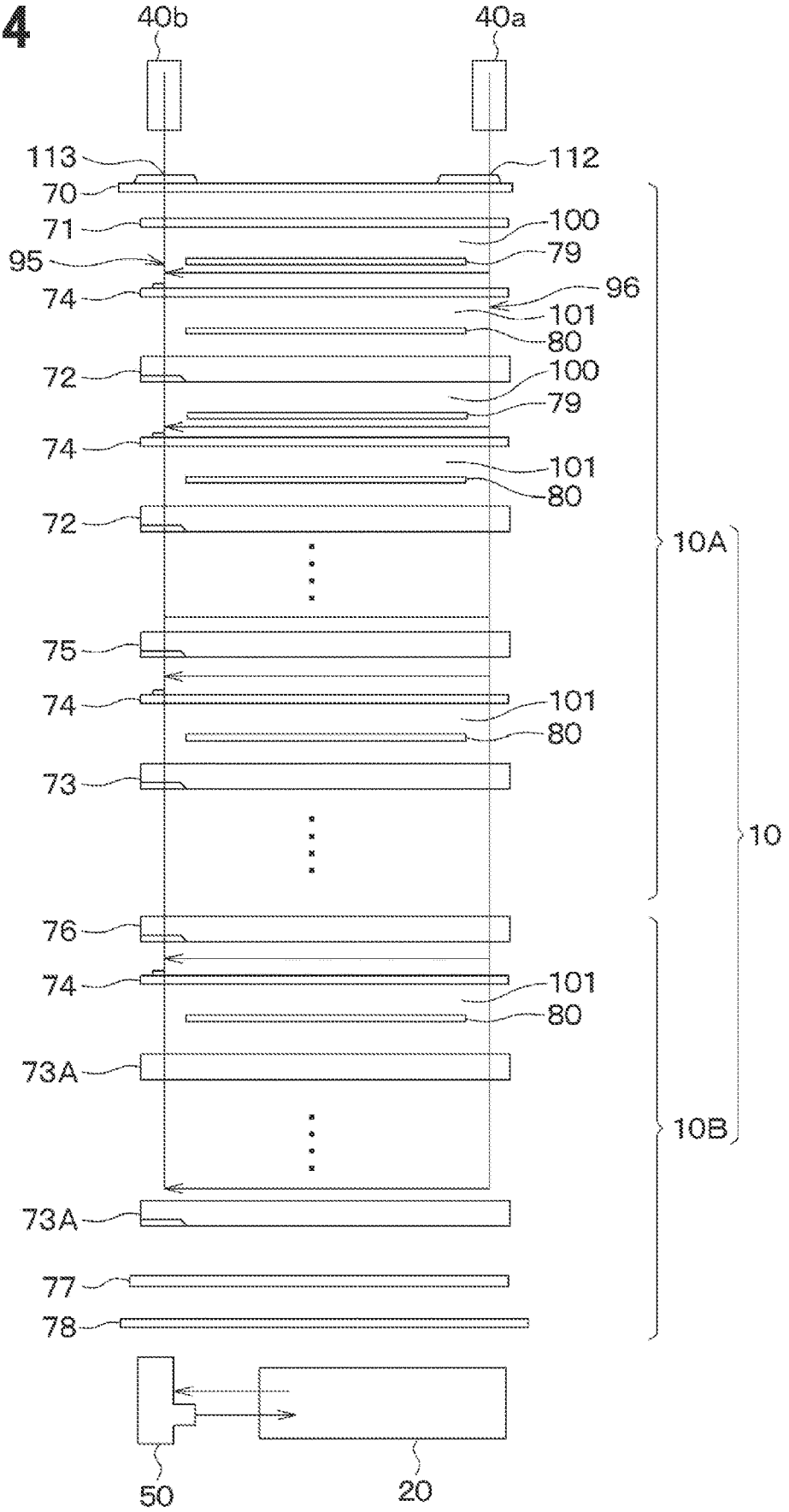
FIG. 4 is a view illustrating a placement relationship between the top plate, the top outer plate, the first outer plates, the second outer plates, the inner plates, the first partition outer plate, and the like constituting the heat exchanger of FIG. 1 and cooling water through-holes.

Further, as illustrated in FIGS. 3 and 4, the plate stack 10 is provided with refrigerant through-holes 90, 91, 92, 93, 94 and cooling water through-holes 95, 96. The refrigerant through-holes 90, 91, 92, 93, 94 and the cooling water through-holes 95, 96 are formed in the plate stack 10 over the second direction D2.

Specifically, the refrigerant through-hole 90 penetrates the top plate 70, the top outer plate 71, the plurality of first outer plates 72, and the plurality of inner plates 74 in the second direction D2.

The refrigerant through-hole 91 penetrates the top plate 70, the top outer plate 71, the plurality of first outer plates 72, the plurality of inner plates 74, the first partition outer plate 75, and the plurality of second outer plates 73 in the second direction D2.

The refrigerant through-hole 92 penetrates the plurality of second outer plates 73, the plurality of inner plates 74, the second partition outer plate 76, the plurality of reverse second outer plates 73A, the bottom plate 77, and the bracket 78.

The refrigerant through-hole 93 penetrates the plurality of inner plates 74, the plurality of reverse second outer plates 73A, the bottom plate 77, and the bracket 78.

The refrigerant through-hole 94 penetrates the top plate 70, the top outer plate 71, the plurality of first outer plates 72, the plurality of second outer plates 73, the plurality of inner plates 74, the first partition outer plate 75, and the second partition outer plate 76. The refrigerant through-hole 94 penetrates the plurality of reverse second outer plates 73A.

The cooling water through-hole 95 penetrates the top plate 70, the top outer plate 71, the plurality of first outer plates 72, the plurality of second outer plates 73, the plurality of inner plates 74, the first partition outer plate 75, and the second partition outer plate 76. The cooling water through-hole 95 penetrates the plurality of reverse second outer plates 73A.

The cooling water through-hole 96 penetrates the top plate 70, the top outer plate 71, the plurality of first outer plates 72, the plurality of second outer plates 73, the plurality of inner plates 74, the first partition outer plate 75, and the second partition outer plate 76. The cooling water through-hole 96 penetrates the plurality of reverse second outer plates 73A.

Figure 5:
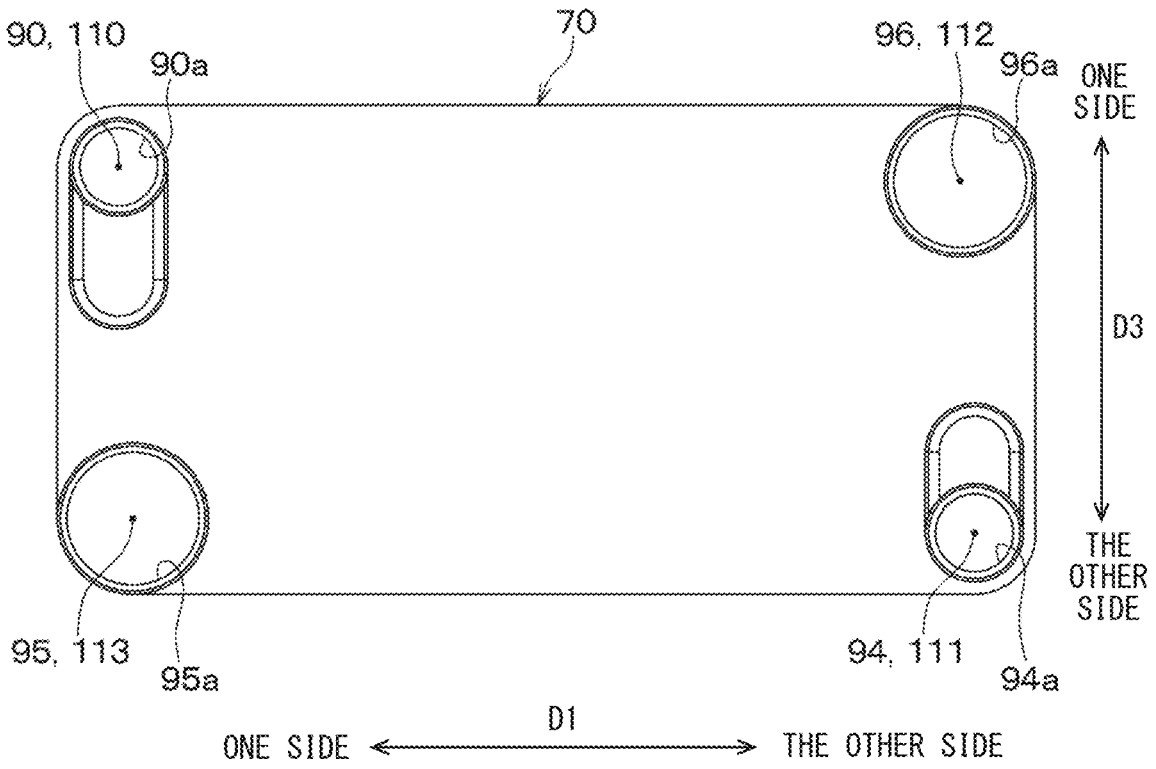
FIG. 5 is a view of the top plate in FIG. 3 as viewed from one side in a second direction.

The top plate 70 of FIG. 5 is formed in a plate shape spreading in a first direction D1 and a third direction D3. The first direction D1 and the third direction D3 are directions orthogonal to each other. The second direction D2 and the third direction D3 are directions orthogonal to each other.

The top plate 70 is formed with a through-hole forming portion 90*a* that forms the refrigerant through-hole 90. One side in the first direction D1 of the refrigerant through-hole 90 constitutes a refrigerant inlet 110. That is, the refrigerant inlet 110 is configured in the plate stack 10.

The refrigerant inlet 110 is disposed on one side in the first direction D1 (i.e., one side in the intersecting direction intersecting the stacking direction) of the plate stack 10. The through-hole forming portion 90*a* is disposed on one side in the first direction D1 and one side in the third direction D3 of the top plate 70.

The top plate 70 is formed with a through-hole forming portion 94*a* that forms the refrigerant through-hole 94. One side in the first direction D1 of the refrigerant through-hole 94 constitutes the refrigerant outlet 111. The refrigerant outlet 111 is configured in the plate stack 10.

The refrigerant outlet 111 is disposed on the other side in the first direction D1 (i.e., the other side in the intersecting direction intersecting the stacking direction) of the plate stack 10. The through-hole forming portion 94*a* is disposed on the other side in the first direction D1 and on the other side in the third direction D3 of the top plate 70.

In the top plate 70, a through-hole forming portion 95*a* forming the cooling water through-hole 95 is formed. One side in the first direction D1 of the cooling water through-hole 95 constitutes a cooling water outlet 113. The through-hole forming portion 95*a* is disposed on one side in the first direction D1 and on the other side in the third direction D3 of the top plate 70.

In the top plate 70, a through-hole forming portion 96*a* forming the cooling water through-hole 96 is formed. One side in the first direction D1 of the cooling water through-hole 96 constitutes a cooling water inlet 112. The through-hole forming portion 96*a* is disposed on the other side in the first direction D1 and on one side in the third direction D3 of the top plate 70.

Figure 6:
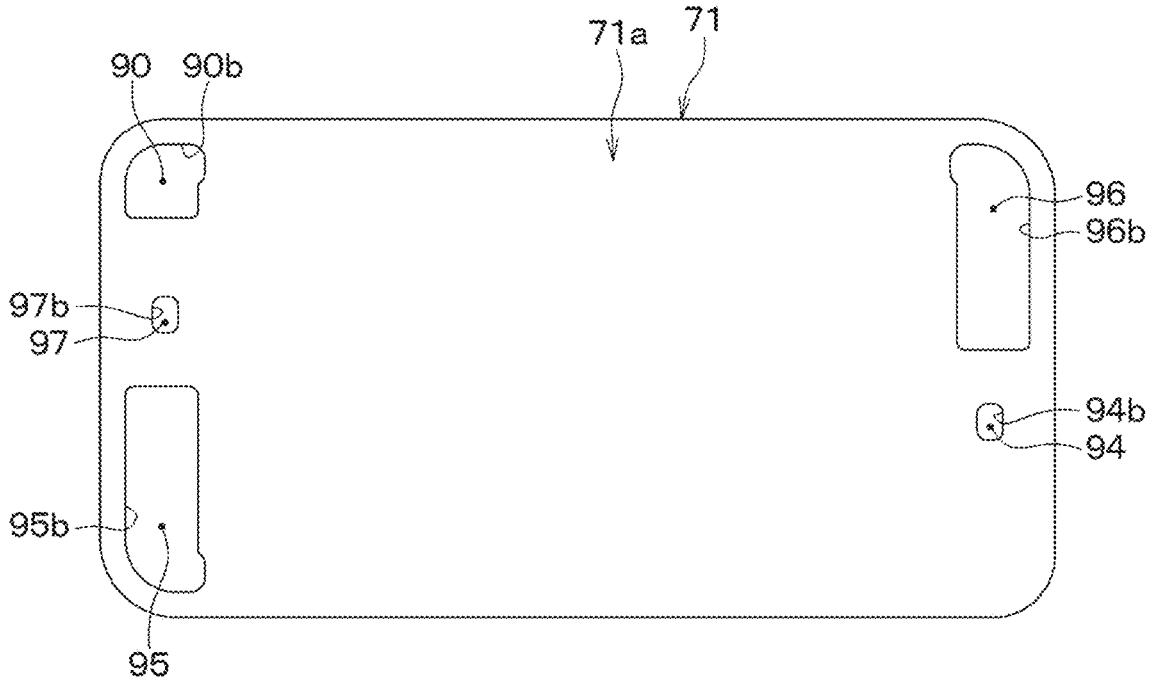
FIG. 6 is a view of the top outer plate in FIG. 3 as viewed from one side in the second direction.

The top outer plate 71 of FIG. 6 is formed in a plate shape spreading in the first direction D1 and the third direction D3. In the top outer plate 71, the dimension in the first direction D1 is larger than the dimension in the third direction D3.

Specifically, the top outer plate 71 includes a bottom 71*a* formed in a rectangular shape spreading in the first direction D1 and the third direction D3.

A through-hole forming portion 90*b* forming the refrigerant through-hole 90 is formed in the bottom 71*a*. The through-hole forming portion 90*b* is disposed on one side in the first direction D1 and one side in the third direction D3 of the bottom 71*a*.

A through-hole forming portion 94*b* forming the refrigerant through-hole 94 is formed in the bottom 71*a*. The through-hole forming portion 94*b* is disposed on the other side in the first direction D1 and on the intermediate side in the third direction D3 of the bottom 71*a*.

A through-hole forming portion 96*b* forming the cooling water through-hole 96 is formed in the bottom 71*a*. The through-hole forming portion 96*b* is disposed on one side in the first direction D1 and on the other side in the third direction D3 of the bottom 71*a*.

A through-hole forming portion 95*b* forming the cooling water through-hole 95 is formed in the bottom 71*a*. The through-hole forming portion 95*b* is disposed on the other side in the first direction D1 and on one side in the third direction D3 of the bottom 71*a*.

Figure 7:
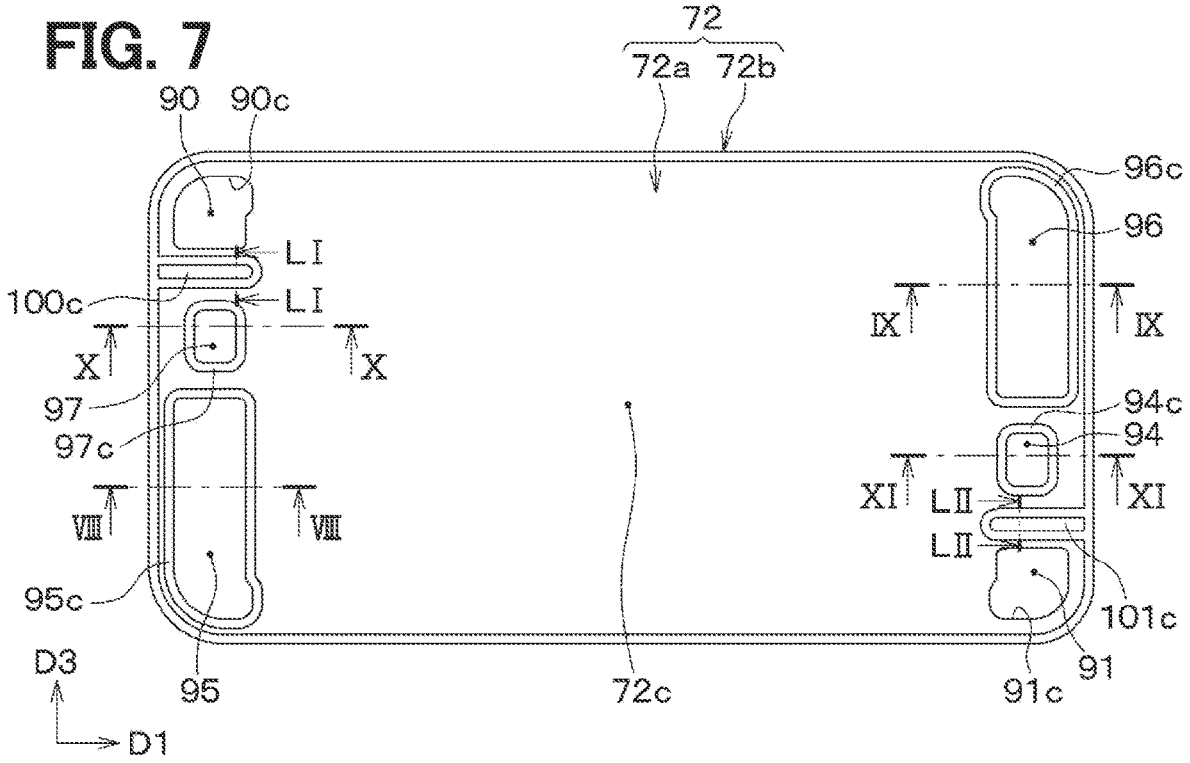
FIG. 7 is a view of the first outer plate in FIG. 3 as viewed from the one side in the second direction.

The plurality of first outer plates 72 in FIG. 7 are each formed in a plate shape spreading in the first direction D1 and the third direction D3. In the first outer plate 72, the dimension in the first direction D1 is larger than the dimension in the third direction D3.

Specifically, each of the plurality of first outer plates 72 includes a bottom 72*a* formed in a rectangular shape spreading in the first direction D1 and the third direction D3, and a side 72*b* surrounding the entire circumference of the bottom 72*a*.

The side 72*b* is formed to protrude from the bottom 72*a* toward one side in the second direction D2 (i.e., the front side in the drawing of FIG. 7).

A through-hole forming portion 90*c* forming a refrigerant through-hole (i.e., third flow path) 90 is formed in the bottom 72*a*. The through-hole forming portion 90*c* is a third flow path forming portion disposed on one side in the first direction D1 and one side in the third direction D3 of the bottom 72*a*.

A through-hole forming portion 91*c* forming a refrigerant through-hole (i.e., sixth flow path) 91 is formed in the bottom 72*a*. The through-hole forming portion 91*c* is a sixth flow path forming portion disposed on the other side in the first direction D1 and the other side in the third direction D3 of the bottom 72*a*.

A through-hole forming portion 94*c* forming a refrigerant through-hole (i.e., first flow path) 94 is formed in the bottom 72*a*. The through-hole forming portion 94*c* is a first flow path forming portion disposed on the other side in the first direction D1 and on the intermediate side in the second direction D2 of the bottom 72*a*.

A through-hole forming portion 95*c* forming a cooling water through-hole (i.e., eighth flow path) 95 is formed in the bottom 72*a*. The through-hole forming portion 95*c* is an eighth flow path forming portion disposed on one side in the first direction D1 and the other side in the third direction D3 of the bottom 72*a*.

A through-hole forming portion 96*c* forming a cooling water through-hole (i.e., seventh flow path) 96 is formed in the bottom 72*a*. The through-hole forming portion 96*c* is a seventh flow path forming portion disposed on the other side in the first direction D1 and on one side in the third direction D3 of the bottom 72*a*.

A through-hole forming portion 97*c* forming a refrigerant through-hole 97 is formed in the bottom 72*a*. The through-hole forming portion 97*c* is disposed on one side in the first direction D1 and on the intermediate side in the third direction D3 of the bottom 72*a*. The refrigerant through-hole 97 of the present embodiment is not used as a passage for the refrigerant or the cooling water.

Each of the through-hole forming portions 90*c*, 91*c* is disposed at the same position as a refrigerant flow path forming portion 72*c* forming the refrigerant flow path 101 in the bottom 72*a* in the third direction D3. The refrigerant flow path forming portion 72*c* is a portion of the bottom 72*a* disposed on the intermediate side in the first direction D1.

Figure 8:
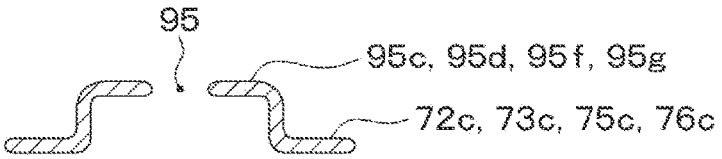
FIG. 8 is a cross-sectional view taken along line VIII-VIII in FIG. 7.
Figure 9:
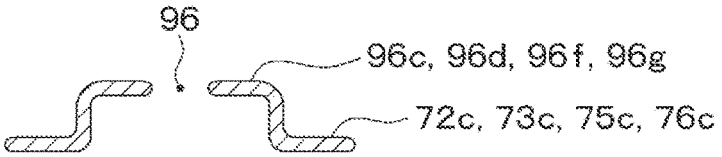
FIG. 9 is a cross-sectional view taken along line IX-IX in FIG. 7.

As illustrated in FIG. 8, the through-hole forming portion 95*c* is formed to protrude on one side in the third direction D3 with respect to the refrigerant flow path forming portion 72*c* forming the refrigerant flow path in the bottom 72*a*. As illustrated in FIG. 9, the through-hole forming portion 96*c* is formed to protrude on one side in the third direction D3 with respect to the refrigerant flow path forming portion 72*c* of the bottom 72*a*.

Figure 10:
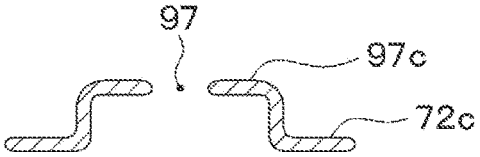
FIG. 10 is a cross-sectional view taken along line X-X in FIG. 7.
Figure 11:
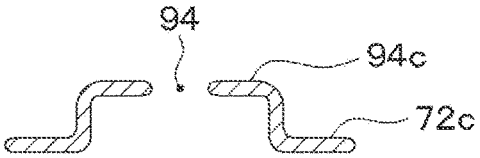
FIG. 11 is a cross-sectional view taken along line XI-XI in FIG. 7.

As illustrated in FIG. 10, the through-hole forming portion 97*c* is formed to protrude on one side in the third direction D3 with respect to the refrigerant flow path forming portion 72*c* of the bottom 72*a*. As illustrated in FIG. 11, the through-hole forming portion 94*c* is formed to protrude on one side in the third direction D3 with respect to the refrigerant flow path forming portion 72*c* of the bottom 72*a*.

Protrusions 100*c*, 101*c* are provided on the bottom 72*a*. Each of the protrusions 100*c*, 101*c* is formed to protrude on one side in the second direction D2 (i.e., the front side in the drawing of FIG. 7) with respect to the refrigerant flow path forming portion 72*c* of the bottom 72*a*.

Figure 12:
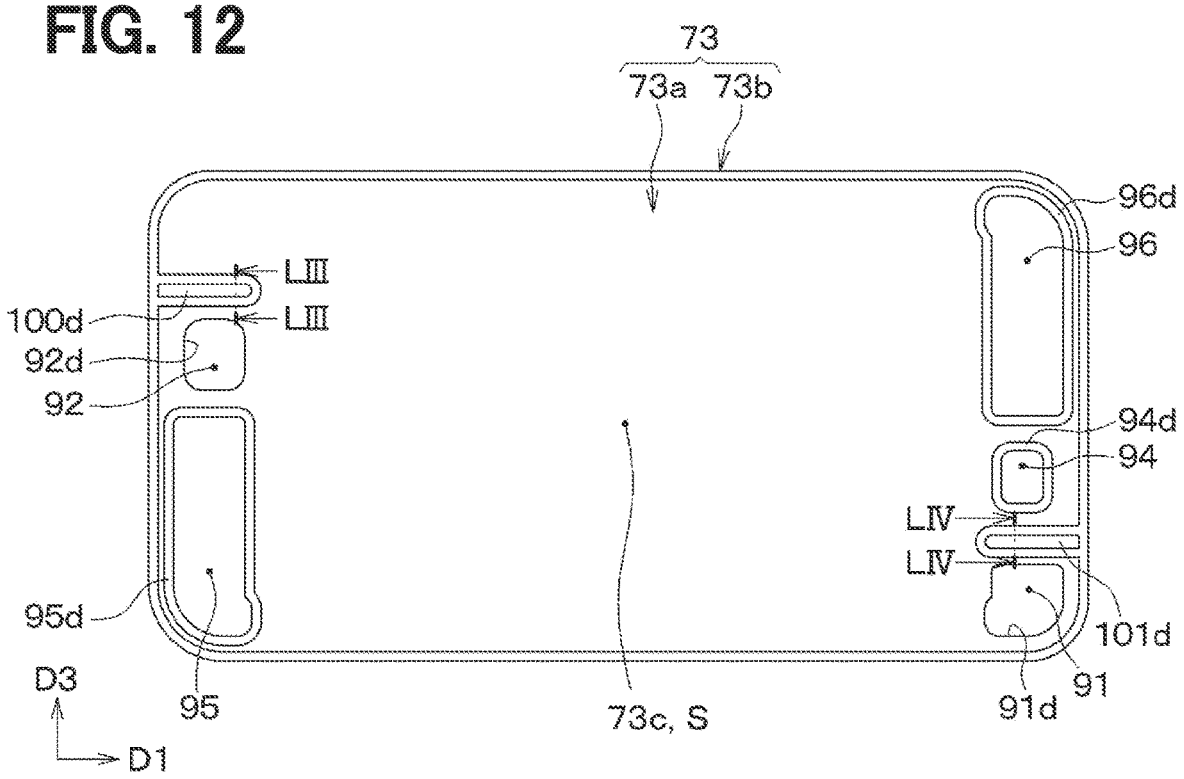
FIG. 12 is a view of the second outer plate in FIG. 3 as viewed from the one side in the second direction.

The protrusion 100*c* is disposed between the refrigerant through-holes 97 and 90. The protrusion 101*c* is disposed between the refrigerant through-holes 91 and 94. The plurality of second outer plates 73 of FIG. 12 are each formed in a plate shape spreading in the first direction D1 and the third direction D3. In the second outer plate 73, the dimension in the first direction D1 is larger than the dimension in the third direction D3.

Specifically, each of the plurality of second outer plates 73 includes a bottom 73*a* formed in a rectangular shape spreading in the first direction D1 and the third direction D3, and a side 73*b* surrounding the entire circumference of the bottom 73*a*.

The side 73*b* is formed to protrude from the bottom 73*a* toward the one side in the second direction D2. A through-hole forming portion 91*d* forming the refrigerant through-hole 91 is formed in the bottom 73*a*.

Here, the through-hole forming portion 91*d* is disposed on the other side in the first direction D1 and on the other side in the third direction D3 of the bottom 73*a*. A through-hole forming portion 92*d* forming the refrigerant through-hole 92 is formed in the bottom 73*a*. The through-hole forming portion 92*d* is disposed on the other side in the first direction D1 and on the intermediate side in the third direction D3 in the bottom 73*a*.

A through-hole forming portion 94*d* forming the refrigerant through-hole 94 is formed in the bottom 73*a*. The through-hole forming portion 94*d* is disposed on the other side in the first direction D1 and on the intermediate side in the third direction D3 in the bottom 73*a*.

A through-hole forming portion 95*d* forming the cooling water through-hole 95 is formed in the bottom 73*a*. The through-hole forming portion 95*d* is disposed on one side in the first direction D1 and on the other side in the third direction D3 of the bottom 73*a*.

A through-hole forming portion 96*d* forming the cooling water through-hole 96 is formed in the bottom 73*a*. The through-hole forming portion 96*d* is disposed on the other side in the first direction D1 and on one side in the third direction D3 of the bottom 73*a*. Each of the through-hole forming portions 91*d*, 92*d* is disposed at the same position as a refrigerant flow path forming portion 73*c* forming the refrigerant flow path in the bottom 73*a* in the third direction D3.

Each of the through-hole forming portions 94*c*, 95*c*, 96*c* is formed to protrude on one side in the third direction D3 with respect to the refrigerant flow path forming portion 73*c* forming the refrigerant flow path 101 in the bottom 73*a*. The refrigerant flow path forming portion 73*c* is disposed at an intermediate portion of the bottom 73*a* in the first direction D1. Protrusions 100*d*, 101*d* are provided on the bottom 73*a*.

Each of the protrusions 100*d*, 101*d* is formed to protrude on one side in the second direction D2 with respect to the refrigerant flow path forming portion 73*c* in the bottom 73*a*. The protrusion 100*d* is disposed on one side in the second direction D2 with respect to the refrigerant through-hole 92. The protrusion 101*d* is disposed between the refrigerant through-holes 91 and 94.

Figure 13:
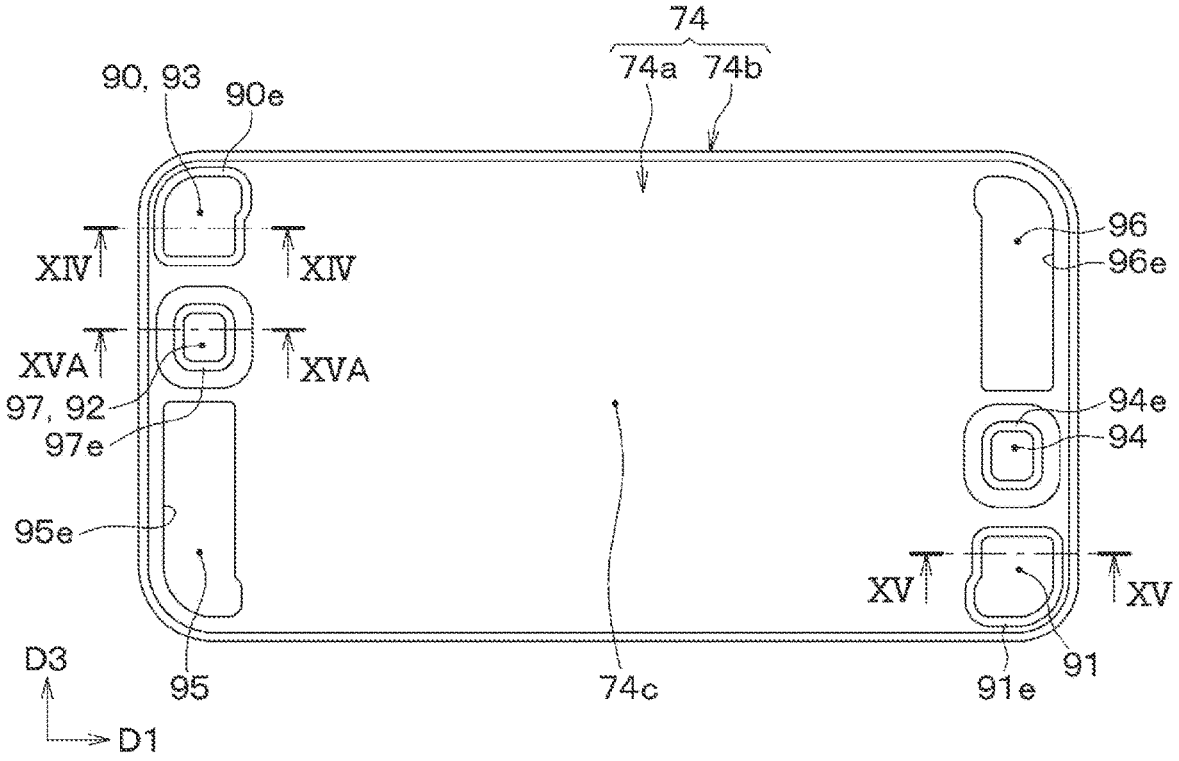
FIG. 13 is a view of the inner plate in FIG. 3 as viewed from the one side in the second direction.

Each of the plurality of inner plates 74 in FIG. 13 is formed in a plate shape spreading in the first direction D1 and the third direction D3. In the inner plate 74, the dimension in the first direction D1 is larger than the dimension in the third direction D3.

Specifically, each of the plurality of inner plates 74 includes a bottom 74*a* formed in a rectangular shape spreading in the first direction D1 and the third direction D3, and a side 74*b* surrounding the entire circumference of the bottom 74*a*. The side 74*b* is formed to protrude from the bottom 74*a* toward the one side in the second direction D2.

As will be described later, the bottom 74*a* is formed with a through-hole forming portion 90*e* that forms one of the refrigerant through-hole (i.e., third flow path) 90 and the refrigerant through-hole (i.e., fifth flow path) 93. The through-hole forming portion 90*e* is a third flow path forming portion or a fifth flow path forming portion disposed on one side in the first direction D1 and one side in the third direction D3 of the bottom 74*a*.

A through-hole forming portion 91*e* forming a refrigerant through-hole (i.e., sixth flow path) 91 is formed in the bottom 74*a*. The through-hole forming portion 91*e* is a sixth flow path forming portion disposed on the other side in the first direction D1 and the other side in the third direction D3 of the bottom 74*a*.

A through-hole forming portion 94*e* forming a refrigerant through-hole (i.e., first flow path and fourth flow path) 94 is formed in the bottom 74*a*. The through-hole forming portion 94*e* is a first flow path forming portion disposed on the other side in the first direction D1 and on the intermediate side in the third direction D3 in the bottom 74*a*.

A through-hole forming portion 95*e* forming a cooling water through-hole (i.e., eighth flow path) 95 is formed in the bottom 74*a*. The through-hole forming portion 95*e* is an eighth flow path forming portion disposed on one side in the first direction D1 and the other side in the third direction D3 of the bottom 74*a*.

A through-hole forming portion 96*e* forming a cooling water through-hole (i.e., seventh flow path) 96 is formed in the bottom 74*a*. The through-hole forming portion 96*e* is a seventh flow path forming portion disposed on the other side in the first direction D1 and on one side in the third direction D3 of the bottom 74*a*.

The bottom 74*a* is formed with a through-hole forming portion 97*e* that forms one of the refrigerant through-hole 97 and the refrigerant through-hole (i.e., second flow path) 92. The through-hole forming portion 97*e* is a seventh flow path forming portion disposed on one side in the first direction D1 and on the intermediate side in the second direction D2 of the bottom 74*a*.

Each of the through-hole forming portions 95*d*, 96*d* is disposed at the same position as a refrigerant flow path forming portion 74*c* forming the refrigerant flow path 101 in the bottom 74*a* in the third direction D3. The refrigerant flow path forming portion 74*c* is disposed on the intermediate side in the third direction D3 of the bottom 74*a*.

Figure 14:
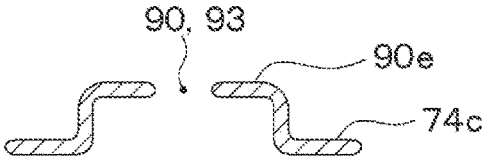
FIG. 14 is a cross-sectional view taken along line XIV-XIV in FIG. 13.
Figure 15A:
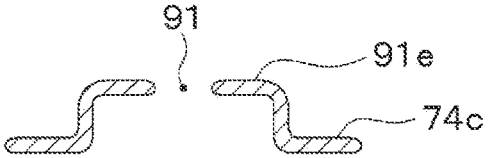
FIG. 15A is a cross-sectional view taken along line XV-XV in FIG. 13.

As illustrated in FIG. 14, the through-hole forming portion 90*e* is formed to protrude on one side in the third direction D3 with respect to the refrigerant flow path forming portion 74*c* in the bottom 74*a*. As illustrated in FIG. 15A, the through-hole forming portion 91*e* is formed to protrude on one side in the third direction D3 with respect to the refrigerant flow path forming portion 74*c* in the bottom 74*a*.

Figure 15B:
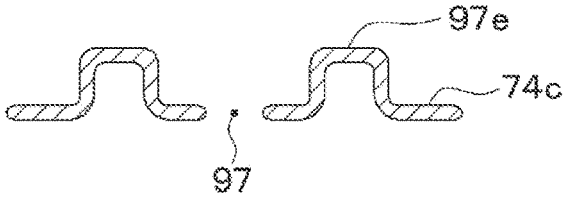
FIG. 15B is a cross-sectional view taken along line XVA-XVA in FIG. 13.

The through-hole forming portion 94*e* is formed to protrude on one side in the third direction D3 with respect to the refrigerant flow path forming portion 74*c* in the bottom 74*a*. As illustrated in FIG. 15B, the through-hole forming portion 97*e* is formed to protrude on one side in the third direction D3 with respect to the refrigerant flow path forming portion 74*c* in the bottom 74*a*.

Figure 16:
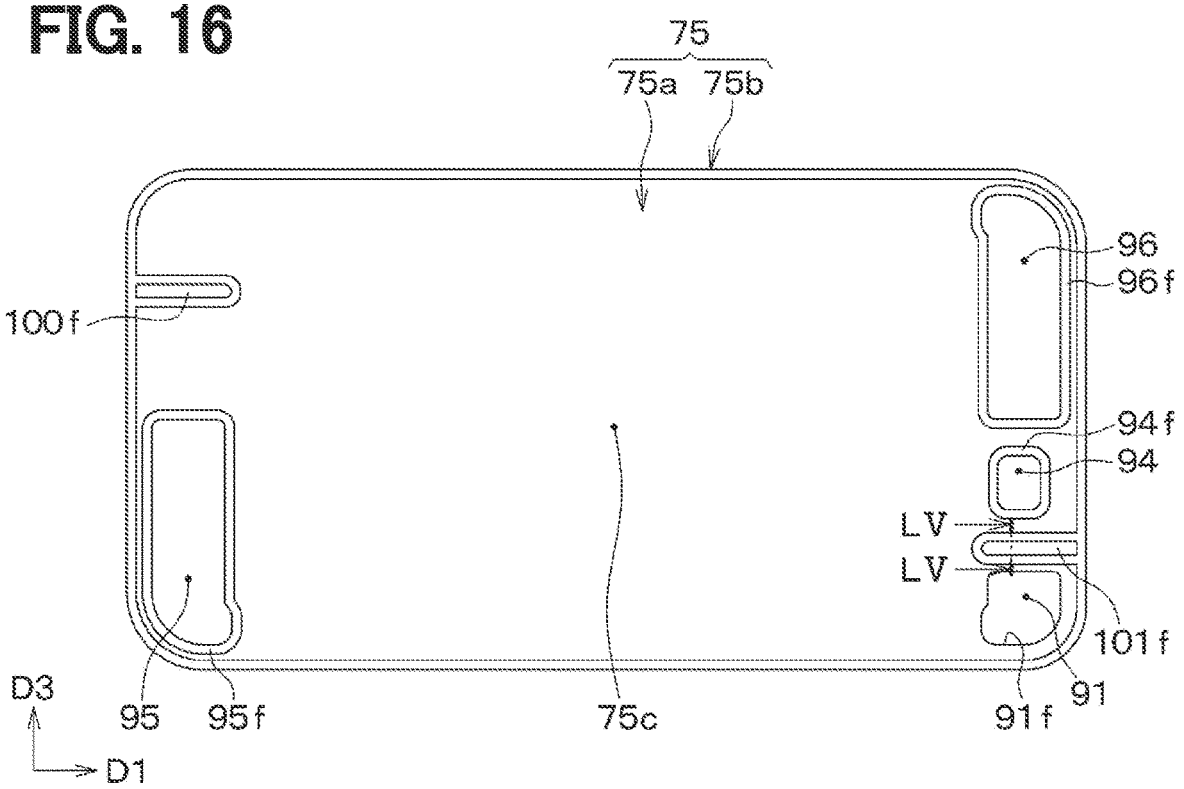
FIG. 16 is a view of the first partition outer plate in FIG. 3 as viewed from the one side in the second direction.

The first partition outer plate 75 of FIG. 16 is formed in a plate shape spreading in the first direction D1 and the third direction D3. In the first partition outer plate 75, the dimension in the first direction D1 is larger than the dimension in the third direction D3.

Specifically, the first partition outer plate 75 includes a bottom 75*a* formed in a rectangular shape spreading in the first direction D1 and the third direction D3, and a side 75*b* surrounding the entire circumference of the bottom 75*a*. The side 75*b* is formed to protrude from the bottom 75*a* toward the one side in the second direction D2.

A through-hole forming portion 91*f* (i.e., fourth through flow path) forming the refrigerant through-hole 91 (i.e., thirteenth through flow path forming portion) is formed in the bottom 75*a*.

The through-hole forming portion 91*f* is disposed on the other side in the first direction D1 and on the other side in the third direction D3 of the bottom 75*a*.

A through-hole forming portion 94*f* (i.e., second through flow path) forming the refrigerant through-hole 94 (i.e., fourteenth through flow path forming portion) is formed in the bottom 75*a*. The through-hole forming portion 94*f* is disposed on the other side in the first direction D1 and on the intermediate side in the third direction D3 in the bottom 75*a*.

A through-hole forming portion 95*f* forming the cooling water through-hole 95 is formed in the bottom 75*a*. The through-hole forming portion 95*f* is disposed on one side in the first direction D1 and on the other side in the third direction D3 of the bottom 75*a*.

A through-hole forming portion 96*f* forming the cooling water through-hole 96 is formed in the bottom 75*a*. The through-hole forming portion 96*f* is disposed on the other side in the first direction D1 and on one side in the third direction D3 of the bottom 75*a*.

The through-hole forming portion 91*f* is disposed at the same position as a refrigerant flow path forming portion 75*c* forming the refrigerant flow path 101 in the bottom 75*a* in the second direction D2. The refrigerant flow path forming portion 75*c* is disposed on the intermediate side in the third direction D3 in the bottom 75*a*.

Each of the through-hole forming portions 94*f*, 95*f*, 96*f* is formed to protrude on one side in the third direction D3 with respect to the refrigerant flow path forming portion 75*c* in the bottom 75*a*.

Protrusions 100*f*, 101*f* are provided on the bottom 75*a*. The protrusions 100*f*, 101*f* are formed to protrude on one side in the second direction D2 (i.e., front side in the drawing of FIG. 16) with respect to the refrigerant flow path forming portion 73*c* in the bottom 75*a*. The protrusion 101*f* is disposed on one side in the third direction D3 with respect to the cooling water through-hole 95. The protrusion 101*f* is disposed between the refrigerant through-holes 91 and 94.

Figure 17:
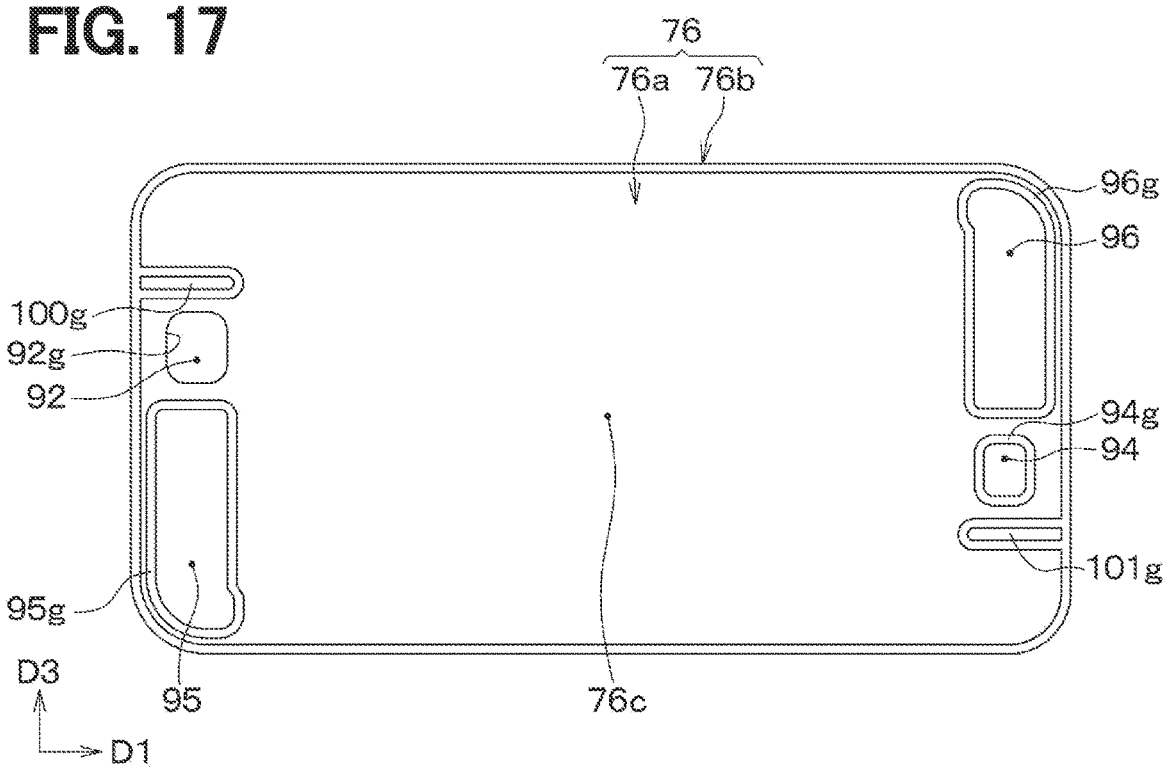
FIG. 17 is a view of a second partition outer plate in FIG. 3 as viewed from the one side in the second direction.

The second partition outer plate 76 of FIG. 17 is formed in a plate shape spreading in the first direction D1 and the third direction D3. In the second partition outer plate 76, the dimension in the first direction D1 is larger than the dimension in the third direction D3.

Specifically, each of the second partition outer plates 76 includes a bottom 76*a* formed in a rectangular shape spreading in the first direction D1 and the third direction D3, and a side 76*b* surrounding the entire circumference of the bottom 76*a*.

A through-hole forming portion 92*g* (i.e., first through flow path) forming the refrigerant through-hole 92 (i.e., fifteenth through flow path forming portion) is formed in the bottom 76*a*. The through-hole forming portion 92*g* is disposed on the other side in the first direction D1 and on the intermediate side in the third direction D3 in the bottom 76*a*.

A through-hole forming portion 94*g* (i.e., second through flow path) forming the refrigerant through-hole 94 (i.e., sixteenth through flow path forming portion) is formed in the bottom 76*a*. The through-hole forming portion 94*g* is disposed on the other side in the first direction D1 and on the intermediate side in the third direction D3 in the bottom 76*a*.

A through-hole forming portion 95*g* forming the cooling water through-hole 95 is formed in the bottom 76*a*. The through-hole forming portion 95*g* is disposed on one side in the first direction D1 and on the other side in the third direction D3 of the bottom 76*a*.

A through-hole forming portion 96*g* forming the cooling water through-hole 96 is formed in the bottom 76*a*. The through-hole forming portion 96*g* is disposed on the other side in the first direction D1 and on one side in the third direction D3 in the bottom 76*a*.

The through-hole forming portion 92*g* is disposed at the same position as a refrigerant flow path forming portion 76*c* forming the refrigerant flow path 101 in the bottom 76*a* in the third direction D3. The refrigerant flow path forming portion 76*c* is disposed on the intermediate side in the third direction D3 in the bottom 76*a*.

Each of the through-hole forming portions 94*g*, 95*g*, 96*g* is formed to protrude on one side in the third direction D3 with respect to the refrigerant flow path forming portion 76*c* in the bottom 76*a*.

Protrusions 100*g*, 101*g* are provided on the bottom 76*a*. The protrusions 100*g*, 101*g* are formed to protrude on one side in the second direction D2 (i.e., the front side in the drawing of FIG. 17) with respect to the refrigerant flow path forming portion 76*c* in the bottom 76*a*.

The refrigerant flow path forming portion 76*c* is disposed at an intermediate portion of the bottom 76*a* in the first direction D1. The protrusion 100*g* is disposed on one side in the third direction D3 with respect to the refrigerant through-hole 92. The protrusion 101*g* is disposed on the other side in the third direction D3 with respect to the refrigerant through-hole 94.

Figure 18:
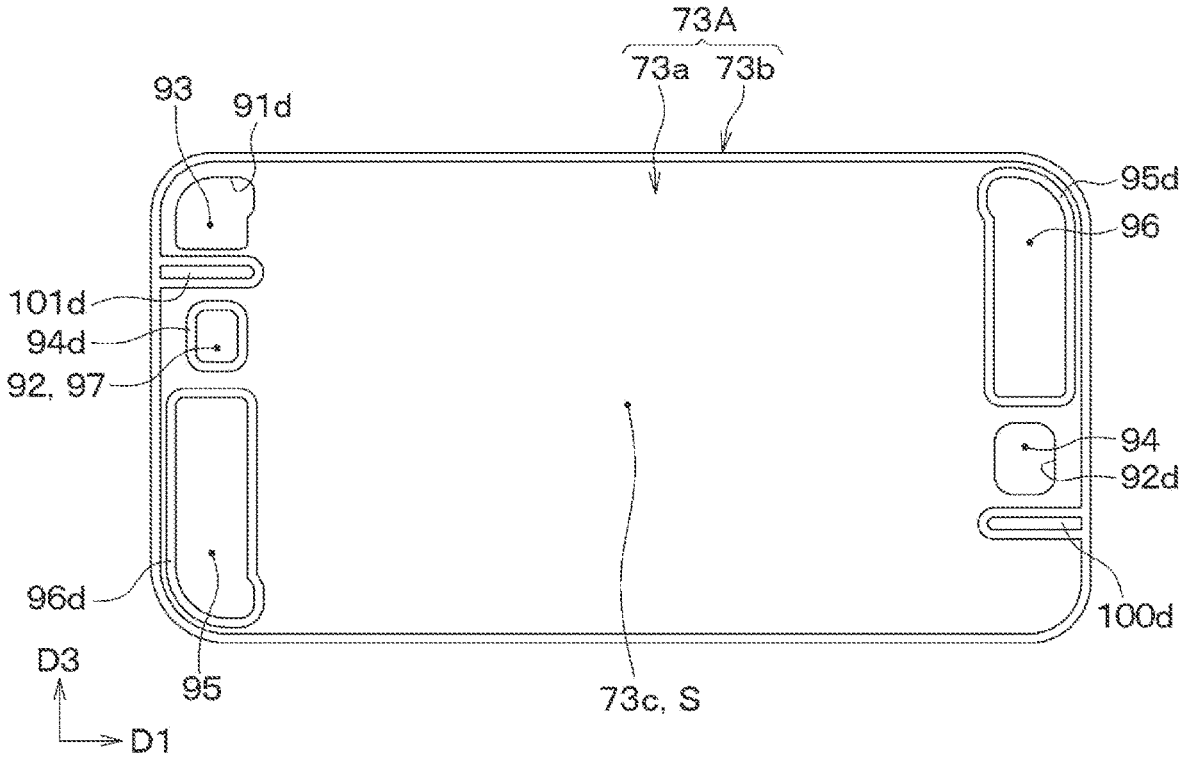
FIG. 18 is a view of the reverse second outer plate in FIG. 3 as viewed from the one side in the second direction.

The plurality of reverse second outer plates 73A in FIG. 18 are each formed in a plate shape spreading in the first direction D1 and the third direction D3. In the present embodiment, each of the reverse second outer plate 73A and the second outer plate 73 is formed of a common plate. Specifically, the reverse second outer plate 73A and the second outer plate 73 are formed to be point-symmetric with each other about an axis S.

As illustrated in FIGS. 12 and 18, the axis S is an imaginary line passing through the center in the direction of the plane including the first direction D1 and the third direction D3 (i.e., bottom 73*a*) in the second direction D2 in the reverse second outer plate 73A or the second outer plate 73.

The reverse second outer plate 73A is a plate of the second outer plate 73 rotated by 180 degrees about the axis.

Therefore, the through-hole forming portions 91*d*, 94*d*, 96*d* disposed on the other side in the third direction D3 in the second outer plate 73 are disposed on one side in the third direction D3 in the reverse second outer plate 73A. The through-hole forming portions 92*d*, 95*d* disposed on one side in the third direction D3 of the second outer plate 73 are disposed on the other side in the third direction D3 of the second outer plate 73A.

The through-hole forming portion 91*d* (i.e., tenth through flow path forming portion) in the bottom 73*a* in the reverse second outer plate 73A forms the refrigerant through-hole 93 (i.e., fifth through flow path and fifth flow path). The through-hole forming portion 91*d* is a fifth flow path forming portion disposed on one side in the first direction D1 and one side in the third direction D3 of the bottom 73*a*.

Figure 32:
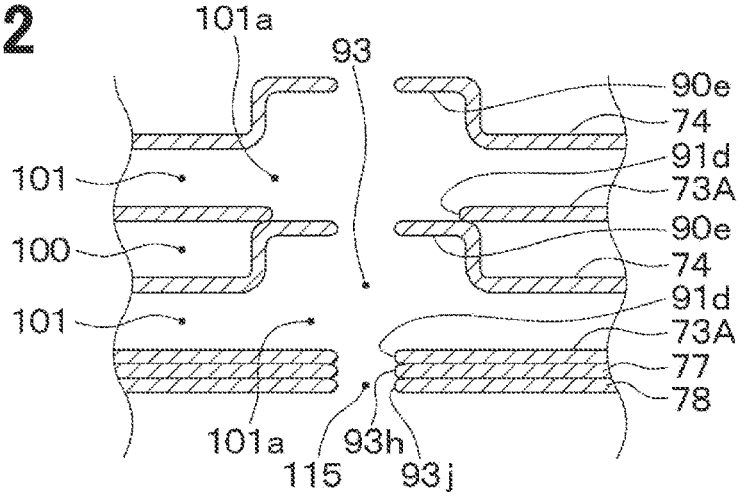
FIG. 32 is a cross-sectional view illustrating the refrigerant through-hole of the heat exchanger body in the heat exchanger according to the first embodiment.

As illustrated in FIG. 32, the through-hole forming portion 91*d* forms a refrigerant introduction port (i.e., second refrigerant introduction port) 101*a* together with the inner plate 74. The refrigerant introduction port 101*a* is provided to guide the refrigerant from the refrigerant through-hole 93 to the refrigerant flow path (i.e., second refrigerant flow path) 101.

The through-hole forming portion 94*d* in the bottom 73*a* in the reverse second outer plate 73A forms one of the refrigerant through-hole (i.e., second flow path) 92 and the refrigerant through-hole 97. The through-hole forming portion 94*d* is a second flow path forming portion disposed on one side in the first direction D1 and on the intermediate side in the third direction D3 in the bottom 73*a*.

The through-hole forming portion 92*d* in the bottom 73*a* in the reverse second outer plate 73A forms the refrigerant through-hole (i.e., fourth flow path) 94. The through-hole forming portion 92*d* is a fourth flow path forming portion disposed on the other side in the first direction D1 and on the intermediate side in the third direction D3 in the bottom 73*a*.

The through-hole forming portion 95*d* in the bottom 73*a* in the reverse second outer plate 73A forms the cooling water through-hole (i.e., seventh flow path) 96. The through-hole forming portion 95*d* is a seventh flow path forming portion disposed on the other side in the first direction D1 and on one side in the third direction D3 of the bottom 73*a*.

The through-hole forming portion 96*d* in the bottom 73*a* in the reverse second outer plate 73A forms a cooling water through-hole (i.e., eighth flow path) 95. The through-hole forming portion 96*d* is an eighth flow path forming portion disposed on one side in the first direction D1 and the other side in the third direction D3 of the bottom 73*a*.

Each of the through-hole forming portions 91*d*, 92*d* is disposed at the same position as a refrigerant flow path forming portion 73*c* forming the refrigerant flow path 101 in the bottom 73*a* in the third direction D3. The refrigerant flow path forming portion 73*c* is disposed on the intermediate side in the third direction D3 in the bottom 73*a*.

Each of the through-hole forming portions 94*c*, 95*c*, 96*c* is formed to protrude on one side in the third direction D3 of the bottom 73*a* (i.e., the front side in the drawing of FIG. 18) with respect to the refrigerant flow path forming portion 73*c*.

Similarly to the second outer plate 73 described above, the bottom 73*a* of the reverse second outer plate 73A is provided with protrusions 100*d*, 101*d*.

Figure 19:
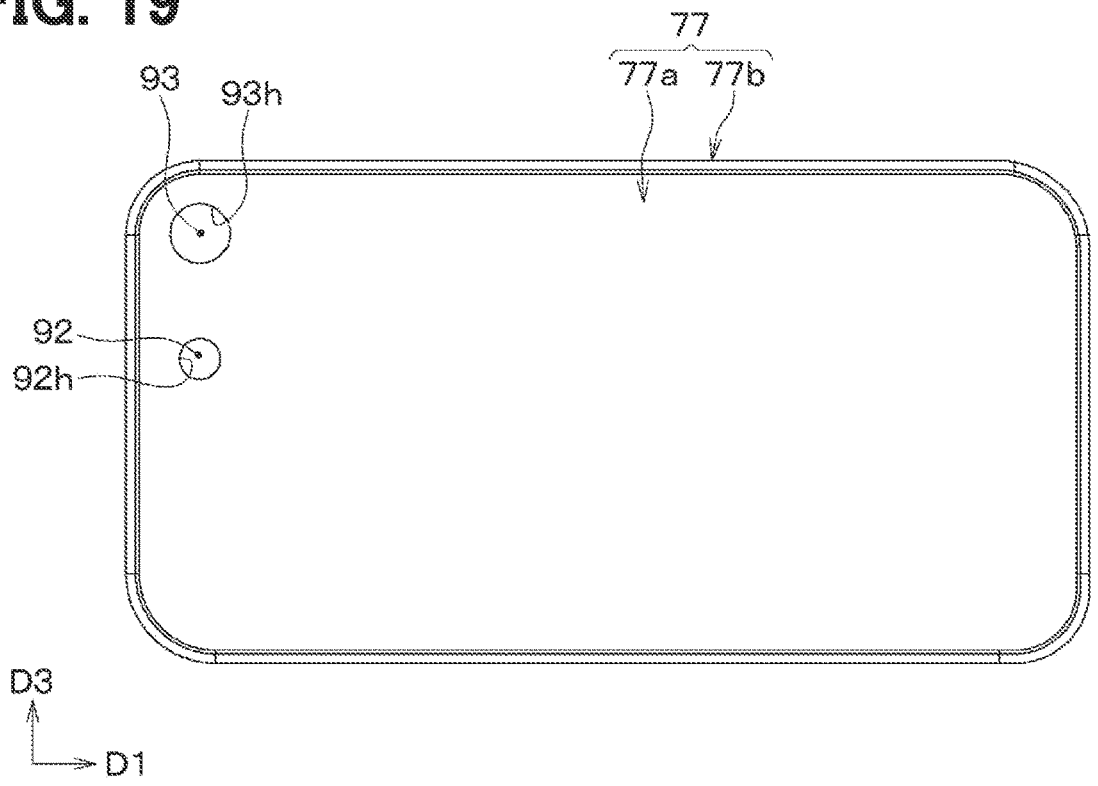
FIG. 19 is a view of the bottom plate in FIG. 3 as viewed from the one side in the second direction.

The bottom plate 77 of FIG. 19 is formed in a plate shape spreading in the first direction D1 and the third direction D3. In the bottom plate 77, the dimension in the first direction D1 is larger than the dimension in the third direction D3.

Specifically, the bottom plate 77 includes a bottom 77*a* formed in a rectangular shape spreading in the first direction D1 and the third direction D3, and a side 77*b* surrounding the entire circumference of the bottom 77*a*. The side 77*b* is formed to protrude from the bottom 77*a* toward the one side in the second direction D2.

A through-hole forming portion 92*h* forming the refrigerant through-hole 92 is formed in the bottom 77*a*. The through-hole forming portion 92*h* is disposed on one side in the first direction D1 and one side in the third direction D3 of the bottom 77*a*.

A through-hole forming portion 92*h* forming the refrigerant through-hole 92 is formed in the bottom 77*a*. The through-hole forming portion 92*h* is disposed on the other side in the first direction D1 and on the intermediate side in the second direction D2 of the bottom 77*a*.

Figure 20:
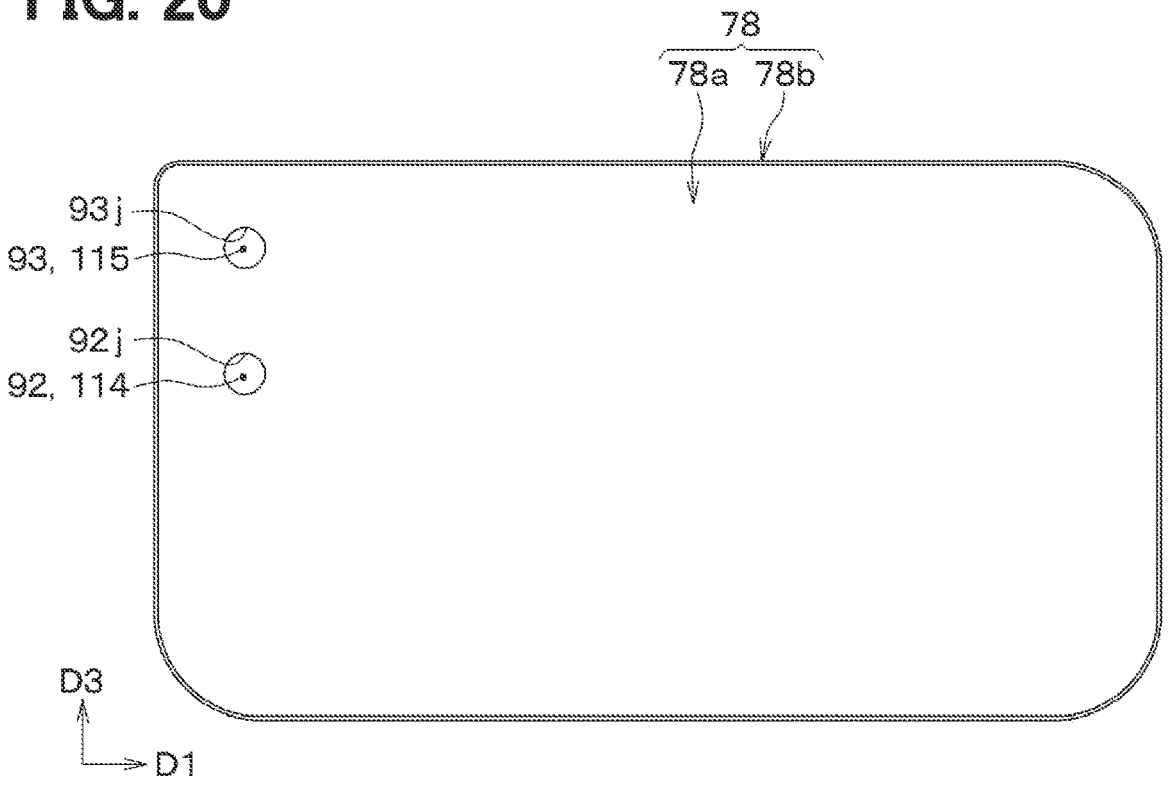
FIG. 20 is a view of the bracket in FIG. 3 as viewed from the one side in the second direction.

The bracket 78 of FIG. 20 is formed in a plate shape spreading in the first direction D1 and the third direction D3. In the bracket 78, the dimension in the first direction D1 is larger than the dimension in the third direction D3.

Specifically, the bracket 78 includes a bottom 78*a* formed in a rectangular shape spreading in the first direction D1 and the third direction D3, and a side 78*b* surrounding the entire circumference of the bottom 78*a*. The side 78*b* is formed to protrude from the bottom 78*a* toward the one side in the second direction D2.

A through-hole forming portion 93*j* forming the refrigerant through-hole 93 is formed in the bottom 78*a*. The through-hole forming portion 93*j* is disposed on one side in the first direction D1 and one side in the third direction D3 of the bottom 78*a*. The other side in the second direction D2 of the refrigerant through-hole 93 forms an introduction port 115 of the subcooling portion 10B.

A through-hole forming portion 92*j* forming the refrigerant through-hole 92 is formed in the bottom 78*a*. The through-hole forming portion 92*j* is disposed on one side in the first direction D1 and on the intermediate side in the second direction D2 in the bottom 78*a*. The other side in the second direction D2 of the refrigerant through-hole 92 forms the discharge port 114 of the condensing portion 10A.

Each of the plurality of cooling water fins 79 is disposed in a cooling water flow path 100 to be described later to promote heat exchange between the cooling water and the refrigerant. Each of the plurality of refrigerant fins 80 is disposed in refrigerant flow path 101 to be described later to promote heat exchange between the cooling water and the refrigerant.

Specifically, the plurality of refrigerant fins 80 constitute a first heat exchange fin disposed in the refrigerant flow path (i.e., first refrigerant flow path) 101 of the condensing portion 10A and a second heat exchange fin disposed in the refrigerant flow path (i.e., second refrigerant flow path) 101 of the subcooling portion 10B.

The plurality of cooling water fins 79 constitute a third heat exchange fin disposed in cooling water flow path (i.e., first heat-medium flow path) 100 of condensing portion 10A and a fourth heat exchange fin disposed in cooling water flow path (i.e., second heat-medium flow path) 100 of subcooling portion 10B.

Next, the refrigerant through-hole 90 will be described with reference to FIGS. 3, 21, and 22.

The plates 71, 72, 74 are arranged in the order of the top outer plate 71, the inner plate 74, the first outer plate 72, the inner plate 74, the first outer plate 72, . . . , between the top plate 70 and the first partition outer plate 75.

The plates 71, 72, 74 collectively represent the top outer plate 71, the inner plates 74, and the first outer plates 72.

Figure 21:
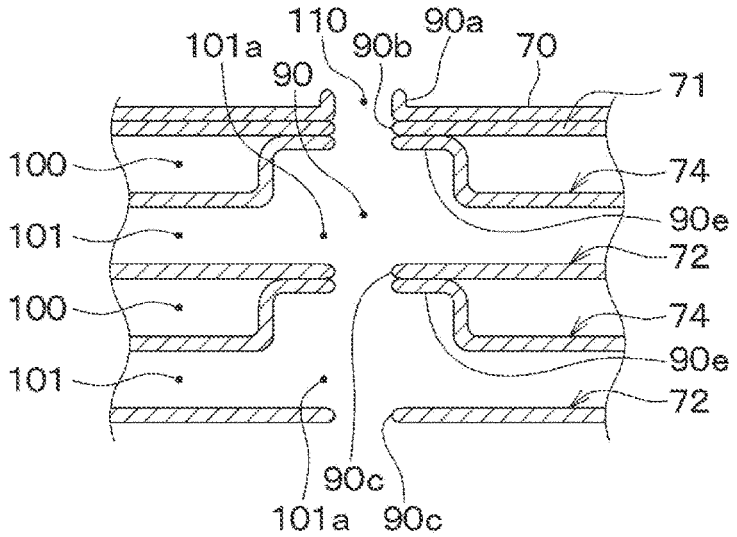
FIG. 21 is a cross-sectional view illustrating a refrigerant through-hole of a heat exchanger body in the heat exchanger according to the first embodiment.

As illustrated in FIG. 21, the cooling water flow path 100 through which cooling water flows is formed between the top outer plate 71 and the inner plate 74. The through-hole forming portion 90*e* in the inner plate 74 is joined to the top plate 70 by brazing. Hence the refrigerant through-hole 90 and the cooling water flow path 100 are separated from each other.

The refrigerant flow path 101 (i.e., first refrigerant flow path) through which a refrigerant flows on one side in the first direction D1 is formed between the inner plate 74 (i.e., first plate) and the first outer plate 72 (i.e., second plate). The inner plate 74 is disposed on one side in the second direction D2 with respect to the first outer plate 72.

The refrigerant flow path 101 is disposed on the other side in the second direction D2 with respect to the inner plate 74 (e.g., the lower side in FIG. 21) and on one side in the second direction D2 with respect to the first outer plate 72 (e.g., the upper side in FIG. 21).

The through-hole forming portion 90*c* (i.e., sixth through flow path forming portion) in the first outer plate 72 forms the refrigerant introduction port (i.e., first refrigerant introduction port) 101*a* together with the inner plate 74. The refrigerant introduction port 101*a* is provided to guide the refrigerant from the refrigerant through-hole 90 to the refrigerant flow path (i.e., first refrigerant flow path) 101.

The cooling water flow path 100 (i.e., first heat-medium flow path) through which cooling water flows is formed between the first outer plate 72 (i.e., second plate) and the inner plate 74 (i.e., third plate). The inner plate 74 is disposed on the other side in the second direction D2 with respect to the first outer plate 72.

The cooling water flow path 100 is disposed on the other side in the second direction D2 with respect to the first outer plate 72 (e.g., the lower side in FIG. 21) and on one side in the second direction D2 with respect to the inner plate 74 (e.g., the upper side in FIG. 21).

The through-hole forming portion 90*e* (fifth through flow path forming portion) in the inner plate 74 is joined to the first outer plate 72 by brazing. Hence the refrigerant through-hole 90 (i.e., third through flow path) and the cooling water flow path 100 are separated from each other.

Figure 22:
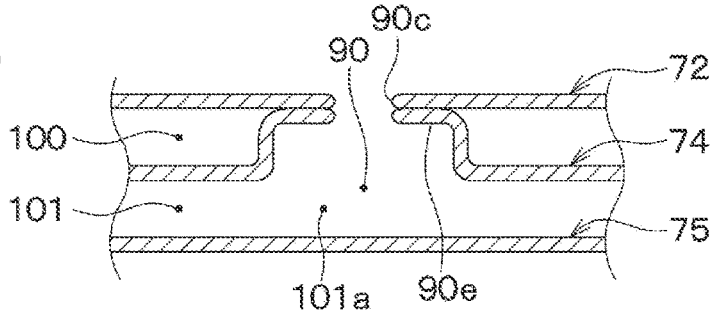
FIG. 22 is a cross-sectional view illustrating the refrigerant through-hole of the heat exchanger body in the heat exchanger according to the first embodiment.

As illustrated in FIG. 22, the refrigerant flow path 101 through which the refrigerant flows is formed between the inner plate 74 and the first partition outer plate 75. The refrigerant introduction port 101*a* for guiding the refrigerant from the refrigerant through-hole 90 to the refrigerant flow path 101 is provided between the inner plate 74 and the first partition outer plate 75.

Between the top plate 70 and the first partition outer plate 75, one cooling water flow path 100 and one refrigerant flow path 101 are alternately arranged in the third direction. The plurality of cooling water flow paths 100 and the refrigerant through-holes 90 are separated from each other. The refrigerant through-hole 90 communicates with the plurality of refrigerant flow paths 101.

Next, the refrigerant through-hole 91 will be described with reference to FIGS. 23, 24, 25, and 26.

Figure 23:
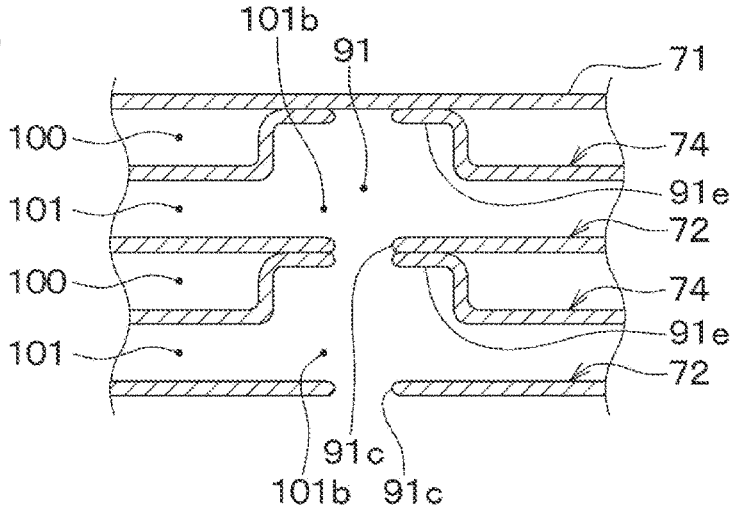
FIG. 23 is a cross-sectional view illustrating the refrigerant through-hole of the heat exchanger body in the heat exchanger according to the first embodiment.

The through-hole forming portion 91*e* in the inner plate 74 of FIG. 23 is joined to the top outer plate 71 by brazing. Hence the refrigerant through-hole 91 and the cooling water flow path 100 are separated from each other. The top outer plate 71 closes one side in the second direction D2 of the refrigerant through-hole 91 (e.g., the upper side in FIG. 23).

The through-hole forming portion 91*c* (i.e., eighth through flow path forming portion) in the first outer plate 72 forms a refrigerant discharge port 101*b* together with the inner plate 74. The refrigerant discharge port 101*b* discharges the refrigerant from the refrigerant flow path 101 to the refrigerant through-hole 91.

The through-hole forming portion 91*e* (i.e., seventh through flow path forming portion) in the inner plate 74 is joined to the first outer plate 72 by brazing. Hence the refrigerant through-hole 91 and the cooling water flow path 100 are separated from each other.

Figure 24:
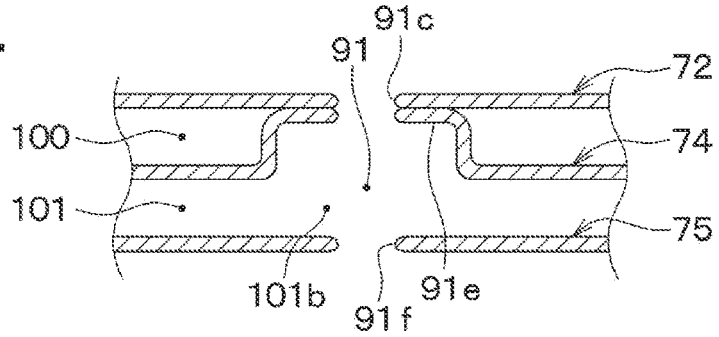
FIG. 24 is a cross-sectional view illustrating the refrigerant through-hole of the heat exchanger body in the heat exchanger according to the first embodiment.

The through-hole forming portion 91*f* in the first partition outer plate 75 of FIG. 24 is provided with a refrigerant discharge port 101*b* that communicates between the refrigerant through-hole 91 and the refrigerant flow path 101 together with the inner plate 74. Therefore, the refrigerant flow path 101 is disposed between the refrigerant introduction port 101*a* and the refrigerant discharge port 101*b*.

Between the top plate 70 and the first partition outer plate 75, the plurality of cooling water flow paths 100 and the refrigerant through-hole 91 are separated. The refrigerant through-hole 91 communicates with the plurality of refrigerant flow paths 101.

Figure 25:
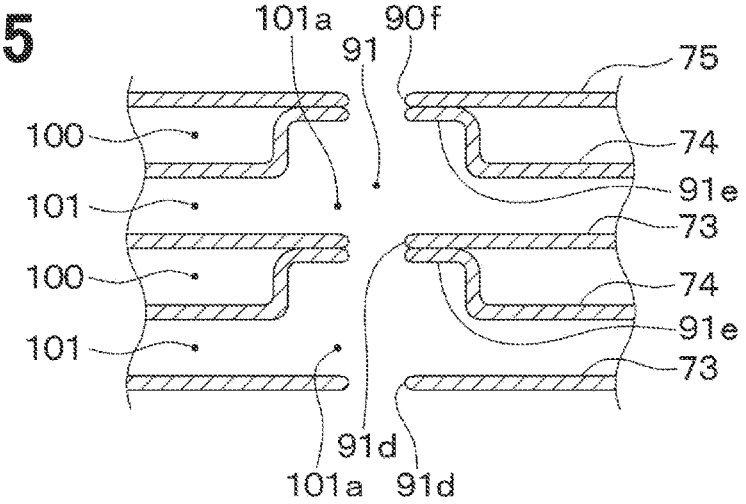
FIG. 25 is a cross-sectional view illustrating the refrigerant through-hole of the heat exchanger body in the heat exchanger according to the first embodiment.
Figure 26:
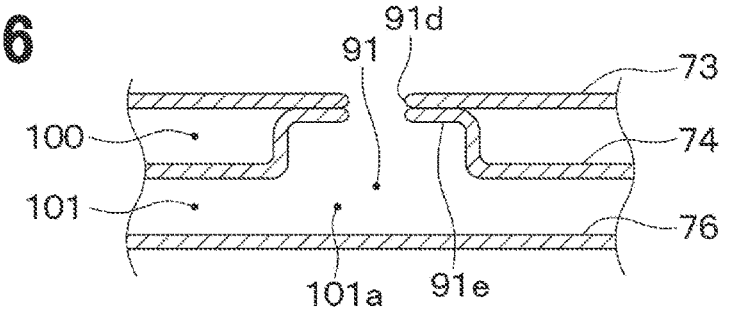
FIG. 26 is a cross-sectional view illustrating the refrigerant through-hole of the heat exchanger body in the heat exchanger according to the first embodiment.

As illustrated in FIGS. 25 and 26, the plates 74, 73 are arranged in the order of the inner plate 74, the second outer plate 73, the inner plate 74, and the second outer plate 73, . . . , between the first partition outer plate 75 and the second partition outer plate 76 of FIG. 3.

The plates 74, 73 collectively represent the inner plates 74 and the second outer plates 73.

The first partition outer plate 75 is a first partition plate for partitioning the condensing portion 10A into a plurality of refrigerant flow paths 101 through which the refrigerant is allowed to flow toward one side in the first direction D1 and a plurality of refrigerant flow paths 101 through which the refrigerant is allowed to flow toward the other side in the second direction D2. The second partition outer plate 76 is a second partition plate for partitioning the condensing portion 10A and the subcooling portion 10B.

The cooling water flow path 100 through which cooling water flows is formed between the first partition outer plate 75 and the inner plate 74. The through-hole forming portion 91*e* in the inner plate 74 is joined to the first partition outer plate 75 by brazing. Hence the refrigerant through-hole 91 and the cooling water flow path 100 are separated from each other.

The refrigerant flow path 101 (i.e., third refrigerant flow path) through which the refrigerant flows on the other side in the first direction D1 is formed between the inner plate 74 (i.e., seventh plate) and the second outer plate 73 (i.e., eighth plate). The through-hole forming portion 91*d* in the second outer plate 73 forms, together with the inner plate 74, the refrigerant introduction port 101*a* that communicates between the refrigerant through-hole 91 and the refrigerant flow path 101.

The cooling water flow path 100 (i.e., third heat-medium flow path) through which cooling water flows is formed between the second outer plate 73 (i.e., eighth plate) and the inner plate 74 (i.e., ninth plate). The through-hole forming portion 91*e* in the inner plate 74 is joined to the second outer plate 73 by brazing. Hence the refrigerant through-hole 91 and the cooling water flow path 100 are separated from each other.

The refrigerant flow path 101 through which the refrigerant flows is formed between the inner plate 74 and the second partition outer plate 76 in FIG. 26. The refrigerant introduction port 101*a* for guiding the refrigerant from the refrigerant through-hole 91 to the refrigerant flow path 101 is provided between the inner plate 74 and the second partition outer plate 76.

Next, the refrigerant through-hole 92 of the present embodiment will be described with reference to FIGS. 27 and 28.

The through-hole forming portion 97*e* in the inner plate 74 is joined to the first partition outer plate 75 by brazing. Hence the refrigerant through-hole 92 and the cooling water flow path 100 are separated from each other. One side in the second direction D2 of the refrigerant through-hole 92 (e.g., the upper side in FIG. 27) is closed by the first partition outer plate 75.

The through-hole forming portion 97*e* in the inner plate 74 is joined to the second outer plate 73 by brazing. Hence the refrigerant through-hole 92 and the cooling water flow path 100 are separated from each other.

Figure 27:
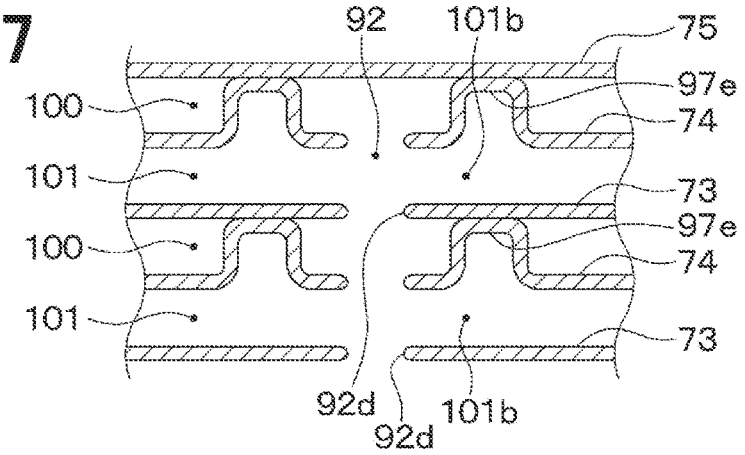
FIG. 27 is a cross-sectional view illustrating the refrigerant through-hole of the heat exchanger body in the heat exchanger according to the first embodiment.

The through-hole forming portion 92*d* in the second outer plate 73 of FIG. 27 forms the refrigerant introduction port 101*a* for guiding the refrigerant from the refrigerant through-hole 91 to the refrigerant flow path 101 together with the inner plate 74.

Between the first partition outer plate 75 and the second partition outer plate 76, one cooling water flow path 100 and one refrigerant flow path 101 are alternately arranged in the third direction. The refrigerant through-hole 92 and the plurality of cooling water flow paths 100 are separated from each other. The refrigerant through-hole 92 communicates with the plurality of refrigerant flow paths 101.

Figure 28:
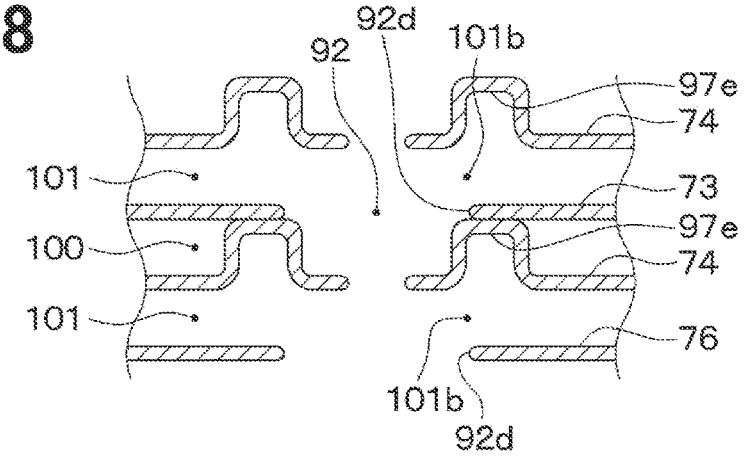
FIG. 28 is a cross-sectional view illustrating the refrigerant through-hole of the heat exchanger body in the heat exchanger according to the first embodiment.
Figure 29:
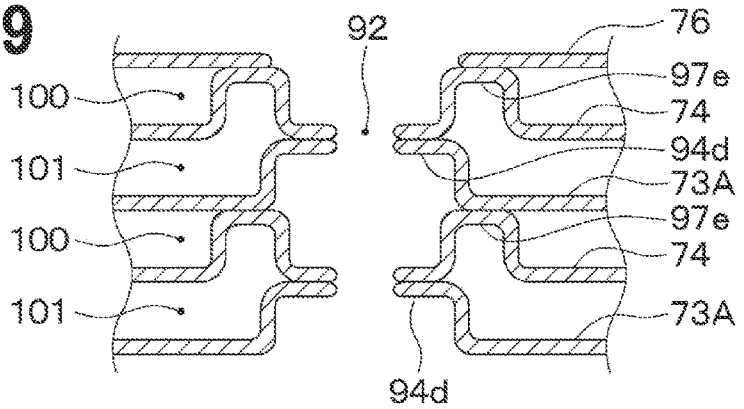
FIG. 29 is a cross-sectional view illustrating the refrigerant through-hole of the heat exchanger body in the heat exchanger according to the first embodiment.
Figure 30:
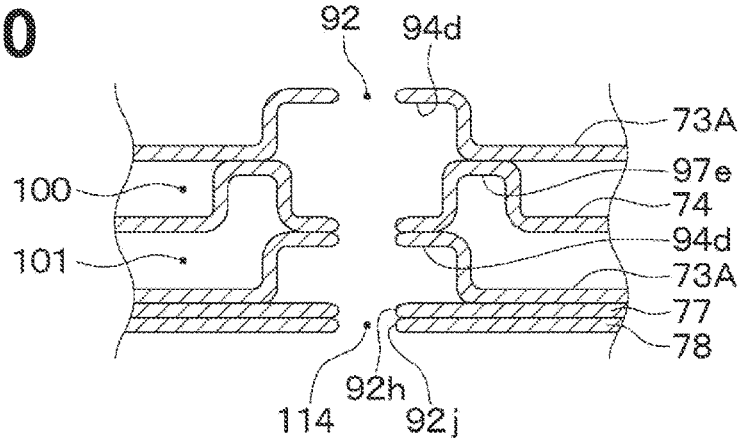
FIG. 30 is a cross-sectional view illustrating the refrigerant through-hole of the heat exchanger body in the heat exchanger according to the first embodiment.

Between the second partition outer plate 76 and the bracket 78 illustrated in FIGS. 28 to 30, the plates 74, 73A are arranged in the order of the inner plate 74, the reverse second outer plate 73A, the inner plate 74, and the reverse second outer plate 73A. The plates 74, 73A collectively represent the inner plates 74 and the reverse second outer plates 73A.

The inner plate 74 and the bottom plate 77 are arranged in the order of the inner plate 74 and the bottom plate 77 on the other side in the third direction with respect to the plates 74, 73A between the second partition outer plate 76 and the bracket 78.

The refrigerant flow path 101 is formed between the second partition outer plate 76 and the inner plate 74 of FIG. 28. The through-hole forming portion 92*d* forming the refrigerant through-hole 92 in the second partition outer plate 76 forms the refrigerant introduction port 101*a* for guiding the refrigerant from the refrigerant through-hole 92 to the refrigerant flow path 101 together with the inner plate 74.

The cooling water flow path 100 is formed between the second partition outer plate 76 and the inner plate 74 in FIG. 29. The through-hole forming portion 97*e* forming the refrigerant through-hole 92 in the inner plate 74 is joined to the second partition outer plate 76 by brazing. Hence the refrigerant through-hole 92 and the cooling water flow path 100 are separated from each other.

The refrigerant flow path 101 (i.e., second refrigerant flow path) through which a refrigerant flows is formed between the inner plate 74 (i.e., fourth plate) and the reverse second outer plate 73A (i.e., fifth plate). The inner plate 74 is disposed on one side in the second direction D2 with respect to the reverse second outer plate 73A.

The refrigerant flow path 101 is disposed on the other side in the second direction D2 with respect to the inner plate 74 (e.g., the lower side in FIG. 29) and on one side in the second direction D2 with respect to the reverse second outer plate 73A (e.g., the upper side in FIG. 29).

A through-hole forming portion 94*d* (i.e., second through flow path forming portion) forming the refrigerant through-hole 92 in the reverse second outer plate 73A is joined to the inner plate 74 by brazing. Hence the refrigerant through-hole 92 and the refrigerant flow path 101 are separated.

The cooling water flow path 100 (i.e., second heat-medium flow path) through which cooling water flows is formed between the reverse second outer plate 73A (i.e., fifth plate) and the inner plate 74 (i.e., sixth plate). The inner plate 74 is disposed on the other side in the second direction D2 with respect to the reverse second outer plate 73A.

The cooling water flow path 100 is disposed on the other side in the second direction D2 with respect to the reverse second outer plate 73A (e.g., the lower side in FIG. 29) and on one side in the second direction D2 with respect to the inner plate 74 (e.g., the upper side in FIG. 29).

The through-hole forming portion 97*e* (i.e., first through flow path forming portion) forming the refrigerant through-hole 92 in the inner plate 74 is joined to the reverse second outer plate 73A by brazing. Hence the refrigerant through-hole 92 and the cooling water flow path 100 are separated from each other.

The other side in the second direction D2 of the refrigerant through-hole 92 (e.g., the lower side in FIG. 29) is formed by the through-hole forming portion 92*h* in the bottom plate 77 and the through-hole forming portion 92*j* in the bracket 78. The other side in the second direction D2 of the refrigerant through-hole 92 of FIG. 30 (e.g., the lower side in the drawing) constitutes a discharge port 114. The discharge port 114 is formed of a bracket 78 (i.e., plate stack 10).

Between the second partition outer plate 76 and the bottom plate 77 in the refrigerant through-hole 92 configured as described above, the plurality of cooling water flow paths 100 and the plurality of refrigerant flow paths 101 are separated from the refrigerant through-hole 92.

Figure 31:
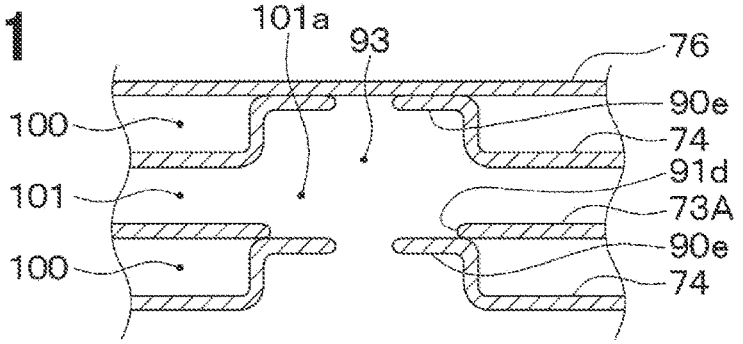
FIG. 31 is a cross-sectional view illustrating the refrigerant through-hole of the heat exchanger body in the heat exchanger according to the first embodiment.

As illustrated in FIGS. 31 and 32, the through-hole forming portion 90*e* forming the refrigerant through-hole 93 in the inner plate 74 is joined to the second partition outer plate 76 by brazing. Hence the refrigerant through-hole 93 and the cooling water flow path 100 are separated from each other.

In the second partition outer plate 76, the through-hole forming portion 91*d* forming the refrigerant through-hole 93 forms the refrigerant introduction port 101*a* together with the inner plate 74. The refrigerant introduction port 101*a* is provided to guide the refrigerant from the refrigerant through-hole 93 to the refrigerant flow path 101.

The through-hole forming portion 90*e* (i.e., ninth through flow path forming portion) forming the refrigerant through-hole 93 in the inner plate 74 is joined to the reverse second outer plate 73A by brazing. Hence the refrigerant through-hole 93 (i.e., fifth through flow path) and the cooling water flow path 100 (i.e., second heat-medium flow path) are separated from each other.

Between the second partition outer plate 76 and the bracket 78, one cooling water flow path 100 and one refrigerant flow path 101 are alternately arranged in the third direction. The refrigerant through-hole 93 and the plurality of cooling water flow paths 100 are separated from each other. The refrigerant through-hole 93 communicates with the plurality of refrigerant flow paths 101.

The refrigerant through-hole 93 penetrates the bottom plate 77 and the bracket 78 and is opened to the other side in the second direction D2. The other side in the second direction D2 of the refrigerant through-hole 93 constitutes an introduction port 115. The introduction port 115 is formed of the bracket 78 (i.e., plate stack 10).

Next, the refrigerant through-hole 94 of the present embodiment will be described with reference to FIGS. 33 to 38.

Figure 33:
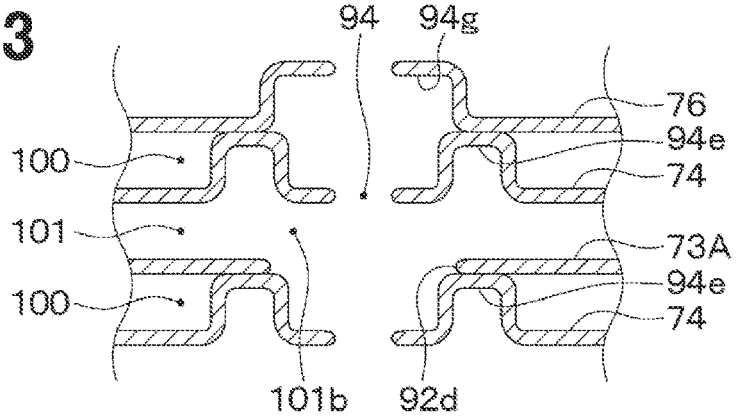
FIG. 33 is a cross-sectional view illustrating the refrigerant through-hole of the heat exchanger body in the heat exchanger according to the first embodiment.
Figure 34:
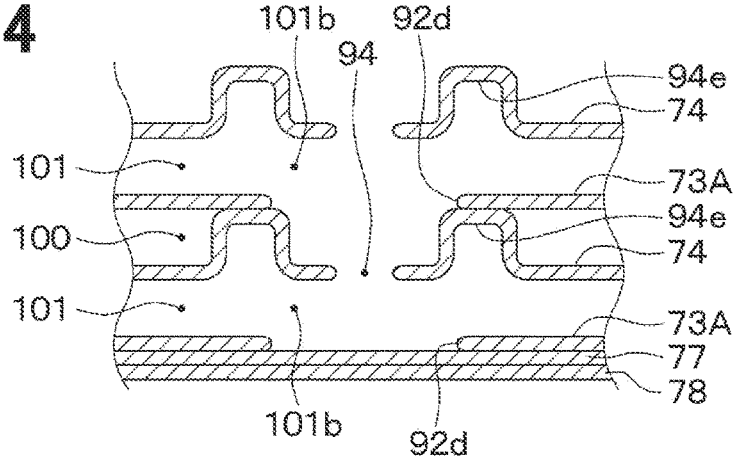
FIG. 34 is a cross-sectional view illustrating the refrigerant through-hole of the heat exchanger body in the heat exchanger according to the first embodiment.

Between the second partition outer plate 76 and the bracket 78 illustrated in FIGS. 33 and 34, the through-hole forming portion 94*e* in the inner plate 74 is joined to the second partition outer plate 76 by brazing. Hence the refrigerant through-hole 94 and the cooling water flow path 100 are separated from each other.

The refrigerant discharge port 101*b* (i.e., second discharge port) is provided between the through-hole forming portion 92*d* (i.e., twelfth through flow path forming portion) in the reverse second outer plate 73A and the inner plate 74 (i.e., fourth plate).

The refrigerant discharge port 101*b* is provided to discharge the refrigerant from the refrigerant flow path 101 (i.e., second refrigerant flow path) to the refrigerant through-hole 94 (i.e., second through flow path).

The through-hole forming portion 94*e* (i.e., eleventh through flow path forming portion) in the inner plate 74 is joined to the reverse second outer plate 73A by brazing. Hence the refrigerant through-hole 94 (i.e., second through flow path) and the cooling water flow path 100 (i.e., second heat-medium flow path) are separated from each other.

Figure 35:
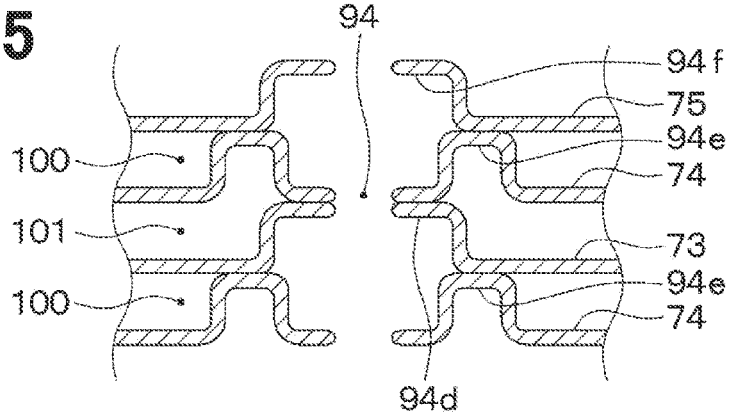
FIG. 35 is a cross-sectional view illustrating the refrigerant through-hole of the heat exchanger body in the heat exchanger according to the first embodiment.
Figure 36:
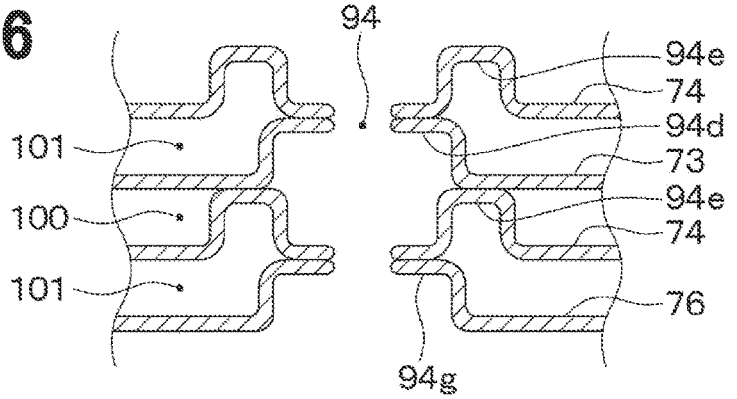
FIG. 36 is a cross-sectional view illustrating the refrigerant through-hole of the heat exchanger body in the heat exchanger according to the first embodiment.

Between the first partition outer plate 75 and the second partition outer plate 76 illustrated in FIGS. 35 and 36, the through-hole forming portion 94*e* in the inner plate 74 is joined to the first partition outer plate 75 by brazing. Hence the refrigerant through-hole 94 and the cooling water flow path 100 are separated from each other.

The through-hole forming portion 94*e* in the inner plate 74 is joined to the second outer plate 73 by brazing. Hence the refrigerant through-hole 94 and the cooling water flow path 100 are separated from each other.

The through-hole forming portion 94*d* in the second outer plate 73 is joined to the inner plate 74 by brazing. Hence the refrigerant through-hole 94 and the refrigerant flow path 101 are separated.

Figure 37:
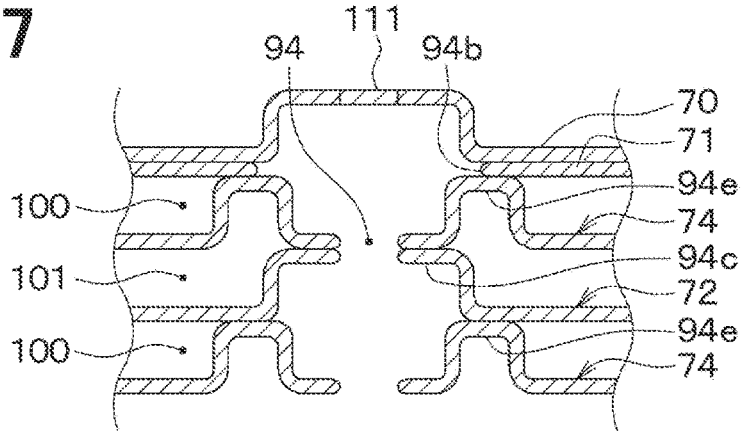
FIG. 37 is a cross-sectional view illustrating the refrigerant through-hole of the heat exchanger body in the heat exchanger according to the first embodiment.
Figure 38:
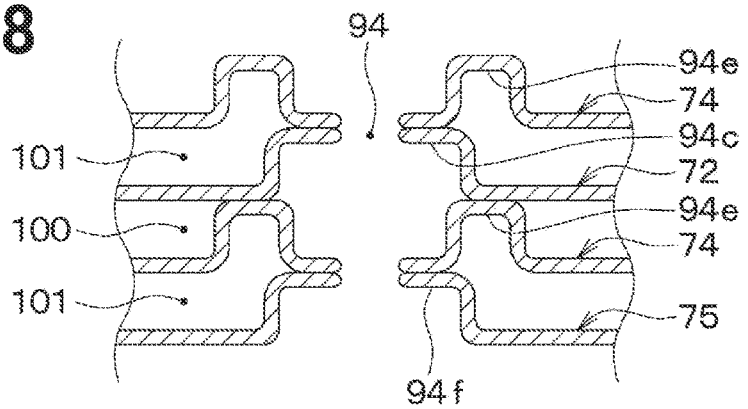
FIG. 38 is a cross-sectional view illustrating the refrigerant through-hole of the heat exchanger body in the heat exchanger according to the first embodiment.

Between the top outer plate 71 and the first partition outer plate 75 illustrated in FIGS. 37 and 38, the through-hole forming portion 94*e* in the inner plate 74 is joined to the top outer plate 71 by brazing. Hence the refrigerant through-hole 94 and the cooling water flow path 100 are separated from each other.

The through-hole forming portion 94*e* (i.e., third plate) in the inner plate 74 (i.e., third through flow path forming portion) is joined to the first outer plate 72 (i.e., second plate) by brazing.

Hence the refrigerant through-hole 94 (i.e., second through flow path) and the cooling water flow path 100 (i.e., first heat-medium flow path) are separated from each other.

The through-hole forming portion 94*c* (i.e., second plate) in the first outer plate 72 (i.e., fourth through flow path forming portion) is joined to the inner plate 74 by brazing. Hence the refrigerant through-hole 94 (i.e., second through flow path) and the refrigerant flow path 101 (i.e., first refrigerant flow path) are separated.

The refrigerant through-hole 94 and the plurality of refrigerant flow paths 101 are separated between the top plate 70 and the first partition outer plate 75 configured as described above. The refrigerant through-hole 94 and the plurality of cooling water flow paths 100 are separated from each other.

Next, the cooling water through-hole 95 of the present embodiment will be described with reference to FIGS. 39, 40, 41, 42, 43, and 44.

Figure 39:
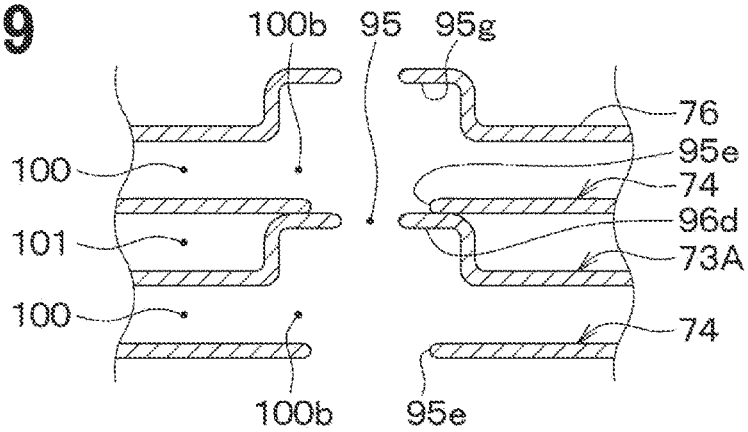
FIG. 39 is a cross-sectional view illustrating the refrigerant through-hole of the heat exchanger body in the heat exchanger according to the first embodiment.
Figure 40:
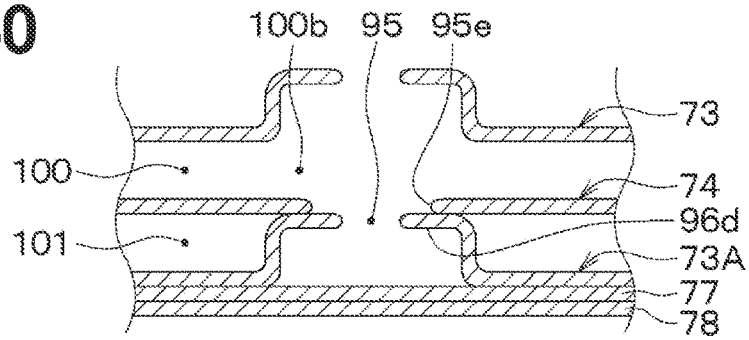
FIG. 40 is a cross-sectional view illustrating the refrigerant through-hole of the heat exchanger body in the heat exchanger according to the first embodiment.

Between the second partition outer plate 76 and the bracket 78 illustrated in FIGS. 39 and 40, a cooling water outlet 100*b* is provided between the through-hole forming portion 95*e* in the inner plate 74 and the second partition outer plate 76. The cooling water outlet 100*b* is provided to discharge the cooling water from the cooling water flow path 100 to the cooling water through-hole 95.

Between the through-hole forming portion 95*e* in the inner plate 74 and the reverse second outer plate 73A, the cooling water outlet 100*b* that communicates between the cooling water through-hole 95 and the cooling water flow path 100 is provided.

The through-hole forming portion 96*d* in the reverse second outer plate 73A is joined to the inner plate 74 by brazing. Hence the cooling water through-hole 95 and the refrigerant flow path 101 are separated.

Between the second partition outer plate 76 and the bracket 78, the cooling water through-hole 95 and the plurality of refrigerant flow paths 101 are separated. The cooling water through-hole 95 communicates with the plurality of cooling water flow paths 100.

Figure 41:
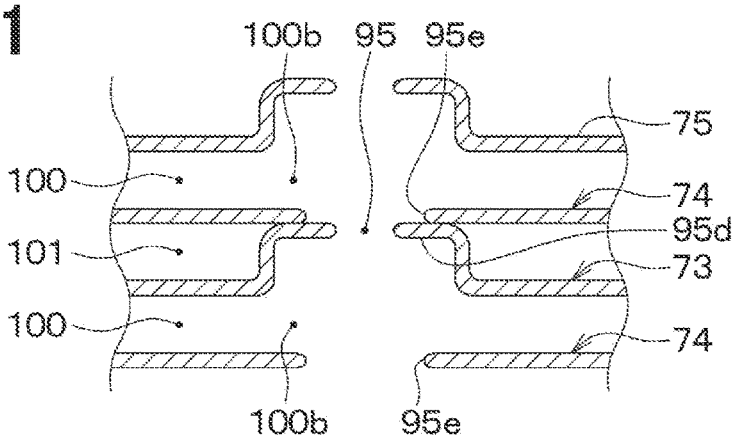
FIG. 41 is a cross-sectional view illustrating cooling water through-holes of the heat exchanger body in the heat exchanger according to the first embodiment.
Figure 42:
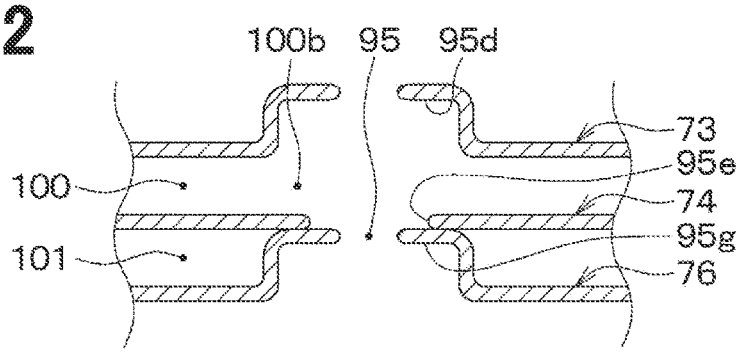
FIG. 42 is a cross-sectional view illustrating the cooling water through-holes of the heat exchanger body in the heat exchanger according to the first embodiment.

Between the first partition outer plate 75 and the second partition outer plate 76 illustrated in FIGS. 41 and 42, the cooling water outlet 100*b* is provided between the through-hole forming portion 95*e* in the inner plate 74 and the first partition outer plate 75. The cooling water outlet 100*b* communicates between the cooling water through-hole 95 and the cooling water flow path 100.

Between the through-hole forming portion 95*e* in the inner plate 74 and the second outer plate 73, the cooling water outlet 100*b* that communicates between the cooling water through-hole 95 and the cooling water flow path 100 is provided.

The through-hole forming portion 95*d* in the second outer plate 73 is joined to the inner plate 74 by brazing. Hence the cooling water through-hole 95 and the refrigerant flow path 101 are separated.

Between the first partition outer plate 75 and the second partition outer plate 76, the cooling water through-hole 95 and the plurality of refrigerant flow paths 101 are separated. The cooling water through-hole 95 and the cooling water flow path 100 communicate with each other.

Figure 43:
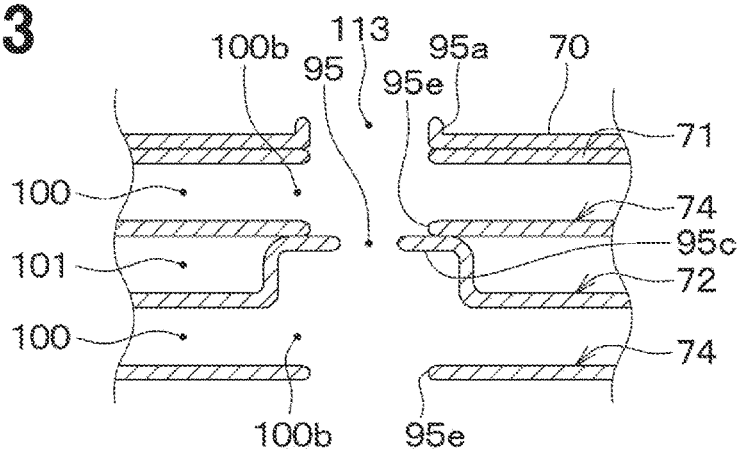
FIG. 43 is a cross-sectional view illustrating the cooling water through-holes of the heat exchanger body in the heat exchanger according to the first embodiment.
Figure 44:
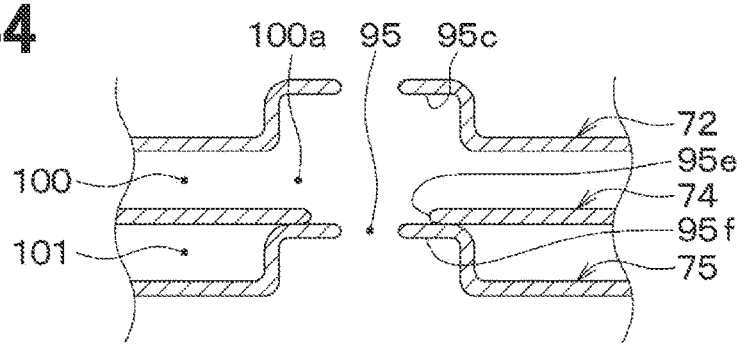
FIG. 44 is a cross-sectional view illustrating the cooling water through-holes of the heat exchanger body in the heat exchanger according to the first embodiment.

Between the top plate 70 and the first partition outer plate 75 illustrated in FIGS. 43 and 44, the cooling water outlet 100*b* is provided between the through-hole forming portion 95*e* in the inner plate 74 and the top outer plate 71. The cooling water outlet 100*b* discharges the cooling water from the cooling water flow path 100 to the cooling water through-hole 95.

Between the through-hole forming portion 95*e* in the inner plate 74 and the first outer plate 72, the cooling water outlet 100*b* for discharging cooling water from the cooling water flow path 100 to the cooling water through-hole 95 is provided.

The through-hole forming portion 95*c* in the first outer plate 72 is joined to the inner plate 74 by brazing. Hence the cooling water through-hole 95 and the refrigerant flow path 101 are separated.

Between the top plate 70 and the first partition outer plate 75, the cooling water through-hole 95 and the plurality of refrigerant flow paths 101 are separated. The cooling water through-hole 95 and the cooling water flow path 100 are separated from each other.

Next, the cooling water through-hole 96 of the present embodiment will be described with reference to FIGS. 45, 46, 47, 48, 49, and 50.

Figure 45:
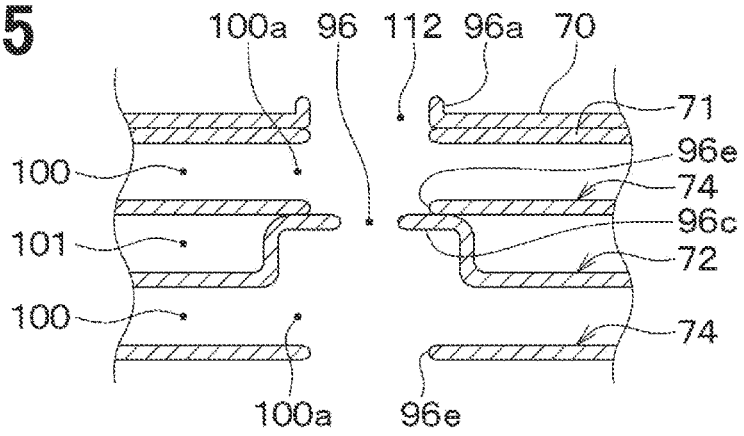
FIG. 45 is a cross-sectional view illustrating the cooling water through-holes of the heat exchanger body in the heat exchanger according to the first embodiment.
Figure 46:
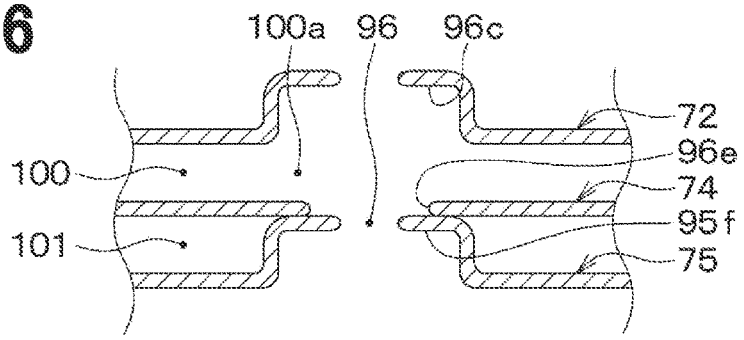
FIG. 46 is a cross-sectional view illustrating the cooling water through-holes of the heat exchanger body in the heat exchanger according to the first embodiment.

Between the top plate 70 and the first partition outer plate 75 illustrated in FIGS. 45 and 46, a cooling water inlet 100*a* is provided between the through-hole forming portion 96*e* in the inner plate 74 and the top outer plate 71. The cooling water inlet 100*a* is provided to guide the cooling water from the cooling water through-hole 96 to the cooling water flow path 100.

Between the through-hole forming portion 96*e* in the inner plate 74 and the first outer plate 72, the cooling water inlet 100*a* for guiding the cooling water from the cooling water through-hole 96 to the cooling water flow path 100 is provided.

The through-hole forming portion 96*c* in the first outer plate 72 is joined to the inner plate 74 by brazing. Hence the cooling water through-hole 96 and the refrigerant flow path 101 are separated.

Between the top plate 70 and the first partition outer plate 75, the cooling water through-hole 96 and the plurality of refrigerant flow paths 101 are separated. The cooling water through-hole 96 and the cooling water flow path 100 communicate with each other.

Figure 47:
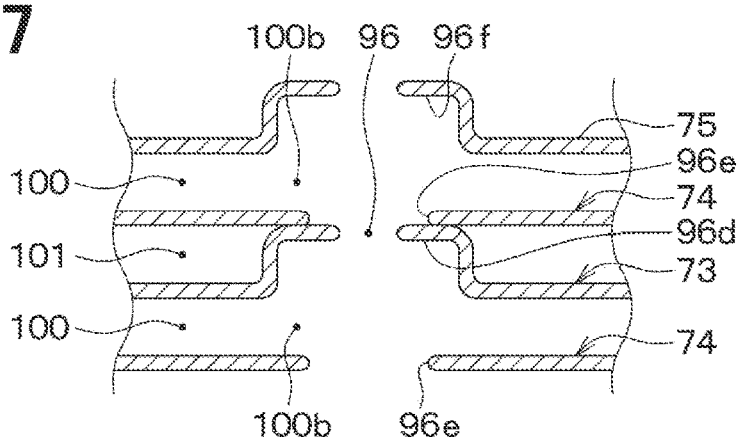
FIG. 47 is a cross-sectional view illustrating the cooling water through-holes of the heat exchanger body in the heat exchanger according to the first embodiment.
Figure 48:
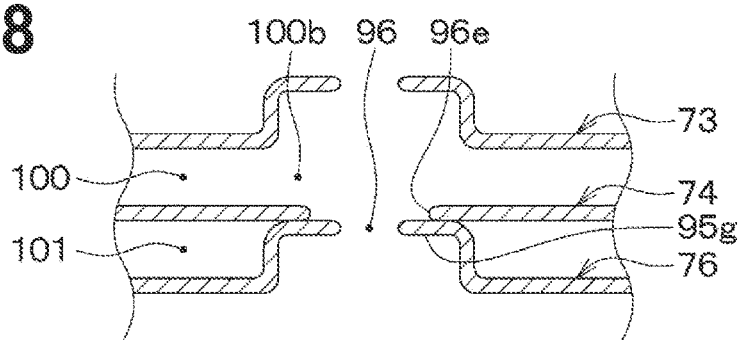
FIG. 48 is a cross-sectional view illustrating the cooling water through-holes of the heat exchanger body in the heat exchanger according to the first embodiment.

Between the first partition outer plate 75 and the second partition outer plate 76 illustrated in FIGS. 47 and 48, the cooling water inlet 100*a* is provided between the through-hole forming portion 96*e* in the inner plate 74 and the first partition outer plate 75.

The cooling water inlet 100*a* is provided to guide the cooling water from the cooling water through-hole 96 to the cooling water flow path 100.

Between the through-hole forming portion 96*e* in the inner plate 74 and the second outer plate 73, the cooling water inlet 100*a* that communicates between the cooling water through-hole 96 and the cooling water flow path 100 is provided.

The through-hole forming portion 96*d* in the second outer plate 73 is joined to the inner plate 74 by brazing. Hence the cooling water through-hole 96 and the refrigerant flow path 101 are separated.

Between the first partition outer plate 75 and the second partition outer plate 76, the cooling water through-hole 96 and the plurality of refrigerant flow paths 101 are separated. The cooling water through-hole 96 and the cooling water flow path 100 communicate with each other.

Figure 49:
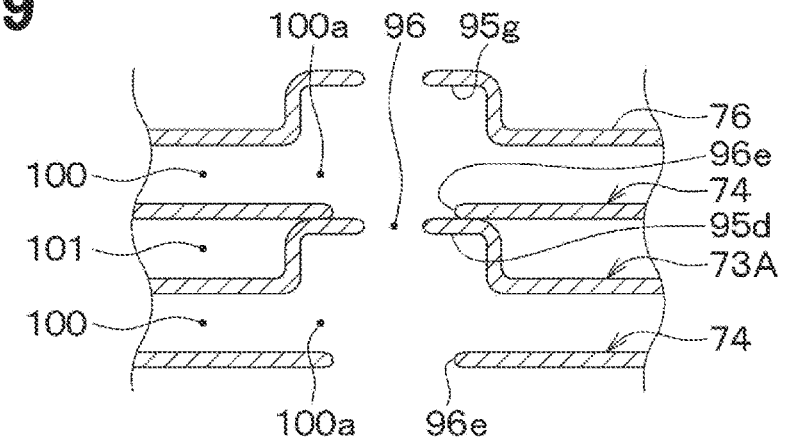
FIG. 49 is a cross-sectional view illustrating the cooling water through-holes of the heat exchanger body in the heat exchanger according to the first embodiment.
Figure 50:
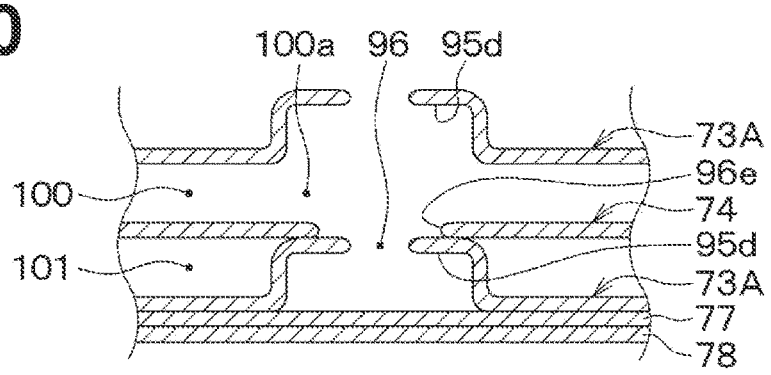
FIG. 50 is a cross-sectional view illustrating the cooling water through-holes of the heat exchanger body in the heat exchanger according to the first embodiment.

As illustrated in FIGS. 49 and 50, between the second partition outer plate 76 and the bracket 78, the through-hole forming portion 96*e* in the inner plate 74 forms the cooling water inlet 100*a* together with the second partition outer plate 76. The cooling water inlet 100*a* is provided to guide the cooling water from the cooling water through-hole 96 to the cooling water flow path 100.

The cooling water inlet 100*a* for guiding the cooling water from the cooling water through-hole 96 to the cooling water flow path 100 is provided between the through-hole forming portion 96*e* and the reverse second outer plate 73A in the inner plate 74.

The through-hole forming portion 95*d* in the reverse second outer plate 73A is joined to the inner plate 74 by brazing. Hence the cooling water through-hole 96 and the refrigerant flow path 101 are separated.

Between the second partition outer plate 76 and the bracket 78, the cooling water through-hole 96 and the plurality of refrigerant flow paths 101 are separated. The cooling water through-hole 96 communicates with the plurality of cooling water flow paths 100. The other side in the second direction D2 of the cooling water through-hole 96 (e.g., the lower side in FIG. 50) is closed by the bottom plate 77.

In the present embodiment as described above, each of the first outer plate 72, the second outer plate 73, the first partition outer plate 75, the second partition outer plate 76, and the reverse second outer plate 73A is configured to have a common outer shape.

As described above, the first outer plate 72 includes the through-hole forming portions 90*c*, 91*c*, 94*c*, 95*c*, 96*c*, 97*c*. As described above, the second outer plate 73 includes the through-hole forming portions 91*d*, 92*d*, 95*d*, 96*d*. As described above, the first partition outer plate 75 includes the through-hole forming portions 91*f*, 94*f*, 95*f*, 96*f*.

As described above, the second partition outer plate 76 includes the through-hole forming portions 92*g*, 94*g*, 95*g*, 96*g*. As described above, the reverse second outer plate 73A includes the through-hole forming portions 91*d*, 92*d*, 95*d*, 96*d*.

Hereinafter, for convenience of description, the first outer plate 72, the second outer plate 73, the first partition outer plate 75, and the second partition outer plate 76 are collectively referred to as outer plates 72, 73, 75, 76.

The through-hole forming portions 90*c*, 91*c*, 94*c*, 95*c*, 96*c*, 97*c*, the through-hole forming portions 91*d*, 92*d*, 95*d*, 96*d*, the through-hole forming portions 91*f*, 94*f*, 95*f*, 96*f*, and the through-hole forming portions 92*g*, 94*g*, 95*g*, 96*g* are collectively referred to as through-hole forming portions 90*c*, . . . , 96*g*.

Each of the outer plates 72, 73, 75, 76 of the present embodiment includes different combinations of through-hole forming portions (i.e., a plurality of through flow path forming portions) among the through-hole forming portions 90*c*, . . . , 96*g* (i.e., through flow path forming portion).

As a result, the outer plates 72, 73, 75, 76 are different types of outer plates. The second outer plate 73 and the reverse second outer plate 73A are formed of a common plate as described above.

As described above, the outer plates 72, 73, 75, 76 can be molded using a mold having a nested structure. At this time, while the nested mold for forming the through-hole forming portion is replaced for each of different types of outer plates, a core or a cavity except for the nested mold among molds is used as a common component.

Next, the operation of the heat exchanger 1 of the present embodiment will be described.

First, cooling water flows into the cooling water through-hole 96 through the cooling water connector 40*a* and the cooling water inlet 112. The cooling water flowing through the cooling water through-hole 96 is diverted into the plurality of cooling water flow paths 100 between the top plate 70 and the bracket 78. The cooling water having passed through the plurality of cooling water flow paths 100 is collected in the cooling water through-hole 95 and discharged through the cooling water outlet 113 and the cooling water connector 40*b*.

On the other hand, the high-pressure refrigerant discharged from the compressor flows into the refrigerant through-hole 90 through the refrigerant connector 30*a* and the refrigerant inlet 110. The high-pressure refrigerant flowing through the refrigerant through-hole 90 is diverted into the plurality of refrigerant flow paths 101 between the top outer plate 71 and the first partition outer plate 75. The high-pressure refrigerant diverted into the plurality of refrigerant flow paths 101 is collected in the refrigerant through-holes 91.

At this time, the high-pressure refrigerant in the plurality of refrigerant flow paths 101 between the top outer plate 71 and the first partition outer plate 75 radiates heat to the cooling water in the cooling water flow path 100.

Thereafter, the refrigerant is diverted from the refrigerant through-hole 91 to the plurality of refrigerant flow paths 101 between the first partition outer plate 75 and the second partition outer plate 76. The high-pressure refrigerant thus diverted into the plurality of refrigerant flow paths 101 is collected in the refrigerant through-holes 92.

At this time, the high-pressure refrigerant in the plurality of refrigerant flow paths 101 between the first partition outer plate 75 and the second partition outer plate 76 radiates heat to the cooling water in the cooling water flow path 100.

Thereafter, the high-pressure refrigerant having passed through the refrigerant through-hole 92 flows to the gas-liquid separator 20 through the discharge port 114 and the receiver connector 50. The gas-liquid separator 20 separates the high-pressure refrigerant having passed through the receiver connector 50 into a gas-phase refrigerant and a liquid-phase refrigerant and discharges the liquid-phase refrigerant out of the liquid-phase refrigerant and the gas-phase refrigerant.

The liquid-phase refrigerant from the gas-liquid separator 20 flows into the refrigerant through-hole 93 through the receiver connector 50 and the introduction port 115. The liquid-phase refrigerant in the refrigerant through-hole 93 is diverted into the plurality of refrigerant flow paths 101 between the second partition outer plate 76 and the bracket 78.

The liquid-phase refrigerant in the plurality of refrigerant flow paths 101 between the second partition outer plate 76 and the bracket 78 is collected in the refrigerant through-holes 94.

At this time, the liquid-phase refrigerant in the plurality of refrigerant flow paths 101 between the second partition outer plate 76 and the bracket 78 radiates heat to the cooling water in the cooling water flow path 100. Thereby, the liquid-phase refrigerant in the plurality of refrigerant flow paths 101 is subcooled.

Thereafter, the liquid-phase refrigerant collected in the refrigerant through-hole 94 passes through the refrigerant through-hole 94 and then flows to the pressure reducing valve through the refrigerant outlet 111 and the refrigerant connector 30*b*.

Next, a method for manufacturing the heat exchanger 1 of the present embodiment will be described.

First, the top plate 70, the top outer plate 71, the plurality of first outer plates 72, the plurality of second outer plates 73, the plurality of inner plates 74, the first partition outer plate 75, and the second partition outer plate 76 are prepared.

The plurality of reverse second outer plates 73A, the bottom plate 77, the bracket 78, the plurality of cooling water fins 79, and the plurality of refrigerant fins 80 are prepared.

In the next step, the top plate 70, the top outer plate 71, . . . , the bracket 78, the plurality of cooling water fins 79, and the plurality of refrigerant fins 80 prepared as above are stacked and fixed temporarily. Hereinafter, the top plate 70, the top outer plate 71, . . . , the bracket 78, the plurality of cooling water fins 79, and the plurality of refrigerant fins 80 temporarily fixed as described above are referred to as a temporarily fixed plate stack.

In the next step, the gas-liquid separator 20, the refrigerant connectors 30*a*, 30*b*, the cooling water connectors 40*a*, 40*b*, and the receiver connector 50 are assembled to the temporarily fixed plate stack.

Next, the temporarily fixed plate stack, the gas-liquid separator 20, the refrigerant connectors 30*a*, 30*b*, the cooling water connectors 40*a*, 40*b*, and the receiver connector 50 thus assembled are integrated by brazing in a high-temperature furnace. As a result, the manufacture of the heat exchanger 1 is completed.

According to the present embodiment described above, the heat exchanger 1 includes the plate stack 10 and the gas-liquid separator 20. The plate stack 10 is formed with the refrigerant inlet 110 through which the refrigerant from the compressor enters and the refrigerant outlet 111 through which the refrigerant is discharged to the pressure reducing valve.

The plate stack 10 includes the inner plate 74, the top outer plate 71, the plurality of first outer plates 72, and the plurality of second outer plates 73. The plate stack 10 includes the first partition outer plate 75, the second partition outer plate 76, and the plurality of reverse second outer plates 73A.

The inner plate 74, the top outer plate 71, the plurality of first outer plates 72, the plurality of second outer plates 73, and the first partition outer plate 75 are each formed in a plate shape spreading in the first direction D1.

The inner plate 74, the top outer plate 71, the plurality of first outer plates 72, the plurality of second outer plates 73, and the first partition outer plate 75 are stacked in the second direction D2 orthogonal to the first direction D1.

The second partition outer plate 76 and the plurality of reverse second outer plates 73A are each formed in a plate shape spreading in the first direction D1. The second partition outer plate 76 and the plurality of reverse second outer plates 73A are stacked in the second direction D2.

In the condensing portion 10A, the first outer plate 72 is disposed between the two inner plates 74. The refrigerant flow path 101 through which the refrigerant flowing from the refrigerant inlet 110 flows is formed between the first outer plate 72 and the inner plate 74 on one side in the second direction D2 of the two inner plates 74.

The cooling water flow path 100 through which the cooling water flows is formed between the inner plate 74 and the first outer plate 72 on the other side in the second direction D2 of the two inner plates 74. The condensing portion 10A radiates heat from the refrigerant in refrigerant flow path 101 to the cooling water in cooling water flow path 100. In the condensing portion 10A, the cooling water flow path 100 and the refrigerant flow path 101 are formed to overlap each other in the second direction D2 (i.e., stacking direction).

The gas-liquid separator 20 separates the refrigerant discharged from the condensing portion 10A into a gas-phase refrigerant and a liquid-phase refrigerant and discharges the liquid-phase refrigerant out of the gas-phase refrigerant and the liquid-phase refrigerant. In the subcooling portion 10B, the reverse second outer plate 73A is disposed between the two inner plates 74.

The refrigerant flow path 101 through which the liquid-phase refrigerant discharged from the gas-liquid separator 20 flows toward the refrigerant through-hole 91 is formed between the reverse second outer plate 73A and the inner plate 74 on one side in the second direction D2 of the two inner plates 74.

The cooling water flow path 100 through which the cooling water flows is formed between the reverse second outer plate 73A and the inner plate 74 on the other side in the second direction D2 of the two inner plates 74.

The subcooling portion 10B radiates heat from the liquid-phase refrigerant in the refrigerant flow path 101 to the cooling water in the cooling water flow path 100. In the subcooling portion 10B, the cooling water flow path 100 and the refrigerant flow path 101 are formed to overlap each other in the second direction D2 (i.e., stacking direction).

The cooling water from the cooling water inlet (i.e., heat-medium inlet) 112 flows through the cooling water flow path 100 of the subcooling portion 10B and the cooling water flow path 100 of the subcooling portion 10B. The cooling water having passed through the cooling water flow path 100 of the subcooling portion 10B and the cooling water flow path 100 of the subcooling portion 10B is discharged from the cooling water outlet (i.e., heat-medium outlet) 113.

The refrigerant inlet 110 and the refrigerant outlet 111 are disposed on the opposite side of the subcooling portion 10B with respect to the condensing portion 10A.

As described above, the following effects can be obtained as compared to a case where the refrigerant inlet 110 is disposed on the opposite side of subcooling portion 10B with respect to the condensing portion 10A in the second direction D2 and the refrigerant outlet 111 is disposed on the opposite side of condensing portion 10A with respect to the subcooling portion 10B in the second direction D2.

That is, in the manufacturing process of mounting the heat exchanger 1 on the vehicle (i.e., an object to be mounted), the refrigerant pipe can be connected from the one side in the second direction D2 to the refrigerant inlet 110 and the refrigerant outlet 111. It is thus possible to reduce the number of assembling steps at the time of mounting the heat exchanger 1 on the vehicle. Further, it is possible to improve the mountability of the heat exchanger 1 on the vehicle.

In the present embodiment, the cooling water inlet 112 and the cooling water outlet 113 are disposed on the opposite side in the second direction D2 of the subcooling portion 10B with respect to the condensing portion 10A.

Therefore, the following effects can be obtained as compared to a case where the cooling water inlet 112 is disposed on the opposite side in the second direction D2 of the subcooling portion 10B with respect to the condensing portion 10A and the cooling water outlet 113 is disposed on the opposite side in the second direction D2 of the condensing portion 10A with respect to the subcooling portion 10B.

This can facilitate performing the step of connecting the cooling water pipe to each of the cooling water inlet 112 and the cooling water outlet 113. Therefore, the number of assembling steps for connecting the refrigerant pipe to the refrigerant inlet 110 and the refrigerant outlet 111 can be reduced, and the number of assembling steps for connecting the cooling water pipe to the cooling water inlet 112 and the cooling water outlet 113 can be reduced.

The condensing portion 10A of the present embodiment includes the refrigerant flow path (i.e., first refrigerant flow path) 101 disposed between the top plate 70 and the first partition outer plate 75. The condensing portion 10A includes the refrigerant flow path (i.e., third refrigerant flow path) 101 disposed between the first partition outer plate 75 and the second partition outer plate 76.

Here, the refrigerant flow path 101 disposed between the top plate 70 and the first partition outer plate 75 is referred to as an upper refrigerant flow path 101. The refrigerant flow path 101 disposed between the first partition outer plate 75 and the second partition outer plate 76 is defined as a lower refrigerant flow path 101. As a result, the refrigerant having passed through the upper refrigerant flow path 101 flows into the lower refrigerant flow path 101.

Here, when the refrigerant flows through the upper refrigerant flow path 101, the refrigerant in the upper refrigerant flow path 101 radiates heat to the cooling water in the cooling water flow path (i.e., first heat-medium flow path) 100. When the refrigerant flows into the lower refrigerant flow path 101, the refrigerant in the lower refrigerant flow path 101 radiates heat to the cooling water in the cooling water flow path (i.e., third heat-medium flow path) 100.

Hence the refrigerant cooled in the upper refrigerant flow path 101 and the lower refrigerant flow path 101 flows into the refrigerant inlet of the gas-liquid separator 20. It is thus possible to sufficiently cool the refrigerant in the condensing portion 10A and then guide the refrigerant to the refrigerant inlet of the gas-liquid separator 20.

Therefore, it is possible to improve the refrigerant cooling performance for cooling the refrigerant as compared to a case where the lower refrigerant flow path 101 is not provided.

In the present embodiment, the condensing portion 10A constitutes the refrigerant through-hole 94 for guiding the liquid-phase refrigerant from the subcooling portion 10B to the refrigerant outlet 111. This eliminates the need to separately provide a refrigerant pipe for guiding the liquid-phase refrigerant from the subcooling portion 10B to the refrigerant outlet 111.

In addition, in the present embodiment, the subcooling portion 10B constitutes the refrigerant through-hole 92 that guides the refrigerant from the condensing portion 10A to the refrigerant inlet of the gas-liquid separator 20. This eliminates the need to separately provide a refrigerant pipe for guiding the refrigerant from the condensing portion 10A to the refrigerant inlet of the gas-liquid separator 20.

As described above, since the number of parts can be reduced, the configuration of the heat exchanger 1 can be simplified.

In the present embodiment, as described above, while the nest mold for forming the through-hole forming portion is replaced for each different type of outer plate, a core or a cavity except for the nest mold among molds is used as a common component. Therefore, the manufacturing cost can be reduced as compared to a case where different molds are used for all the outer plates.

In the present embodiment, each of the second outer plate 73 and the reverse second outer plate 73A is formed of a plate common to each other. This makes it possible to reduce the number of types of plates as compared to a case where the second outer plate 73 and the reverse second outer plate 73A are formed of different plates, and to thereby reduce the manufacturing cost.

Figure 51:
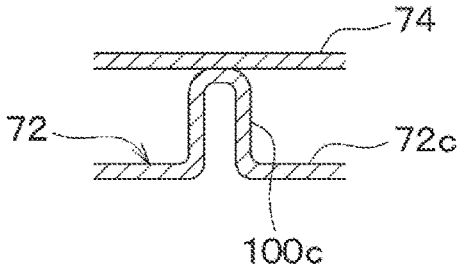
FIG. 51 is a cross-sectional view taken along line LI-LI in FIG. 7.
Figure 52:
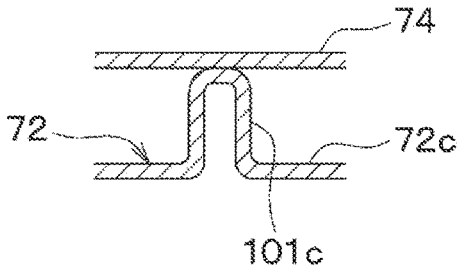
FIG. 52 is a cross-sectional view taken along line LII-LII in FIG. 7.

As illustrated in FIGS. 51 and 52, the protrusions 100*c*, 101*c* of the first outer plate 72 of the present embodiment are in contact with the inner plate 74. Thus, the inner plate 74 is supported by the protrusions 100*c*, 101*c* of the first outer plate 72 from the other side in the second direction D2 (e.g., the lower side in FIGS. 51 and 52). Thereby, the strength of the inner plate 74 in the second direction D2 can be increased.

Figure 53:
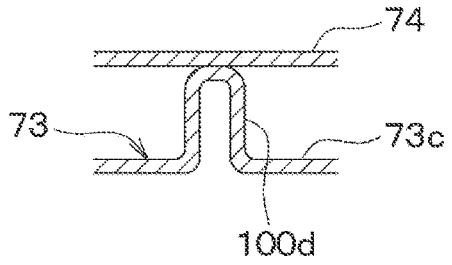
FIG. 53 is a cross-sectional view taken along line LIII-LIII in FIG. 7.
Figure 54:
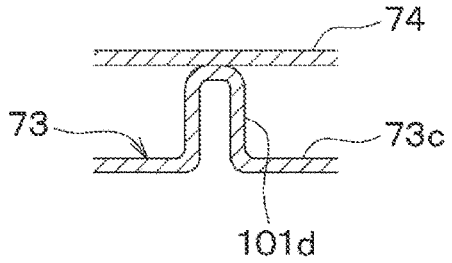
FIG. 54 is a cross-sectional view taken along line LIV-LIV in FIG. 7.

Similarly, as illustrated in FIGS. 53 and 54, the inner plate 74 is supported by the protrusions 100*d*, 101*d* in the second outer plate 73 from the other side in the second direction D2 (e.g., the lower side in FIGS. 53 and 54). Thereby, the strength of the inner plate 74 in the second direction D2 can be increased.

Figure 55:
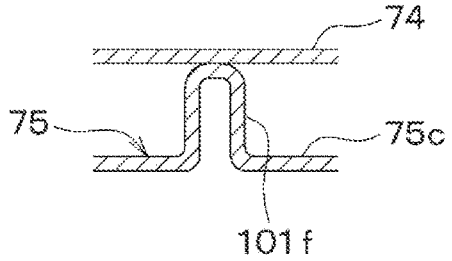
FIG. 55 is a cross-sectional view taken along line LV-LV in FIG. 7.
Figure 56:
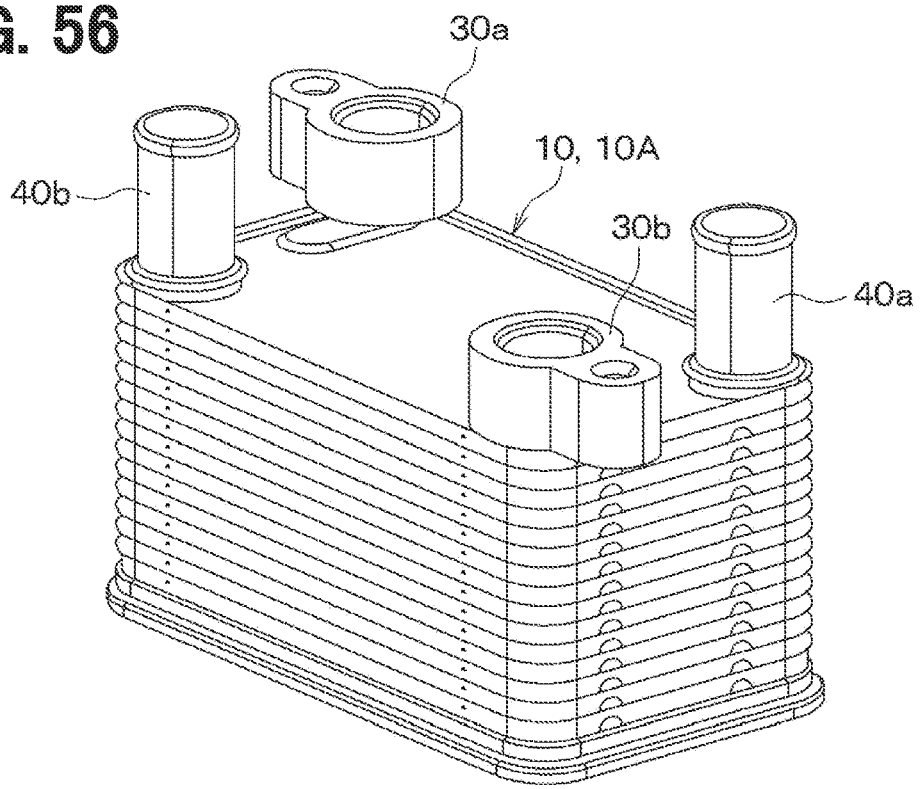
FIG. 56 is a perspective view illustrating an overall configuration of a heat exchanger according to a second embodiment.
Figure 57:
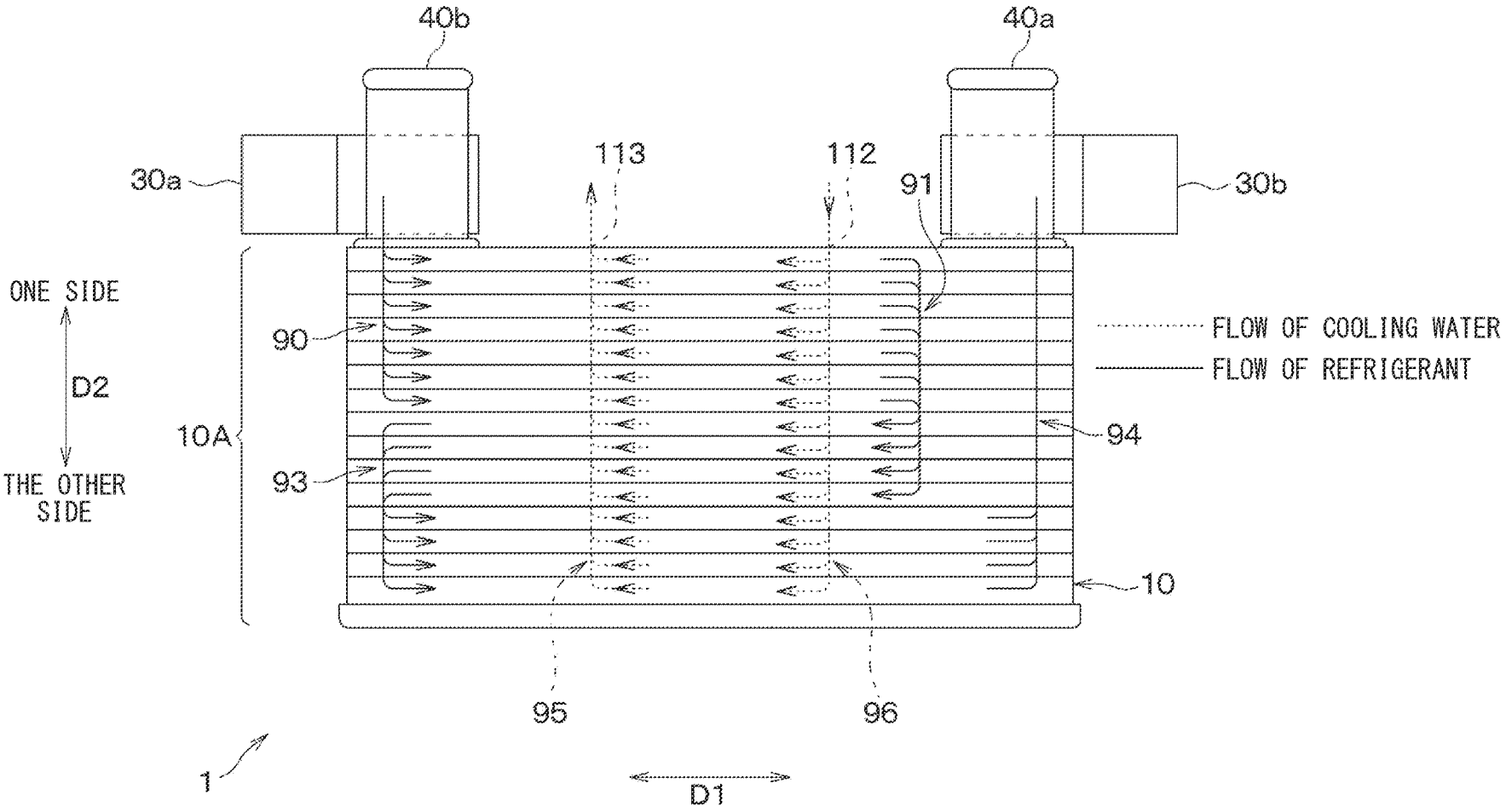
FIG. 57 is a schematic view illustrating the overall configuration of the heat exchanger of FIG. 56 and a flow of a refrigerant and a flow of cooling water in the heat exchanger.

As illustrated in FIG. 55, the protrusion 101*f* in the first partition outer plate 75 is in contact with the inner plate 74. Similarly, the protrusion 100*f* of the first partition outer plate 75 is in contact with the inner plate 74.

Thus, the first partition outer plate 75 supports the inner plate 74 from the other side in the second direction D2 (e.g., the lower side in FIG. 55) by the protrusions 100*f*, 101*f*. Thereby, the strength of the inner plate 74 in the second direction D2 can be increased.

The protrusions 100*d*, 101*d* of the reverse second outer plate 73A are in contact with the inner plate 74. Thus, the reverse second outer plate 73A supports the inner plate 74 by the protrusions 100*d*, 101*d*. Thereby, the strength of the inner plate 74 in the second direction D2 can be increased.

Similarly, the protrusions 100*g*, 101*g* in the second partition outer plate 76 are in contact with the inner plate 74. Thus, the inner plate 74 is supported by the protrusions 100*g*, 101*g* in the second partition outer plate 76. Thereby, the strength of the inner plate 74 in the second direction D2 can be increased.

In the present embodiment, the outer shapes of the first outer plate 72 and the second outer plate 73A are formed in common. However, the first outer plate 72 and the second outer plate 73A include different combinations of through-hole forming portions among the through-hole forming portions 94*d*, 72*d*, 91*d*, 94*c*, 90*c*, 91*c*, 96*c*, 95*c*, 95*d*, 96*d* (i.e., the plurality of flow path forming portions).

Hence the first outer plate 72 and the second outer plate 73A constitute different types of outer plates. Therefore, the first outer plate 72 and the second outer plate 73A can have a common mold for forming the outer shape.

In the present embodiment, the inner plate (i.e., first and third plates) 74 of the condensing portion 10A and the inner plate (i.e., fourth and sixth plates) 74 of the subcooling portion 10B are each formed by one type of plate (i.e., common plate). It is thus possible to reduce the number of parts of the plate constituting the heat exchanger 1 can be reduced.

Second Embodiment

In the first embodiment, the example has been described where the heat exchanger 1 includes the gas-liquid separator 20, the condensing portion 10A, and the subcooling portion 10B.

However, instead of this, the present second embodiment in which the gas-liquid separator 20 and the subcooling portion 10B are deleted and the heat exchanger 1 includes the condensing portion 10A will be described with reference to FIGS. 56 to 63. In FIGS. 56 to 59, the same reference numerals as those in FIGS. 1 to 4 denote the same components, and the description thereof will be omitted.

As illustrated in FIGS. 56 to 59, the heat exchanger 1 of the present embodiment includes a plate stack 10, refrigerant connectors 30*a*, 30*b*, and cooling water connectors 40*a*, 40*b*. The plate stack 10 of the present embodiment is formed of the condensing portion 10A. As in the first embodiment, the refrigerant connectors 30*a*, 30*b* and the cooling water connectors 40*a*, 40*b* are disposed on one side in the second direction D2 with respect to the condensing portion 10A (e.g., the upper side in FIG. 57).

The plate stack 10 includes a top plate 70, a top outer plate 71, a plurality of first outer plates 72, a plurality of second outer plates 73B, a plurality of inner plates 74, a first partition outer plate 75, and a second partition outer plate 76A.

In addition, the plate stack 10 is provided with a bottom plate 77, a bracket 78, a plurality of cooling water fins 79, and a plurality of the refrigerant fins 80.

The plate stack 10 is provided with refrigerant through-holes 90, 91, 93, 94 and cooling water through-holes 95, 96. The refrigerant through-holes 90, 91, 93, 94 and the cooling water through-holes 95, 96 are formed in the plate stack 10 over the second direction D2.

Figure 58:
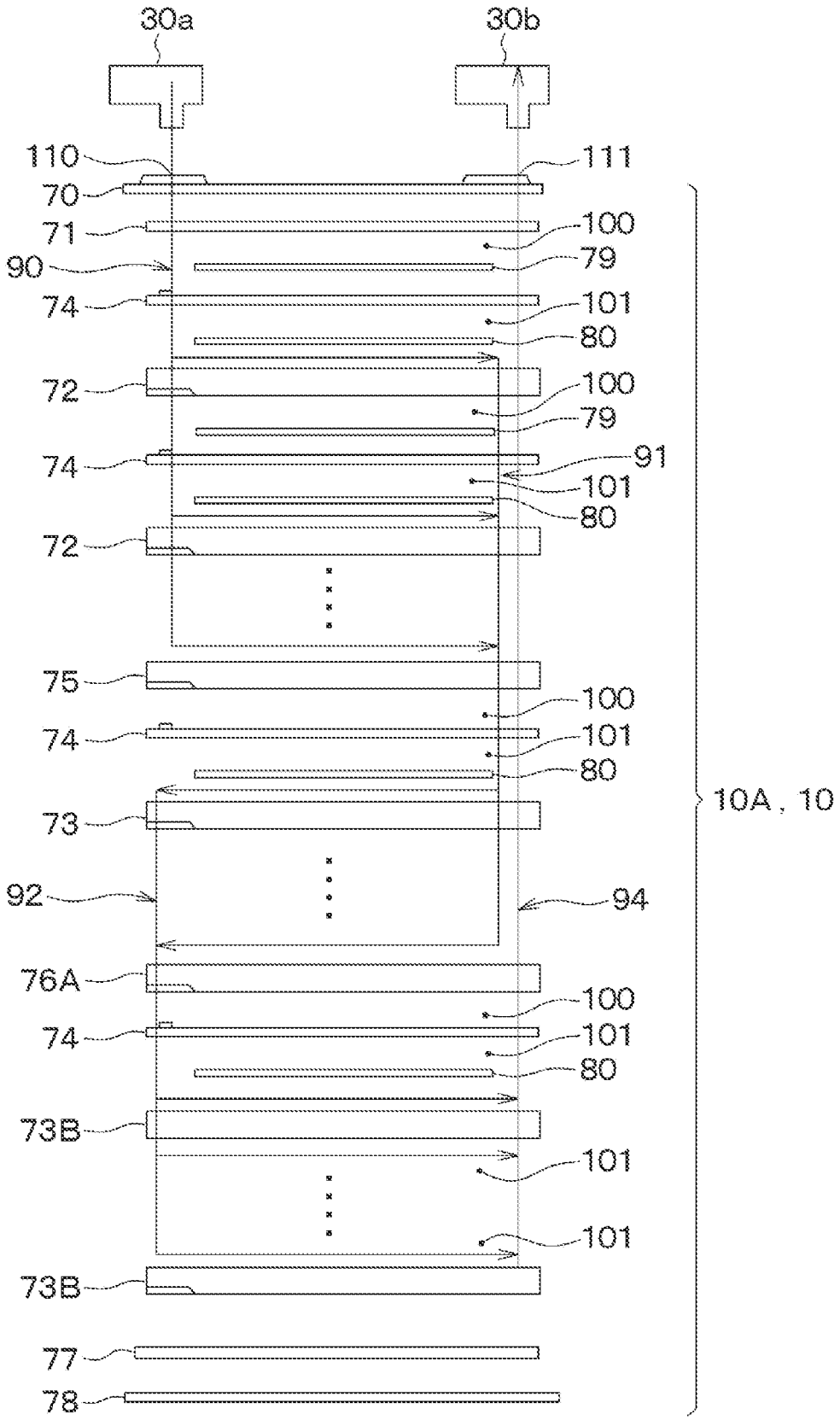
FIG. 58 is a view illustrating a placement relationship between a top plate, a top outer plate, first outer plates, second outer plates, inner plates, a second partition outer plate, and the like constituting the heat exchanger of FIG. 56 and refrigerant through-holes.
Figure 59:
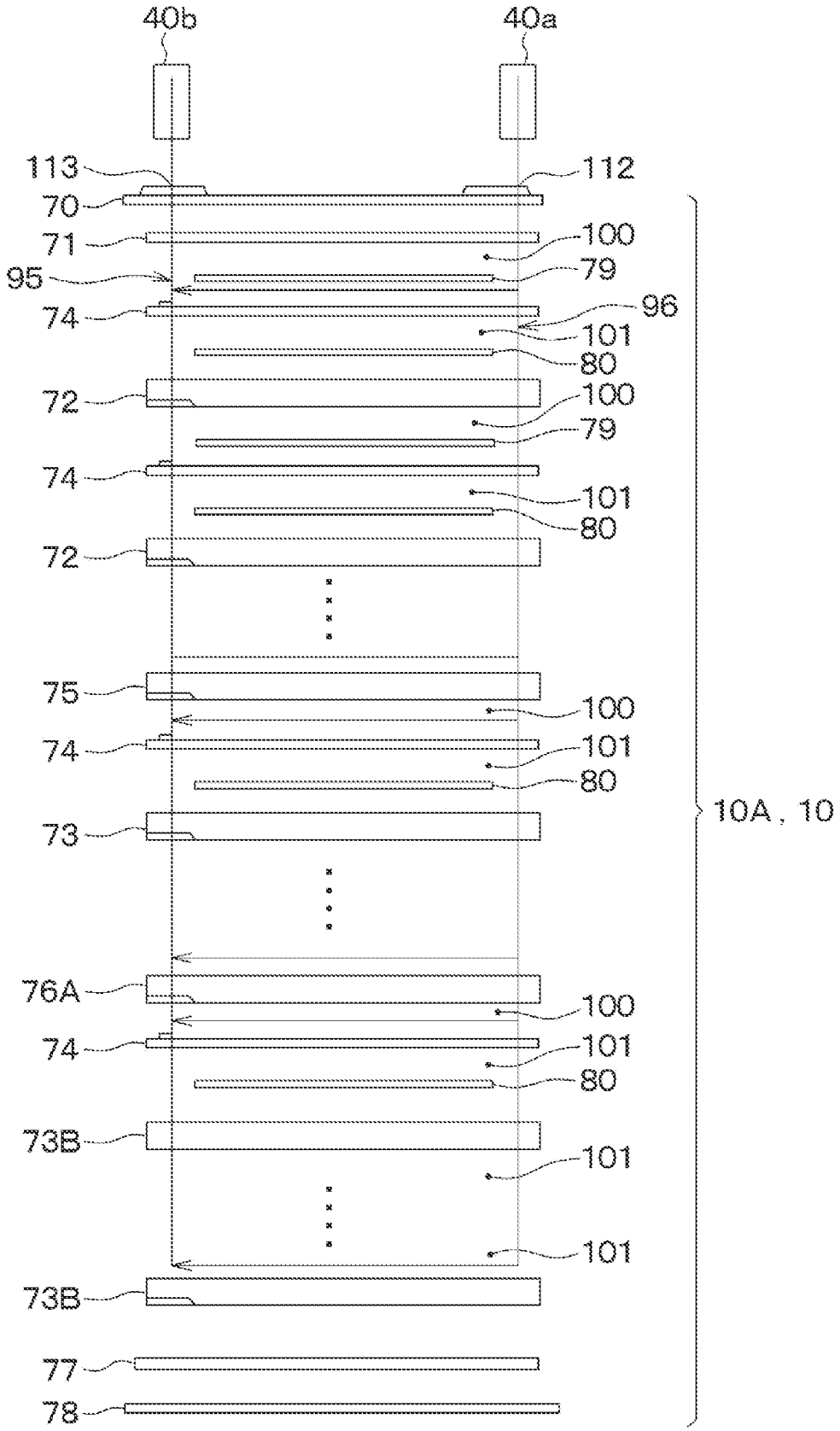
FIG. 59 is a view illustrating a placement relationship between the top plate, the top outer plate, the first outer plates, the second outer plates, the inner plates, the second partition outer plate, and the like constituting the heat exchanger of FIG. 56 and cooling water through-holes.

The configuration on the other side in the second direction D2 with respect to the second partition outer plate 76A in the plate stack 10 of FIG. 58 (e.g., the upper side in FIG. 58) is the same as the configuration on the other side in the second direction D2 with respect to the second partition outer plate 76A in the plate stack 10 of FIG. 3.

The configuration on the other side in the second direction D2 with respect to the second partition outer plate 76A (e.g., the lower side in FIG. 58) in the plate stack 10 of FIG. 58 is different from the configuration on the other side in the second direction D2 with respect to the second partition outer plate 76A in the plate stack 10 of FIG. 3.

One inner plate 74 and one second outer plate 73B are alternately disposed on the other side in the second direction with respect to the second partition outer plate 76A in the plate stack 10 of the present embodiment (e.g., the lower side in FIG. 58).

First, a cooling water flow path 100 is formed between the second partition outer plate 76A and the inner plate 74 on the other side in the second direction D2 with respect to the second partition outer plate 76A (e.g., the lower side in FIG. 58).

A refrigerant flow path 101 is formed between the inner plate 74 and the second outer plate 73B on the other side in the second direction D2 with respect to the inner plate 74.

Furthermore, the cooling water flow path 100 is formed between the inner plate 74 and the second outer plate 73B on the other side in the second direction D2 with respect to the second outer plate 73B. In this manner, one cooling water flow path 100 and one refrigerant flow path 101 are arranged in the second direction D2 on the other side in the second direction D2 with respect to the second partition outer plate 76A of each of FIGS. 58 and 59.

In the present embodiment, as in the first embodiment, the cooling water fin 79 is disposed in the cooling water flow path 100. The refrigerant fin 80 is disposed in the refrigerant flow path 101.

Figure 60:
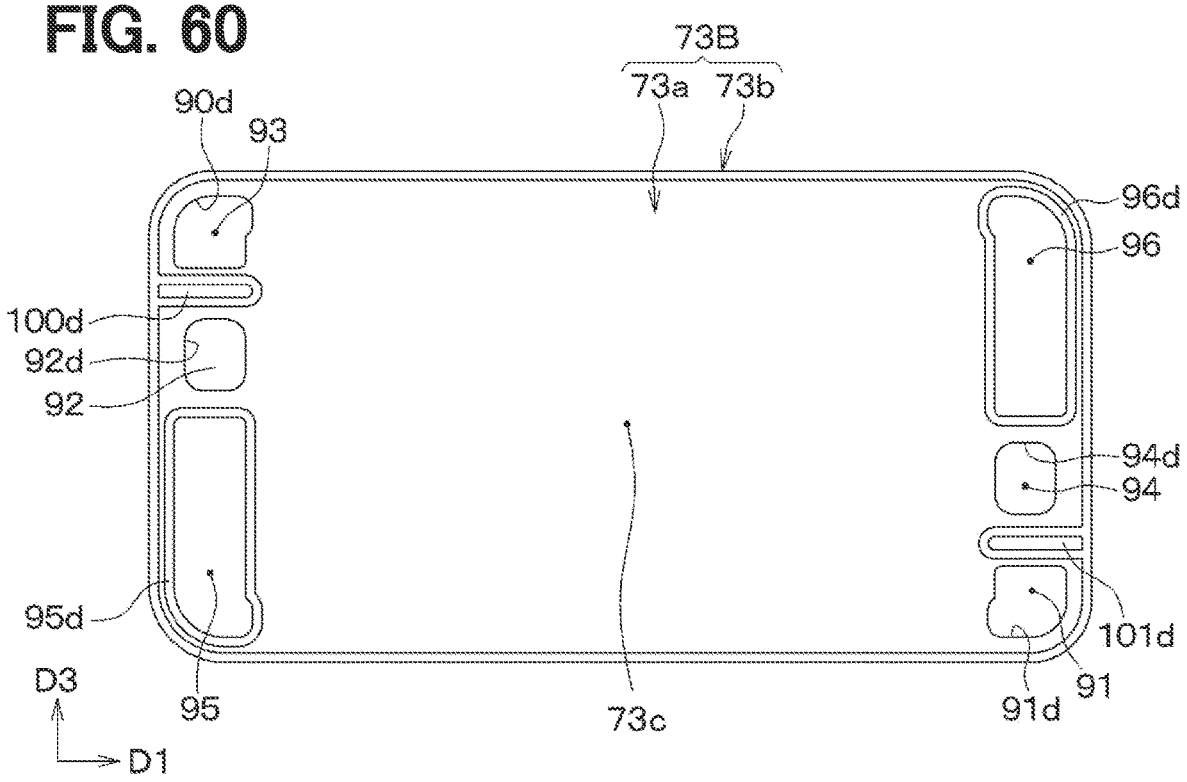
FIG. 60 is a view of the second outer plate in FIG. 58 as viewed from one side in the second direction.

The second outer plate 73B of FIG. 60 is obtained by adding a through-hole forming portion 90*d* to the second outer plate 73 of FIG. 12. The through-hole forming portion 90*d* forms the refrigerant through-hole 93 in the bottom 73*a* of the second outer plate 73B. The through-hole forming portion 90*d* is disposed on one side in the third direction D3 on the other side in the first direction D1 in the bottom 73*a*.

Each of the through-hole forming portions 90*d* is disposed at the same position as a refrigerant flow path forming portion 73*c* forming the refrigerant flow path 101 in a bottom 72*a* in the second direction D2. The refrigerant flow path forming portion 73*c* is disposed on the intermediate side in the third direction D3 in the bottom 72*a*.

In addition, a through-hole forming portion 94*d* forming the refrigerant through-hole 94 in the bottom 72*a* of the second outer plate 73B is disposed at the same position as the refrigerant flow path forming portion 73*c* of the bottom 72*a* in the third direction D3.

Figure 61:
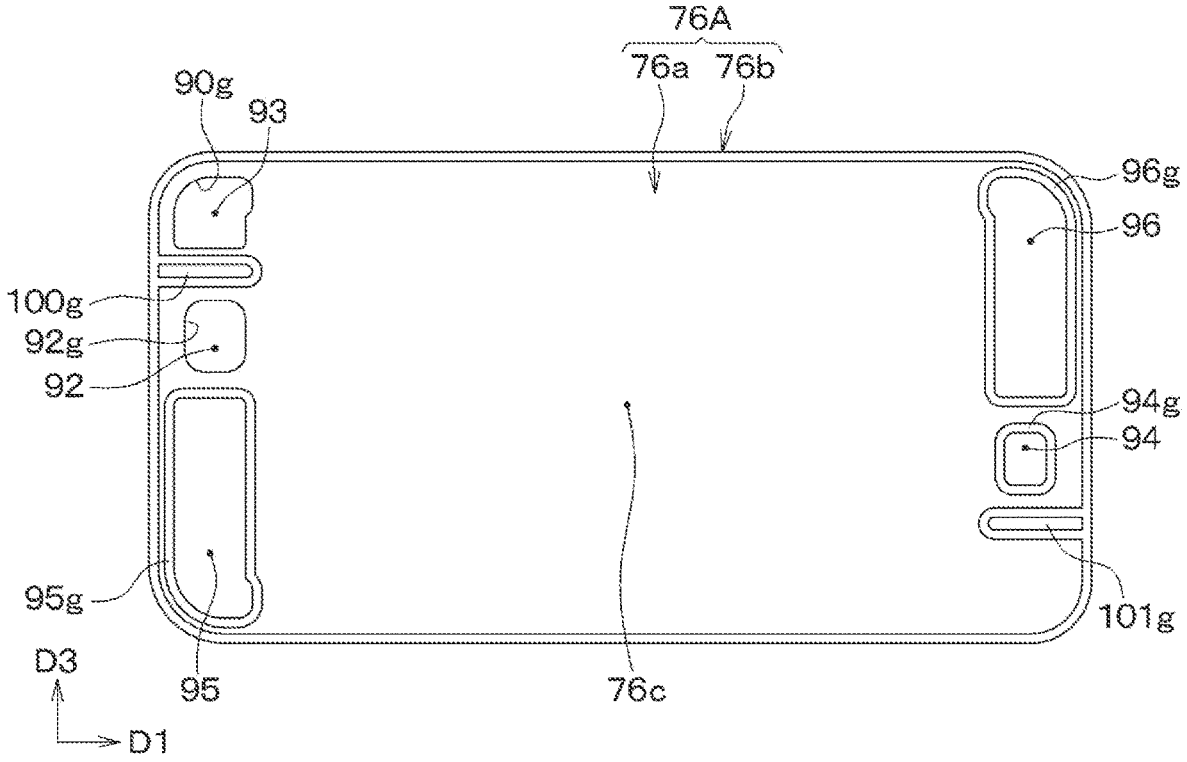
FIG. 61 is a view of the second partition outer plate in FIG. 58 as viewed from the one side in the second direction.

The second partition outer plate 76A of FIG. 61 is obtained by adding a through-hole forming portion 90*g* to the second partition outer plate 76 of FIG. 17. The through-hole forming portion 90*g* forms the refrigerant through-hole 93 in the bottom 76*a* of the second partition outer plate 76A.

The through-hole forming portion 90*g* is disposed at the same position as a refrigerant flow path forming portion 76*c* of the bottom 76*a* in the second direction D2. The refrigerant flow path forming portion 76*c* is disposed on the intermediate side in the third direction D3 in the bottom 76*a*.

Figure 62:
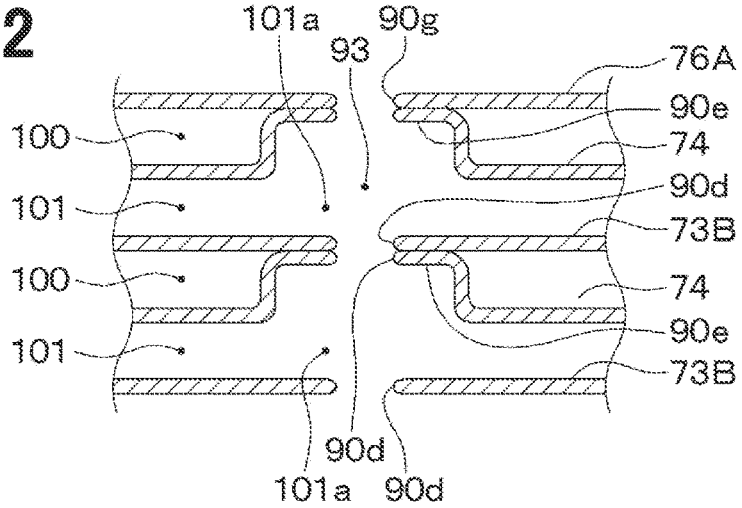
FIG. 62 is a cross-sectional view illustrating the refrigerant through-hole of the heat exchanger body in the heat exchanger according to the second embodiment.

As illustrated in FIG. 62, the through-hole forming portion 90*e* in the inner plate 74 is joined to the second partition outer plate 76A by brazing. Hence the refrigerant through-hole 93 and the cooling water flow path 100 are separated from each other.

Figure 63:
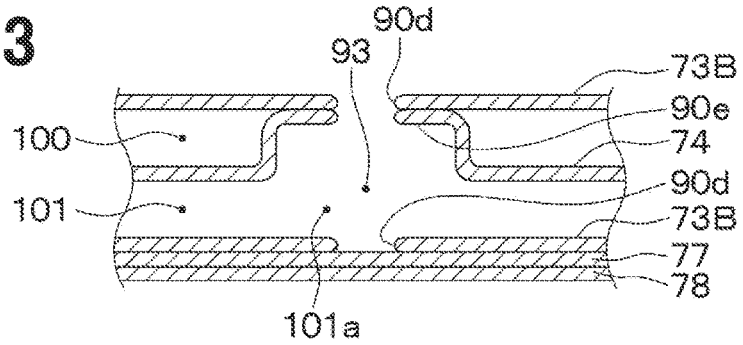
FIG. 63 is a cross-sectional view illustrating the refrigerant through-hole of the heat exchanger body in the heat exchanger according to the second embodiment.

As illustrated in FIGS. 62 and 63, the through-hole forming portion 90*d* in the second outer plate 73B forms the refrigerant introduction port 101*a* together with the inner plate 74. The refrigerant introduction port 101*a* is provided to guide the refrigerant from the refrigerant through-hole 93 to the refrigerant flow path 101.

The through-hole forming portion 90*e* in the inner plate 74 is joined to the second outer plate 73B by brazing. Hence the refrigerant through-hole 93 and the cooling water flow path 100 are separated from each other.

In this manner, the refrigerant through-hole 93 and the plurality of cooling water flow paths 100 are separated from each other. The refrigerant through-hole 93 communicates with the plurality of refrigerant flow paths 101. The other side in the second direction D2 of the refrigerant through-hole 93 (e.g., the lower side in FIG. 63) is closed by the bottom plate 77.

Figure 64:
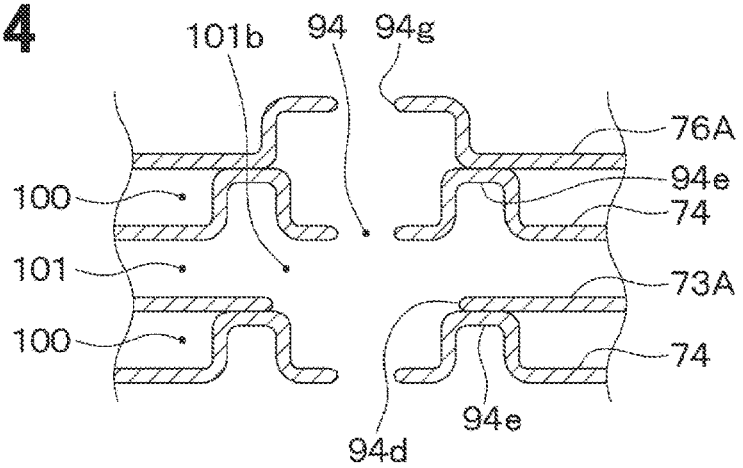
FIG. 64 is a cross-sectional view illustrating the refrigerant through-hole of the heat exchanger body in the heat exchanger according to the second embodiment.

As illustrated in FIG. 64, the through-hole forming portion 94*e* in the inner plate 74 is joined to the second partition outer plate 76A by brazing. Hence the refrigerant through-hole 94 and the cooling water flow path 100 are separated from each other.

Figure 65:
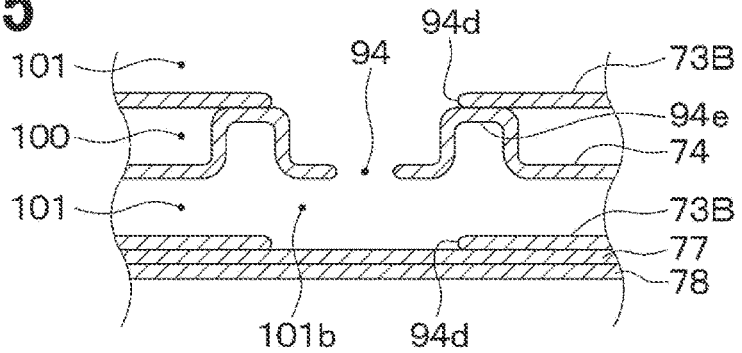
FIG. 65 is a cross-sectional view illustrating the refrigerant through-hole of the heat exchanger body in the heat exchanger according to the second embodiment.

As illustrated in FIG. 65, the through-hole forming portion 94*d* in the second outer plate 73B forms a refrigerant discharge port 101*b* together with the inner plate 74. The refrigerant discharge port 101*b* discharges the refrigerant from the refrigerant flow path 101 to the refrigerant through-hole 94.

The through-hole forming portion 94*e* in the inner plate 74 is joined to the second outer plate 73B by brazing. Hence the refrigerant through-hole 94 and the cooling water flow path 100 are separated from each other.

In this manner, the refrigerant through-hole 94 and the plurality of cooling water flow paths 100 are separated from each other. The refrigerant through-hole 94 communicates with the plurality of refrigerant flow paths 101. The other side in the second direction D2 of the refrigerant through-hole 94 (e.g., the lower side in FIG. 65) is closed by the bottom plate 77.

As in the first embodiment, the cooling water through-hole 96 communicates with the plurality of cooling water flow paths 100 between the second partition outer plate 76A and the bottom plate 77 via the cooling water inlet 100*a*.

As in the first embodiment, the cooling water through-hole 95 communicates with the plurality of cooling water flow paths 100 between the second partition outer plate 76A and the bottom plate 77 via the cooling water outlet 100*b*.

In the present embodiment as described above, the first outer plate 72, the second outer plate 73B, the first partition outer plate 75, and the second partition outer plate 76A have a common outer shape.

As described above, the first outer plate 72 includes the through-hole forming portions 90*c*, 91*c*, 94*c*, 95*c*, 96*c*, 97*c*. As described above, the second outer plate 73B includes the through-hole forming portions 90*d*, 91*d*, 92*d*, 95*d*, 96*d*. As described above, the first partition outer plate 75 includes the through-hole forming portions 91*f*, 94*f*, 95*f*, 96*f*. The second partition outer plate 76A includes through-hole forming portions 90*g*, 92*g*, 94*g*, 95*g*, 96*g*.

Hereinafter, the first outer plate 72, the second outer plate 73B, the first partition outer plate 75, and the second partition outer plate 76A are collectively referred to as outer plates 72, 73B, 75, 76A.

The through-hole forming portions 90*c*, 91*c*, 94*c*, 95*c*, 96*c*, 97*c* are referred to as through-hole forming portions 90*c* to 97*c*. The through-hole forming portions 90*c* to 97*c*, the through-hole forming portions 91*f*, 94*f*, 95*f*, 96*f*, and the through-hole forming portions 90*g*, 92*g*, 94*g*, 95*g*, 96*g* are referred to as through-hole forming portions 90*c* to 96*g*.

The first outer plate 72, the second outer plate 73B, the first partition outer plate 75, and the second partition outer plate 76A are of different types by including different combinations of through-hole forming portions among the through-hole forming portions 90*g* to 96*g*.

Next, the operation of the heat exchanger 1 of the present embodiment will be described.

First, cooling water flows into the cooling water through-hole 96 through the cooling water connector 40*a* and the cooling water inlet 112. The cooling water flowing through the cooling water through-hole 96 is diverted into the plurality of cooling water flow paths 100 between the top plate 70 and the bracket 78. The cooling water thus diverted into the plurality of cooling water flow paths 100 is collected in the cooling water through-hole 95 and discharged through the cooling water outlet 113 and the cooling water connector 40*b*.

On the other hand, the high-pressure refrigerant discharged from the compressor flows into the refrigerant through-hole 90 through the refrigerant connector 30*a* and the refrigerant inlet 110. The high-pressure refrigerant flowing through the refrigerant through-hole 90 is diverted into the plurality of refrigerant flow paths 101 between the top outer plate 71 and the first partition outer plate 75. The high-pressure refrigerant thus diverted into the plurality of refrigerant flow paths 101 is collected in the refrigerant through-holes 91.

At this time, the high-pressure refrigerant in the plurality of refrigerant flow paths 101 between the top outer plate 71 and the first partition outer plate 75 radiates heat to the cooling water in the cooling water flow path 100.

Thereafter, the refrigerant is diverted from the refrigerant through-hole 91 to the plurality of refrigerant flow paths 101 between the first partition outer plate 75 and the second partition outer plate 76A. The high-pressure refrigerant thus diverted into the plurality of refrigerant flow paths 101 is collected in the refrigerant through-holes 92.

At this time, the high-pressure refrigerant in the plurality of refrigerant flow paths 101 between the first partition outer plate 75 and the second partition outer plate 76A radiates heat to the cooling water in the cooling water flow path 100.

Thereafter, the high-pressure refrigerant having passed through the refrigerant through-hole 92 is diverted into the plurality of refrigerant flow paths 101 between the second partition outer plate 76A and the bottom plate 77. The high-pressure refrigerant thus diverted into the plurality of refrigerant flow paths 101 is collected in the refrigerant through-holes 94.

At this time, the high-pressure refrigerant in the plurality of refrigerant flow paths 101 between the second partition outer plate 76A and the bottom plate 77 radiates heat to the cooling water in the cooling water flow path 100. Thereafter, the refrigerant collected in the refrigerant through-hole 94 flows from the refrigerant through-hole 94 to the pressure reducing valve through the refrigerant outlet 111 and the refrigerant connector 30*b*.

Next, a method for manufacturing the heat exchanger 1 of the present embodiment will be described.

First, the top plate 70, the top outer plate 71, the plurality of first outer plates 72, the plurality of second outer plates 73B, the plurality of inner plates 74, the first partition outer plate 75, and the second partition outer plate 76A are prepared.

The bottom plate 77, the bracket 78, the plurality of cooling water fins 79, and the plurality of refrigerant fins 80 are prepared in the plate stack 10.

In the next step, the top plate 70, the top outer plate 71, . . . , the bracket 78, the plurality of cooling water fins 79, and the plurality of refrigerant fins 80 prepared as above are stacked and fixed temporarily. As a result, a temporarily fixed plate stack is molded.

In the next step, the gas-liquid separator 20, the refrigerant connectors 30*a*, 30*b*, the cooling water connectors 40*a*, 40*b*, and the receiver connector 50 are assembled to the temporarily fixed plate stack as thus described.

Next, the temporarily fixed plate stack, the gas-liquid separator 20, the refrigerant connectors 30*a*, 30*b*, the cooling water connectors 40*a*, 40*b*, and the receiver connector 50 thus assembled are integrated by brazing in a high-temperature furnace. As a result, the manufacture of the heat exchanger 1 is completed.

According to the present embodiment described above, the heat exchanger 1 of the present embodiment includes the plate stack 10 and the gas-liquid separator 20. The plate stack 10 is formed with a refrigerant inlet 110 and a refrigerant outlet 111. The refrigerant inlet 110 and the refrigerant outlet 111 are disposed on one side in the second direction D2 with respect to the condensing portion 10A (e.g., the upper side in FIG. 58).

Thereby, as in the first embodiment, it is possible to reduce the number of assembling steps at the time of mounting the heat exchanger 1 on the vehicle. Further, it is possible to improve the mountability of the heat exchanger 1 on the vehicle. In the present embodiment, the cooling water inlet 112 and the cooling water outlet 113 are disposed on one side in the second direction D2 with respect to the condensing portion 10A (e.g., the upper side in FIG. 59). This can facilitate performing the step of connecting the cooling water pipe to each of the cooling water inlet 112 and the cooling water outlet 113.

The condensing portion 10A includes the refrigerant flow path 101 between the first outer plate 72 and the inner plate 74, the refrigerant flow path 101 between the second outer plate 73 and the inner plate 74, and the refrigerant flow path 101 between the second outer plate 73B and the inner plate 74.

The refrigerant flow path 101 between the first outer plate 72 and the inner plate 74 is defined as an upper refrigerant flow path 101. The refrigerant flow path 101 between the second outer plate 73 and the inner plate 74 is defined as an intermediate refrigerant flow path 101. The refrigerant flow path 101 between the second outer plate 73B and the inner plate 74 is defined as a lower refrigerant flow path 101.

Thus, in the condensing portion 10A, the refrigerant from the upper refrigerant flow path 101 flows into the lower refrigerant flow path 101 after passing through the intermediate refrigerant flow path 101. At this time, when the refrigerant flows through the upper refrigerant flow path 101, the intermediate refrigerant flow path 101, and the lower refrigerant flow path 101, the refrigerant radiates heat to the cooling water in the cooling water flow path 100. Therefore, the refrigerant can be discharged after being sufficiently cooled in the condensing portion 10A.

Third Embodiment

In the first embodiment, the refrigerant flow path 101 through which the refrigerant is allowed to flow on one side in the first direction D1 and the refrigerant flow path 101 through which the refrigerant is allowed to flow on the other side in the first direction D1 are formed in the condensing portion 10A.

Figure 66:
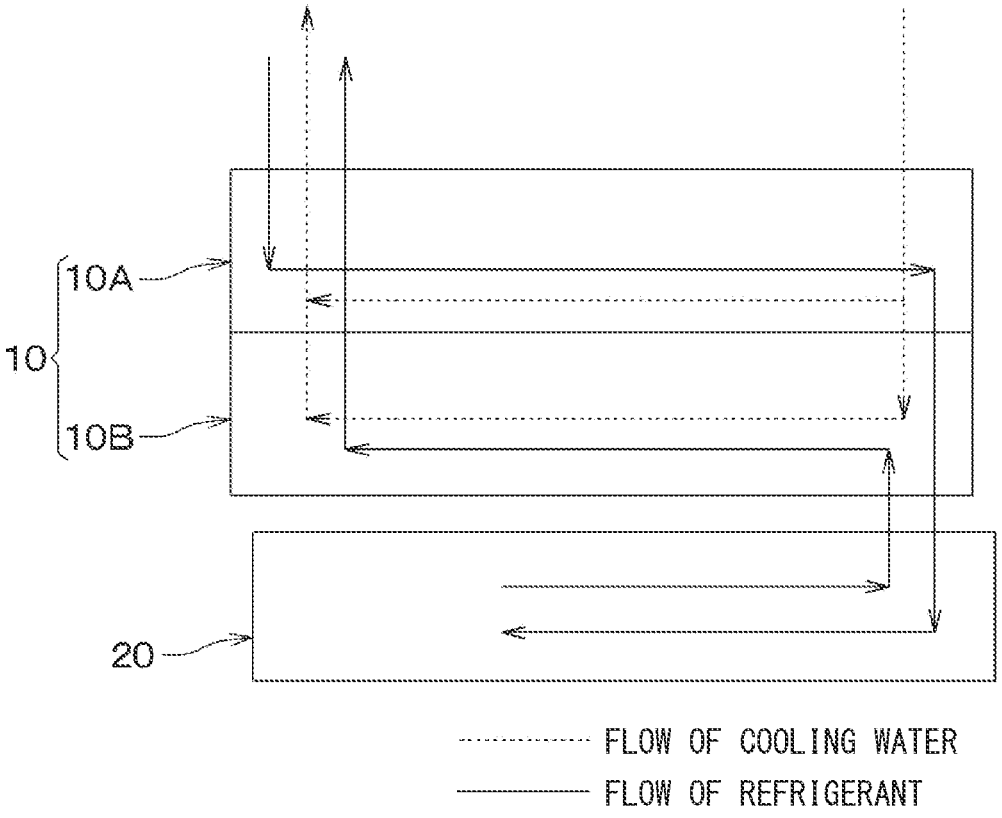
FIG. 66 is a perspective view illustrating an overall configuration of a heat exchanger according to a third embodiment.
Figure 67:
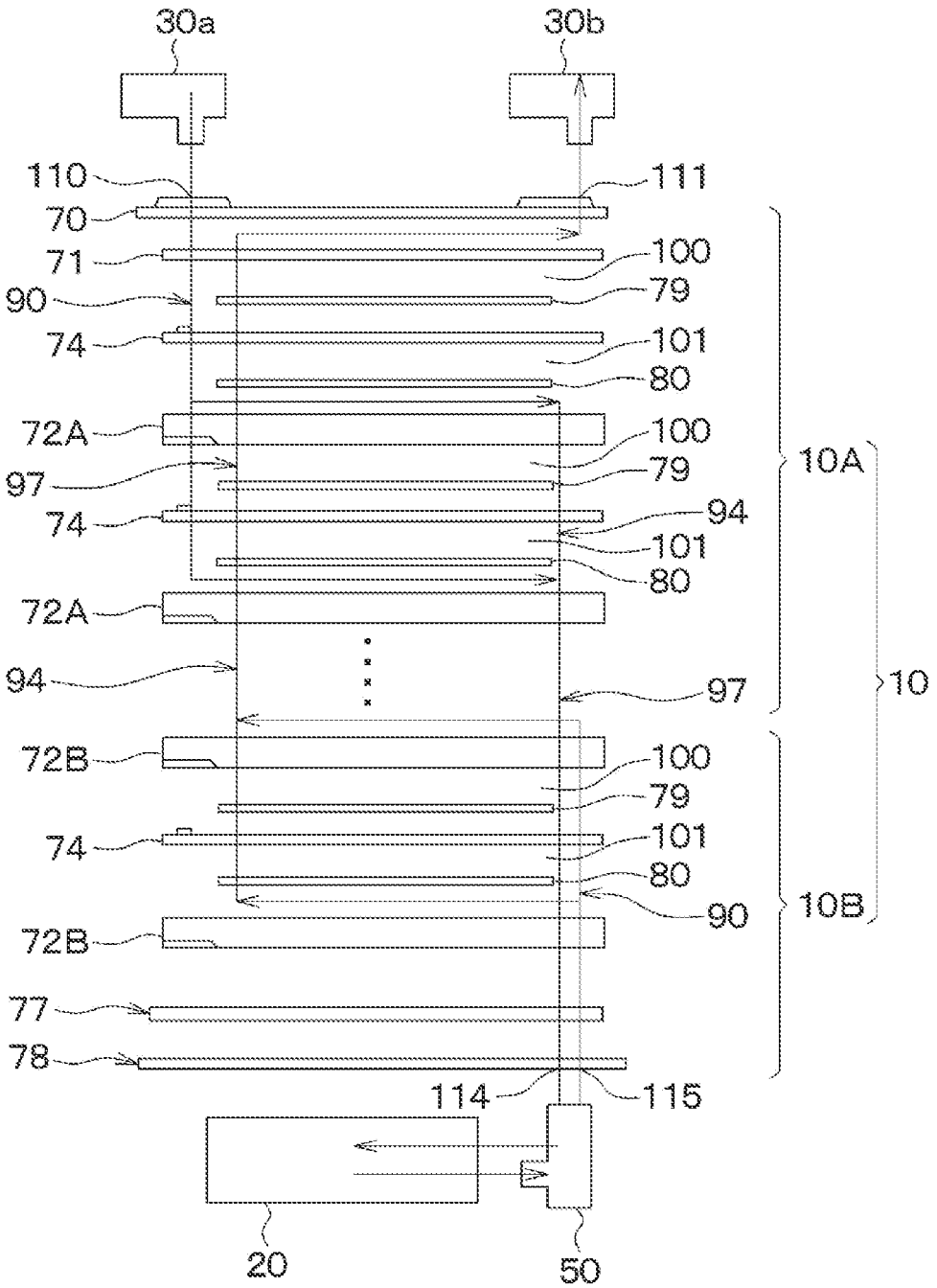
FIG. 67 is a view illustrating a placement relationship between a top plate, a top outer plate, first outer plates, inner plates, reverse first outer plates, and the like constituting the heat exchanger of FIG. 66 and refrigerant through-holes.
Figure 68:
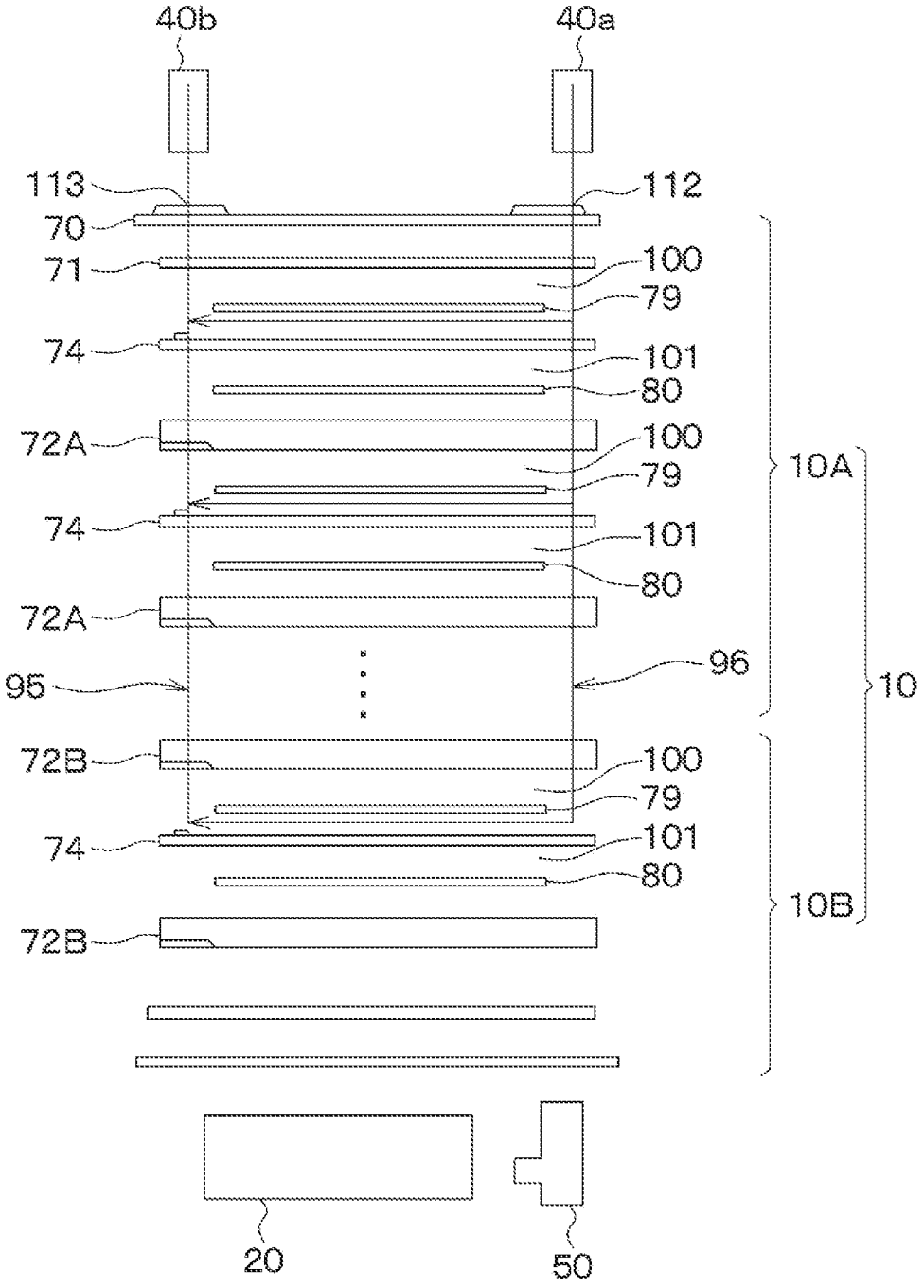
FIG. 68 is a view illustrating a placement relationship between the top plate, the top outer plate, the first outer plates, the inner plates, the reverse first outer plates, and the like constituting the heat exchanger of FIG. 66 and cooling water through-holes.

The present third embodiment will be described with reference to FIGS. 66 to 68 in which the refrigerant flow path 101 that allows the refrigerant to flow on the other side in the first direction D1 is deleted, and the condensing portion 10A includes the refrigerant flow path 101 that allows the refrigerant to flow on the one side in the first direction D1. In FIGS. 66 to 68, the same reference numerals as those in FIGS. 1 to 4 denote the same components, and the description thereof will be omitted.

As illustrated in FIGS. 66 to 68, the heat exchanger 1 of the present embodiment includes a plate stack 10, a gas-liquid separator 20, refrigerant connectors 30*a*, 30*b*, cooling water connectors 40*a*, 40*b*, and a receiver connector 50. The plate stack 10 includes a condensing portion 10A and a subcooling portion 10B.

The heat exchanger 1 of the present embodiment is different from the heat exchanger 1 of the first embodiment in the configuration of the plate stack 10. Therefore, the configuration of the plate stack 10 will be mainly described below.

That is, the condensing portion 10A of the heat exchanger 1 of the present embodiment includes a top plate 70, a top outer plate 71, a plurality of first outer plates 72A, a plurality of inner plates 74, a plurality of cooling water fins 79, and a plurality of refrigerant fins 80.

The plates 71, 74, 72A are arranged in the order of the top outer plate 71, the inner plate 74, the first outer plate 72A, the inner plate 74, the first outer plate 72A, . . . , on the other side in the second direction D2 of the condensing portion 10A with respect to the top plate 70.

Here, the other side in the second direction D2 corresponds to, for example, the lower side in FIG. 67.

The plates 71, 74, 72A collectively represent the top outer plate 71, the inner plates 74, and the first outer plates 72A.

Thus, on the other side in the second direction D2 with respect to the top outer plate 71 in the condensing portion 10A (e.g., the lower side in FIG. 67), one first outer plate 72A and one inner plate 74 are alternately arranged on the other side in the second direction D2.

Thereby, on the other side in the second direction D2 with respect to the top outer plate 71 in the condensing portion 10A, one cooling water flow path 100 and one refrigerant flow path 101 are alternately arranged on the other side in the second direction D2.

Figure 69:
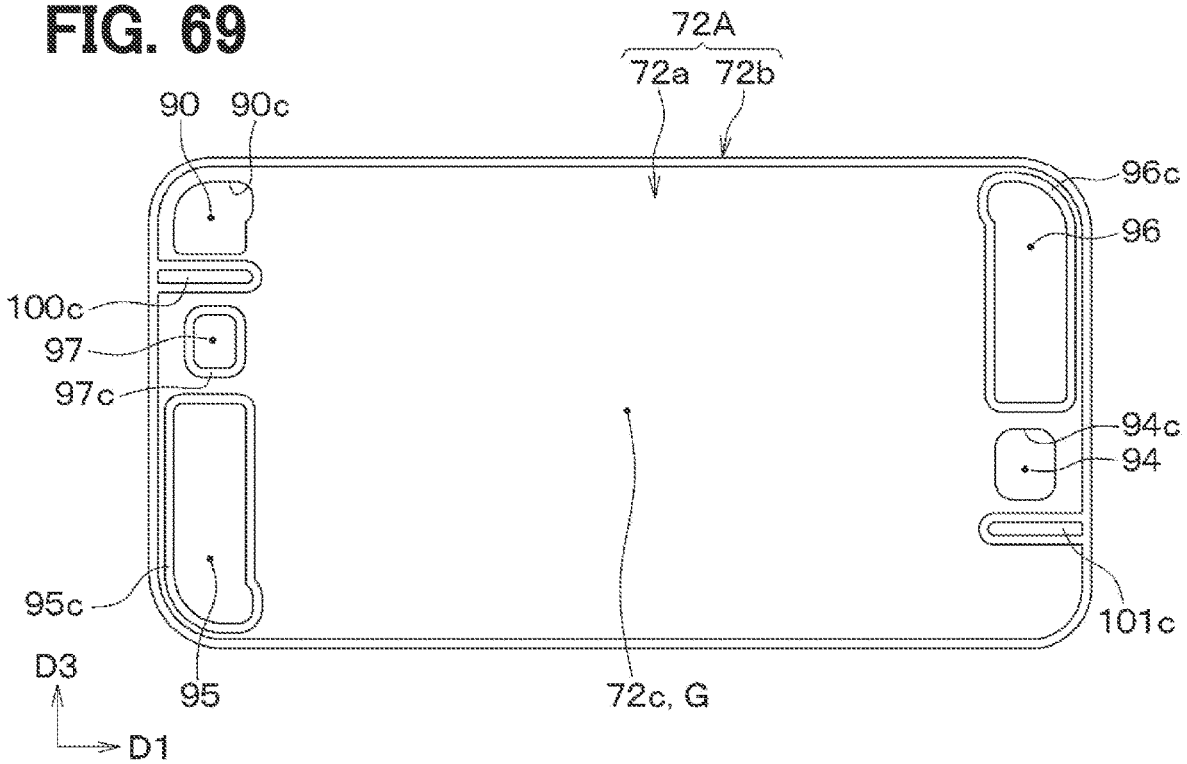
FIG. 69 is a view of the first outer plate in FIG. 67 as viewed from the one side in the second direction.

In the present embodiment, the first outer plate 72A of FIG. 69 is obtained by removing the through-hole forming portion 91*c* from the first outer plate 72 of FIG. 7. In the condensing portion 10A configured as described above, refrigerant through-holes 90, 94, 97 and cooling water through-holes 95, 96 are configured.

The subcooling portion 10B of FIG. 67 is provided with a plurality of reverse first outer plates 72B, a plurality of inner plates 74, a bottom plate 77, and a bracket 78.

Figure 70:
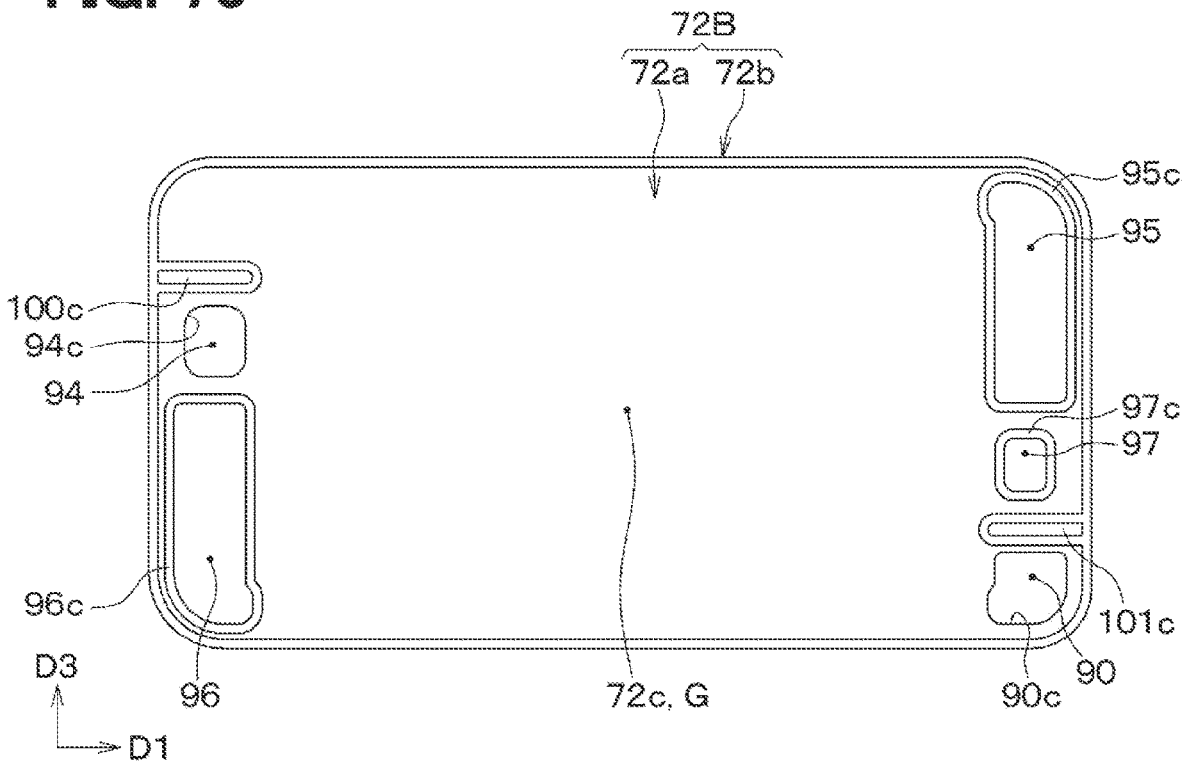
FIG. 70 is a view of the reverse first partition outer plate in FIG. 67 as viewed from the one side in the second direction.
Figure 71:
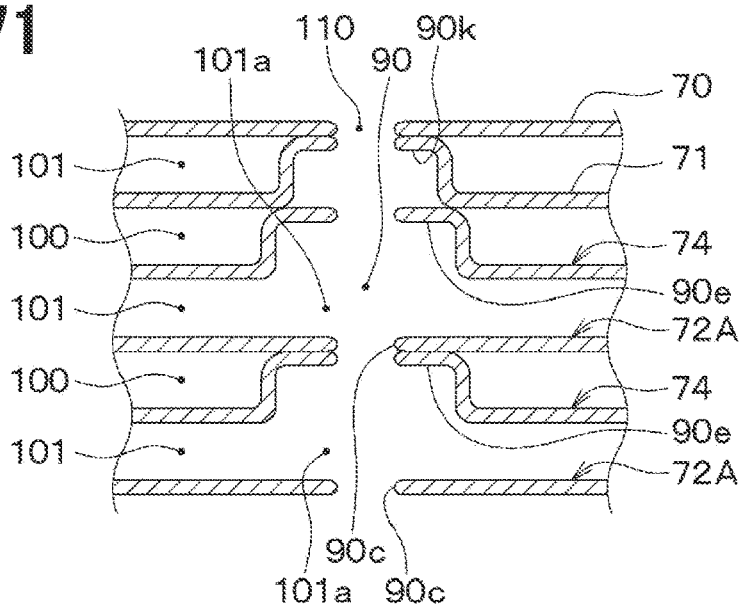
FIG. 71 is a cross-sectional view illustrating a refrigerant through-hole of a heat exchanger body in a heat exchanger according to the third embodiment.

Here, the reverse first outer plate 72B of FIG. 70 and the first outer plate 72A of FIG. 69 are each formed of a common plate. Specifically, the reverse first outer plate 72B and the first outer plate 72A are formed to be point-symmetric with each other about an axis G.

As illustrated in FIGS. 69 and 70, the axis G is an imaginary line passing through the center in the direction of the plane including the first direction D1 and the third direction D3 (i.e., bottom 72*a*) in the second direction D2 in the reverse first outer plate 72B or the first outer plate 72A. The reverse first outer plate 72B is a plate rotated by 180 degrees about the center point in the first outer plate 72A.

Therefore, through-hole forming portions 94*c*, 96*c* disposed on the other side in the third direction D3 in the first outer plate 72A are disposed on one side in the third direction D3 in the reverse first outer plate 72B.

Through-hole forming portions 90*c*, 97*c*, 95*c* disposed on one side in the third direction D3 of the first outer plate 72A are disposed on the other side in the third direction D3 of the reverse first outer plate 72B.

On the other side in the second direction D2 with respect to the bottom plate 77 and the bracket 78 in the subcooling portion 10B of FIG. 67, one reverse first outer plate 72B and one inner plate 74 are alternately arranged on the other side in the second direction D2 (e.g., the lower side in FIG. 67).

Thereby, on the other side in the second direction D2 with respect to the bottom plate 77 and the bracket 78 in the subcooling portion 10B, one cooling water flow path 100 and one refrigerant flow path 101 are alternately arranged on the other side in the second direction D2.

The heat exchanger 1 thus configured includes the cooling water through-holes 90, 94, 97 and the cooling water through-holes 95, 96.

Next, the condensing portion 10A and the subcooling portion 10B of the present embodiment will be described with reference to FIGS. 71 to 76.

First, the refrigerant flow path 101 is formed between the top plate 70 and the top outer plate 71 of the condensing portion 10A. A through-hole forming portion 90*k* forming the refrigerant through-hole 90 in the top outer plate 71 is joined to the top plate 70 by brazing.

Hence the refrigerant flow path 101 between the top plate 70 and the top outer plate 71 and the refrigerant through-hole 90 are separated.

A through-hole forming portion 90*e* forming the refrigerant through-hole 90 in the inner plate 74 is joined to the top outer plate 71 by brazing.

Hence the cooling water flow path 100 and the refrigerant through-hole 90 between the inner plate 74 and the top outer plate 71 are separated.

The through-hole forming portion 90*c* forming the refrigerant through-hole 90 in the first outer plate 72A forms the refrigerant introduction port 101*a* together with the inner plate 74. The refrigerant introduction port 101*a* is provided to guide the refrigerant from the refrigerant through-hole 90 to the refrigerant flow path 101.

Figure 72:
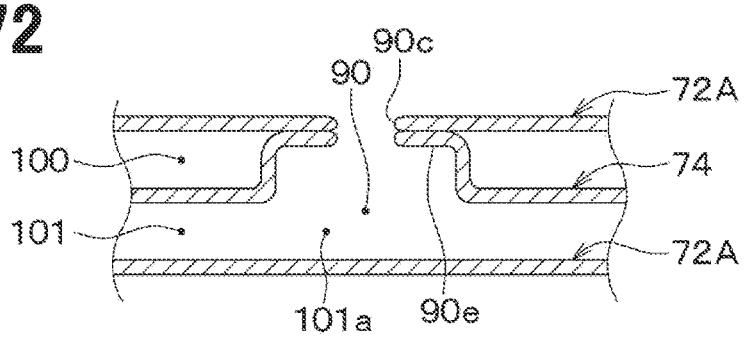
FIG. 72 is a cross-sectional view illustrating the refrigerant through-hole of the heat exchanger body in the heat exchanger according to the third embodiment.

However, as illustrated in FIG. 72, the refrigerant through-hole 90 of the first outer plate 72A disposed closest to the other side in the second direction D2 in the condensing portion 10A is closed.

Figure 73:
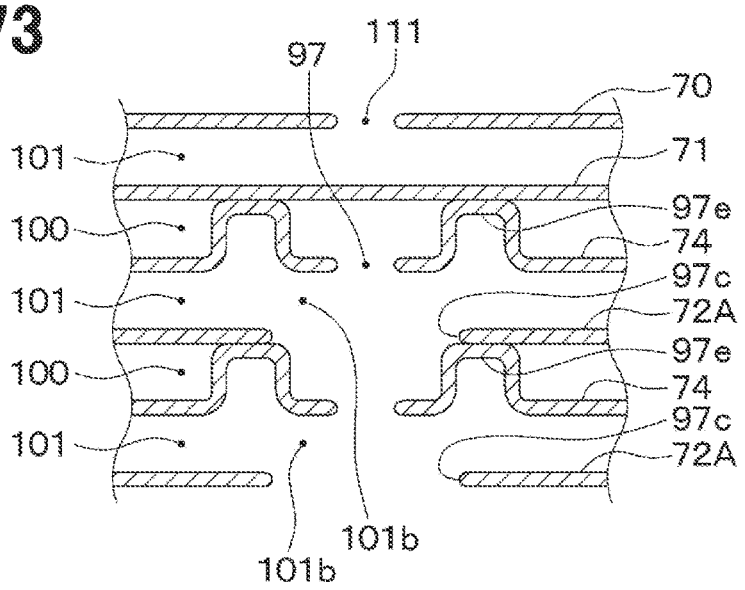
FIG. 73 is a cross-sectional view illustrating the refrigerant through-hole of the heat exchanger body in the heat exchanger according to the third embodiment.

As illustrated in FIG. 73, a through-hole forming portion 97*e* forming the refrigerant through-hole 97 in the inner plate 74 is joined to the top outer plate 71 by brazing.

Hence the cooling water flow path 100 and the refrigerant through-hole 97 between the inner plate 74 and the top outer plate 71 are separated.

The through-hole forming portion 97*c* forming the refrigerant through-hole 97 in the first outer plate 72A forms the refrigerant discharge port 101*b* together with the inner plate 74. The refrigerant discharge port 101*b* discharges the refrigerant from the refrigerant flow path 101 to the refrigerant through-hole 97.

The through-hole forming portion 97*e* forming the refrigerant through-hole 97 in the inner plate 74 is joined to the first outer plate 72A by brazing. Hence the refrigerant through-hole 97 and the cooling water flow path 100 are separated from each other.

The refrigerant through-hole 97 of the condensing portion 10A configured as described above communicates with the refrigerant through-hole 97 of the subcooling portion 10B. The refrigerant through-hole 97 communicates with the discharge port 114 of the bracket 78.

Figure 74:
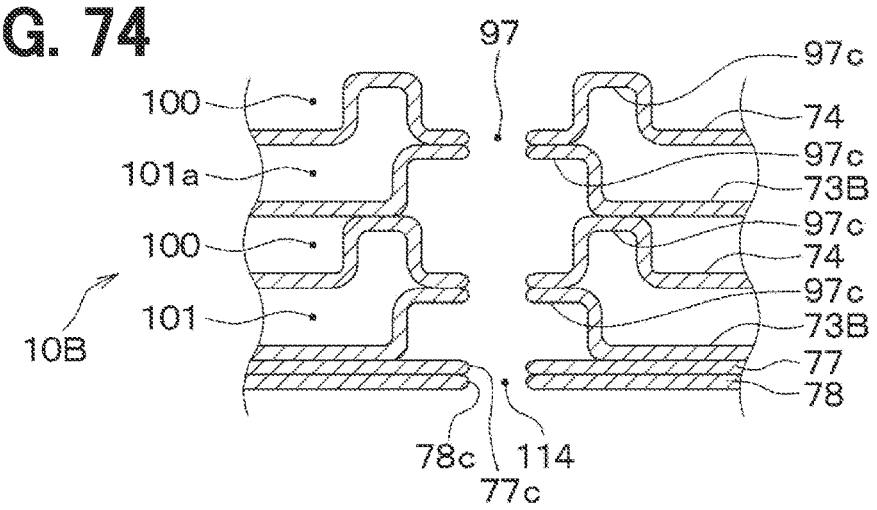
FIG. 74 is a cross-sectional view illustrating the refrigerant through-hole of the heat exchanger body in the heat exchanger according to the third embodiment.

In the subcooling portion 10B illustrated in FIG. 74, the through-hole forming portion 97*c* forming the refrigerant through-hole 97 in the reverse second outer plate 73B is joined to the inner plate 74 by brazing.

Hence the refrigerant flow path 101 between the reverse second outer plate 73B and the inner plate 74 and the refrigerant through-hole 97 are separated.

In the inner plate 74, the through-hole forming portion 97*c* forming the refrigerant through-hole 97 is joined to the reverse second outer plate 73B by brazing. Hence the cooling water flow path 100 and the refrigerant through-hole 97 between the inner plate 74 and the reverse second outer plate 73B are separated.

The other side in the second direction D2 (e.g., the lower side in FIG. 74) of the refrigerant through-hole 97 of the present embodiment passes through the bottom plate 77 and the bracket 78. The other side in the second direction D2 of the refrigerant through-hole 97 forms a discharge port 114.

Figure 75:
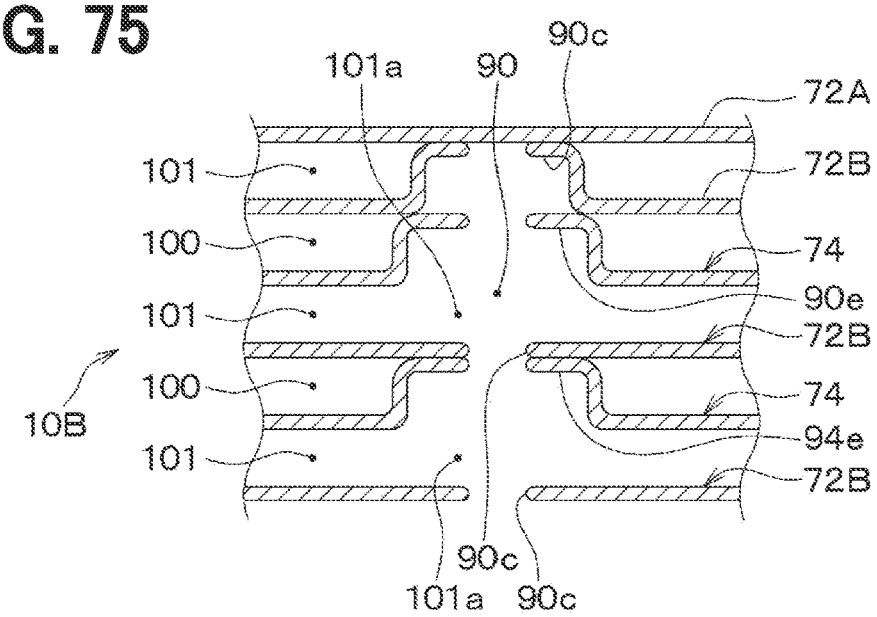
FIG. 75 is a cross-sectional view illustrating the refrigerant through-hole of the heat exchanger body in the heat exchanger according to the third embodiment.
Figure 76:
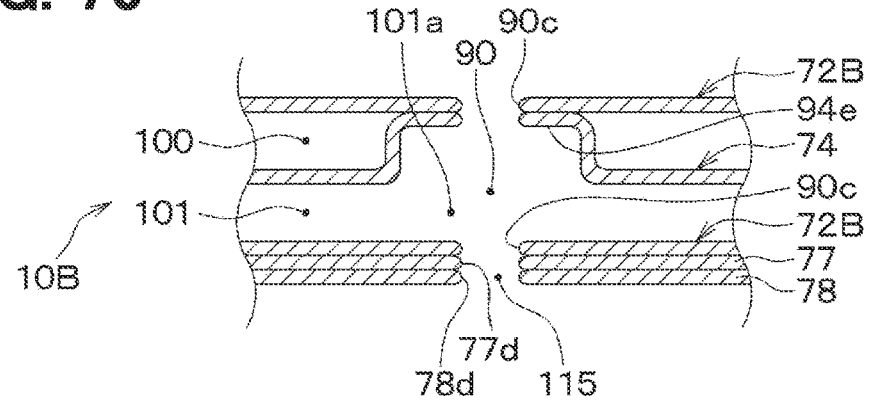
FIG. 76 is a cross-sectional view illustrating the refrigerant through-hole of the heat exchanger body in the heat exchanger according to the third embodiment.

In the subcooling portion 10B illustrated in FIGS. 75 and 76, the through-hole forming portion 90*c* forming the refrigerant through-hole 90 in the reverse first outer plate 72B is joined to the first outer plate 72A by brazing.

Hence the refrigerant flow path 101 and the refrigerant through-hole 90 between the first outer plate 72A and the reverse first outer plate 72B are separated.

The through-hole forming portion 90*c* forming the refrigerant through-hole 90 in the reverse first outer plate 72B forms the refrigerant introduction port 101*a* together with the inner plate 74. The refrigerant introduction port 101*a* is provided to guide the refrigerant from the refrigerant through-hole 90 to the refrigerant flow path 101.

A through-hole forming portion 94*e* forming the refrigerant through-hole 90 in the inner plate 74 is joined to the reverse first outer plate 72B by brazing. Hence the cooling water flow path 100 and the refrigerant through-hole 90 between the inner plate 74 and the reverse first outer plate 72B are separated.

As described above, the refrigerant through-hole 90 communicates with the plurality of refrigerant flow paths 101 of the subcooling portion 10B. The refrigerant through-hole 90 is separated from the plurality of cooling water flow paths 100 of the subcooling portion 10B.

Figure 77:
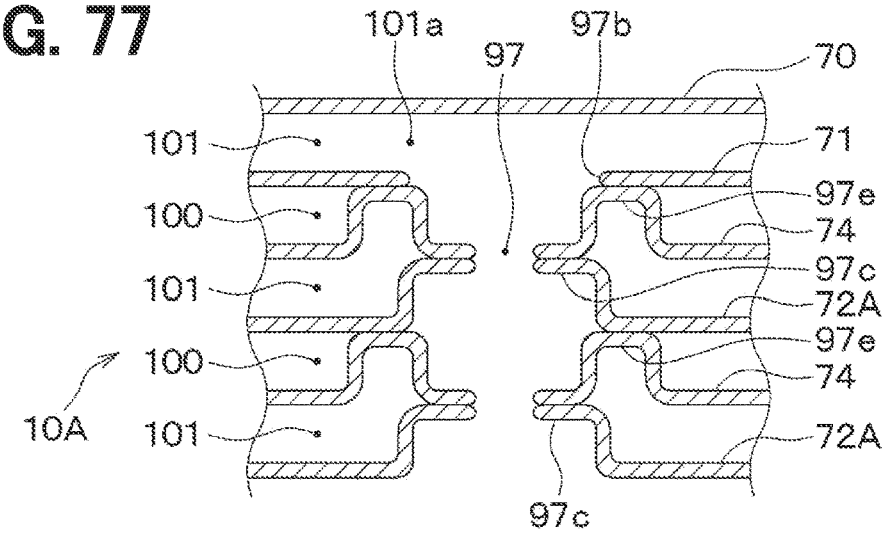
FIG. 77 is a cross-sectional view illustrating the refrigerant through-hole of the heat exchanger body in the heat exchanger according to the third embodiment.

In the condensing portion 10A illustrated in FIG. 77, the through-hole forming portion 97*e* forming the refrigerant through-hole 97 in the inner plate 74 is joined to the top outer plate 71 by brazing.

Hence the cooling water flow path 100 and the refrigerant through-hole 97 between the inner plate 74 and the top outer plate 71 are separated.

The through-hole forming portion 97*c* forming the refrigerant through-hole 97 in the first outer plate 72A is joined to the inner plate 74 by brazing. Hence the refrigerant flow path 101 between the inner plate 74 and the first outer plate 72A and the refrigerant through-hole 97 are separated.

The through-hole forming portion 97*e* forming the refrigerant through-hole 97 in the inner plate 74 is joined to the first outer plate 72A by brazing. Hence the cooling water flow path 100 and the refrigerant through-hole 97 between the inner plate 74 and the first outer plate 72A are separated.

In the condensing portion 10A, the refrigerant through-hole 97 is separated from the plurality of refrigerant flow paths 101. The refrigerant through-hole 97 is separated from the plurality of cooling water flow paths 100.

Figure 78:
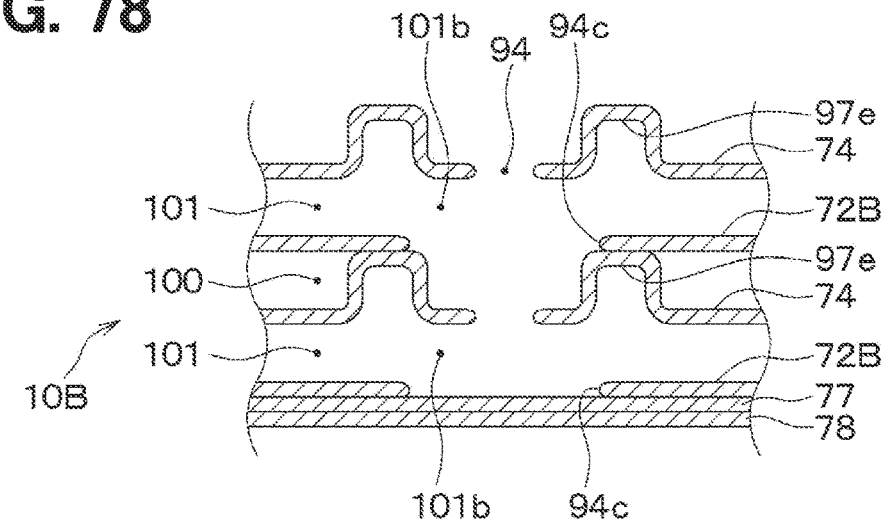
FIG. 78 is a cross-sectional view illustrating the refrigerant through-hole of the heat exchanger body in the heat exchanger according to the third embodiment.

In the subcooling portion 10B illustrated in FIG. 78, the through-hole forming portion 94*c* forming the refrigerant through-hole 97 in the reverse first outer plate 72B forms the refrigerant discharge port 101*b* together with the inner plate 74. The refrigerant discharge port 101*b* discharges the refrigerant from the refrigerant flow path 101 to the refrigerant through-hole 94.

The through-hole forming portion 94*e* forming the refrigerant through-hole 94 in the inner plate 74 is joined to the reverse first outer plate 72B by brazing. Hence the cooling water flow path 100 and the refrigerant through-hole 94 between the inner plate 74 and the reverse first outer plate 72B are separated.

The refrigerant through-hole 94 of the subcooling portion 10B and the refrigerant through-hole 97 of the condensing portion 10A of the present embodiment communicate with each other. The other side in the second direction D2 of the refrigerant through-hole 94 of the subcooling portion 10B (e.g., the lower side in FIG. 78) is closed by the bottom plate 77.

Next, the operation of the heat exchanger 1 of the present embodiment will be described.

First, cooling water flows into the cooling water through-hole 96 through the cooling water connector 40*a* and the cooling water inlet 112. The cooling water flowing through the cooling water through-hole 96 is diverted into the plurality of cooling water flow paths 100 between the top plate 70 and the bracket 78.

The cooling water thus diverted into the plurality of cooling water flow paths 100 is collected in the cooling water through-hole 95 and discharged through the cooling water outlet 113 and the cooling water connector 40*b*.

On the other hand, the high-pressure refrigerant discharged from the compressor flows into the refrigerant through-hole 90 through the refrigerant connector 30*a* and the refrigerant inlet 110. The high-pressure refrigerant flowing through the refrigerant through-hole 90 is diverted into the plurality of refrigerant flow paths 101 of the condensing portion 10A. The high-pressure refrigerant flowing through the plurality of refrigerant flow paths 101 is collected in the refrigerant through-holes 94.

At this time, the high-pressure refrigerant in the plurality of refrigerant flow paths 101 radiates heat to the cooling water in the cooling water flow path 100 of the condensing portion 10A.

Thereafter, the high-pressure refrigerant flows from the refrigerant through-hole 94 to the gas-liquid separator 20 through the refrigerant through-hole 97 of the subcooling portion 10B, the discharge port 114, and the receiver connector 50. The gas-liquid separator 20 separates the high-pressure refrigerant having passed through the refrigerant through-hole 92 into a gas-phase refrigerant and a liquid-phase refrigerant and discharges the liquid-phase refrigerant out of the gas-phase refrigerant and the liquid-phase refrigerant.

The liquid-phase refrigerant from the gas-liquid separator 20 flows into the refrigerant through-hole 90 of the subcooling portion 10B through the receiver connector 50 and the introduction port 115. The liquid-phase refrigerant in the refrigerant through-hole 90 is diverted into the plurality of refrigerant flow paths 101 of the subcooling portion 10B.

The liquid-phase refrigerant in the plurality of refrigerant flow paths 101 of the subcooling portion 10B is collected in the refrigerant through-holes 94. At this time, the liquid-phase refrigerant in the plurality of refrigerant flow paths 101 of the subcooling portion 10B radiates heat to the cooling water in the cooling water flow path 100 of the subcooling portion 10B. Thereby, the liquid-phase refrigerant in the plurality of refrigerant flow paths 101 is subcooled.

Thereafter, the liquid-phase refrigerant collected in the refrigerant through-hole 94 flows into the refrigerant through-hole 97 of the condensing portion 10A. Then, the liquid-phase refrigerant in the refrigerant through-hole 97 flows to the pressure reducing valve through the refrigerant flow path 101 between the inner plate 74 and the first outer plate 72A, a refrigerant outlet 111, and the refrigerant connector 30*b*.

According to the present embodiment described above, the heat exchanger 1 of the present embodiment includes the plate stack 10 and the gas-liquid separator 20. The plate stack 10 is formed with a refrigerant inlet 110 and a refrigerant outlet 111. The refrigerant inlet 110 and the refrigerant outlet 111 are disposed on one side in the second direction D2 with respect to the condensing portion 10A (e.g., the upper side in FIG. 68).

Thereby, as in the first embodiment, it is possible to reduce the number of assembling steps at the time of mounting the heat exchanger 1 on the vehicle. Further, it is possible to improve the mountability of the heat exchanger 1 on the vehicle.

In the present embodiment, the cooling water inlet 112 and the cooling water outlet 113 are disposed on one side in the second direction D2 with respect to the condensing portion 10A (e.g., the upper side in FIG. 67). This can facilitate performing the step of connecting the cooling water pipe to each of the cooling water inlet 112 and the cooling water outlet 113.

In the present embodiment, each of the reverse first outer plate 72B and the first outer plate 72A are formed of a common plate. Thus, each of the reverse first outer plate 72B and the first outer plate 72A can be manufactured using a common mold.

Therefore, the manufacturing cost can be reduced.

Fourth Embodiment

In the third embodiment, the example has been described where the heat exchanger 1 includes the gas-liquid separator 20, the condensing portion 10A, and the subcooling portion 10B.

However, instead of this, the present fourth embodiment in which the gas-liquid separator 20 and the subcooling portion 10B are deleted and the heat exchanger 1 is configured by the condensing portion 10A will be described with reference to FIGS. 79 to 87. In FIGS. 79 to 87, the same reference numerals as those in FIGS. 1 to 4 denote the same components, and the description thereof will be omitted.

Figure 79:
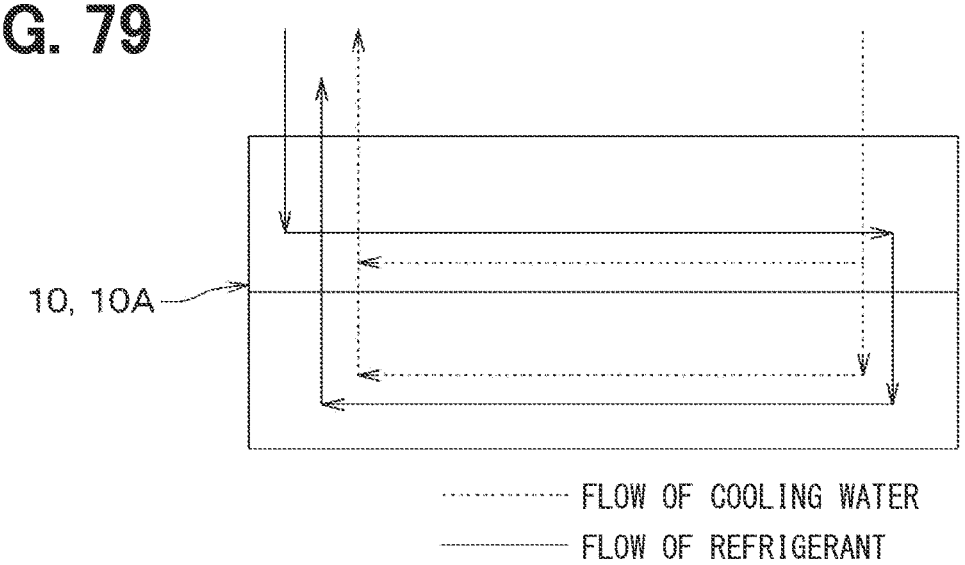
FIG. 79 is a perspective view illustrating an overall configuration of a heat exchanger according to a fourth embodiment.
Figure 80:
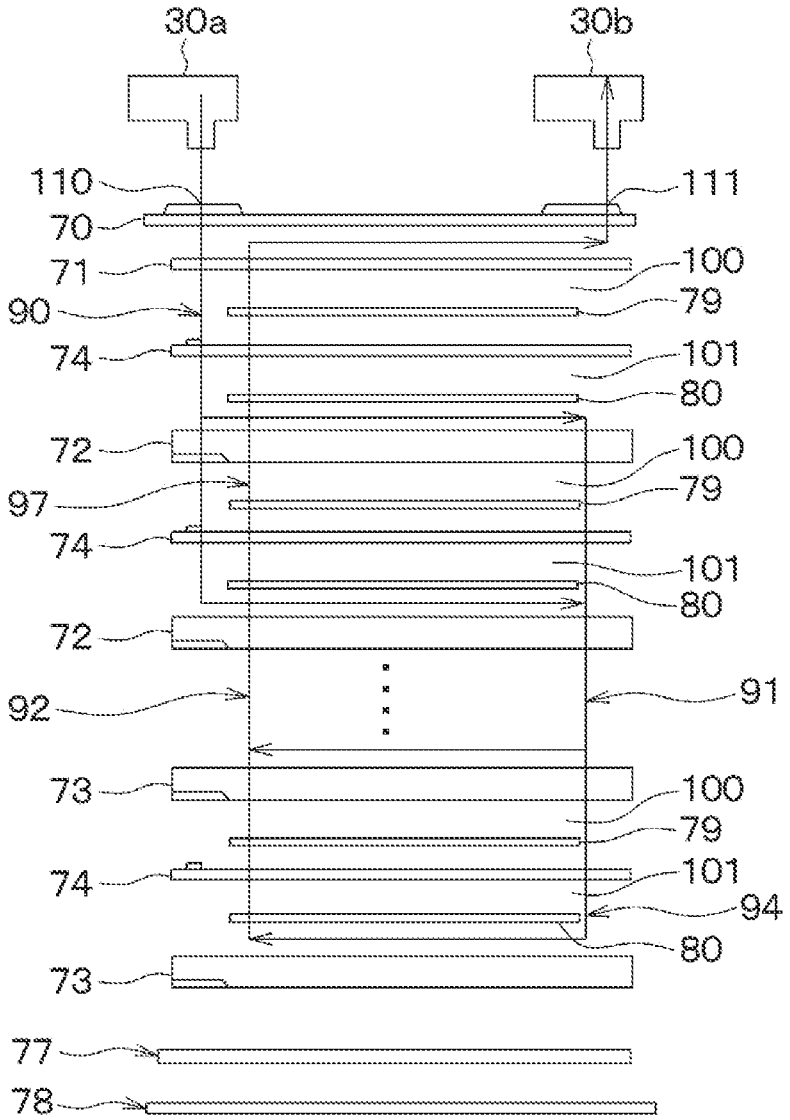
FIG. 80 is a view illustrating a relationship between a top plate, a top outer plate, first outer plates, inner plates, and second outer plates constituting the heat exchanger of FIG. 79 and refrigerant through-holes.
Figure 81:
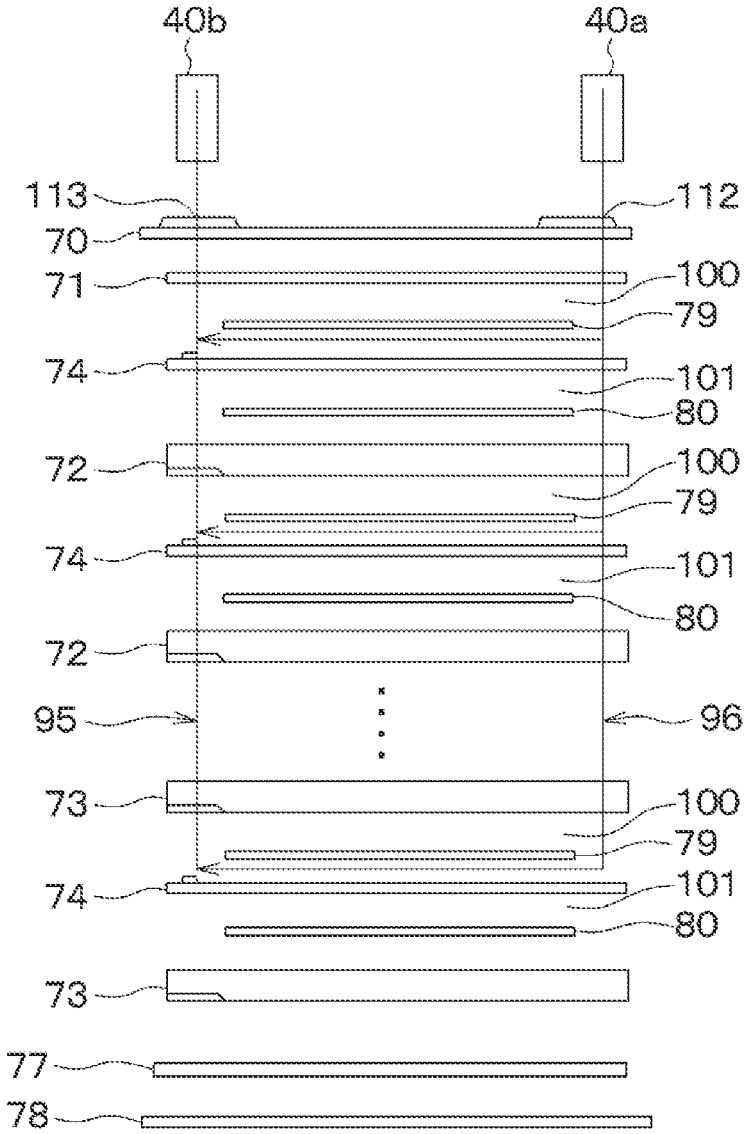
FIG. 81 is a view illustrating a relationship between the placement of the top plate, the top outer plate, the first outer plates, the inner plates, the second outer plates, and the like constituting the heat exchanger of FIG. 79 and the placement of cooling water through-holes.
Figure 82:
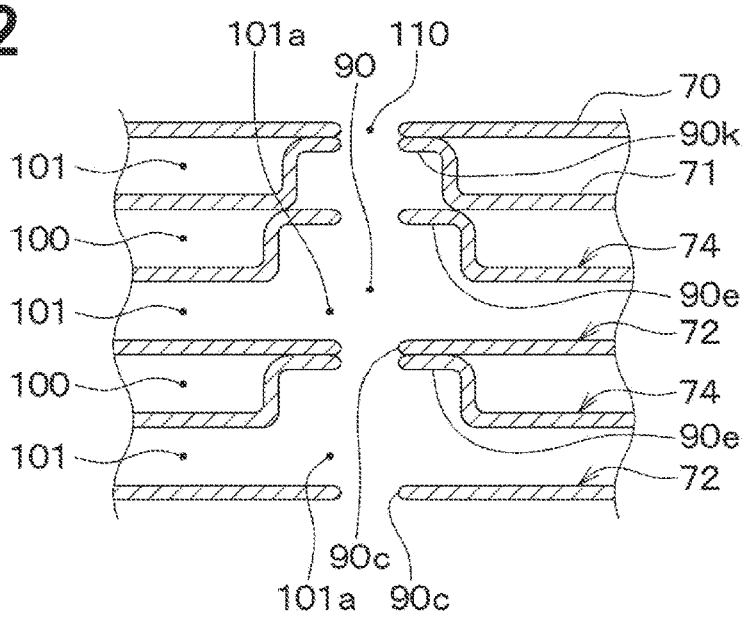
FIG. 82 is a cross-sectional view illustrating a refrigerant through-hole of a heat exchanger body in a heat exchanger according to the fourth embodiment.

As illustrated in FIGS. 79 to 81, the heat exchanger 1 of the present embodiment includes a plate stack 10, refrigerant connectors 30*a*, 30*b*, and cooling water connectors 40*a*, 40*b*. The plate stack 10 of the present embodiment is formed of the condensing portion 10A. As in the first embodiment, the refrigerant connectors 30*a*, 30*b* and the cooling water connectors 40*a*, 40*b* are disposed on one side in the second direction D2 with respect to the condensing portion 10A (e.g., the upper side in FIG. 80).

The plate stack 10 includes a top plate 70, a top outer plate 71, a plurality of first outer plates 72, a plurality of second outer plates 73, and a plurality of inner plates 74.

In addition, the plate stack 10 is provided with a bottom plate 77, a bracket 78, a plurality of cooling water fins 79, and a plurality of the refrigerant fins 80.

The plate stack 10 is provided with refrigerant through-holes 90, 91, 92, 97 and cooling water through-holes 95, 96. The refrigerant through-holes 90, 91, 92, 97 and the cooling water through-holes 95, 96 are formed in the plate stack 10 over the second direction D2.

On the other side in the second direction D2 with respect to the top plate 70 and the top outer plate 71 in the plate stack 10 of FIG. 80 (the lower side in FIG. 80), the plurality of first outer plates 72 and the plurality of inner plates 74 are alternately arranged one by one on the other side in the second direction D2.

Between the plurality of first outer plates 72, the plurality of inner plates 74 and the bottom plate 77, and the bracket 78 in the plate stack 10, the plurality of second outer plates 73 and the plurality of inner plates 74 are alternately arranged one by one on the other side in the second direction D2.

A refrigerant flow path 101 is formed between the top plate 70 and the top outer plate 71 of the plate stack 10. The top plate 70 has a refrigerant inlet 110 communicating with the refrigerant flow path 101. A through-hole forming portion 90*k* forming the refrigerant through-hole 90 in the top outer plate 71 is joined to the top plate 70 by brazing.

Hence the refrigerant flow path 101 between the top plate 70 and the top outer plate 71 and the refrigerant through-hole 90 are separated.

A through-hole forming portion 90*e* forming the refrigerant through-hole 90 in the inner plate 74 is joined to the top outer plate 71 by brazing. Hence the cooling water flow path 100 and the refrigerant through-hole 90 between the inner plate 74 and the top outer plate 71 are separated.

A through-hole forming portion 90*c* forming the refrigerant through-hole 90 in the first outer plate 72 forms a refrigerant introduction port 101*a* together with the inner plate 74. The refrigerant introduction port 101*a* is provided to guide the refrigerant from the refrigerant through-hole 90 to the refrigerant flow path 101 between the first outer plate 72 and the inner plate 74.

Figure 83:
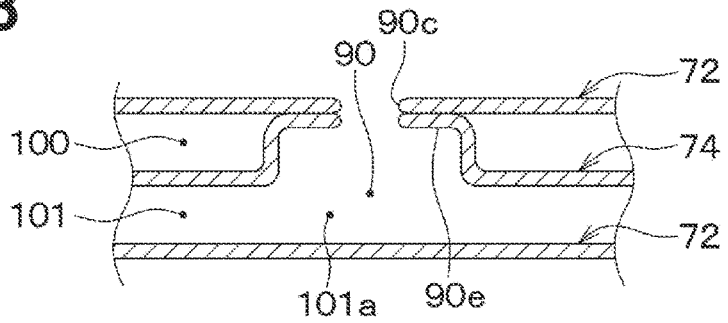
FIG. 83 is a cross-sectional view illustrating the refrigerant through-hole of the heat exchanger body in the heat exchanger according to the fourth embodiment.

However, as illustrated in FIG. 83, the refrigerant through-hole 90 of the first outer plate 72A disposed closest to the other side in the second direction D2 of the plate stack 10 (e.g., the lower side in FIG. 83) is closed.

Figure 84:
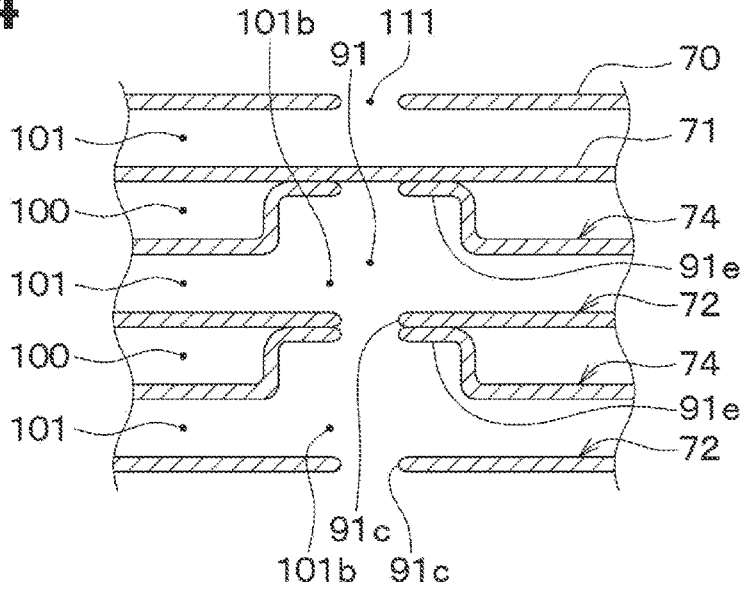
FIG. 84 is a cross-sectional view illustrating the refrigerant through-hole of the heat exchanger body in the heat exchanger according to the fourth embodiment.

As illustrated in FIG. 84, a through-hole forming portion 91*e* forming the refrigerant through-hole 91 in the inner plate 74 is joined to the top outer plate 71 by brazing. Hence the cooling water flow path 100 and the refrigerant through-hole 91 between the inner plate 74 and the top outer plate 71 are separated.

The through-hole forming portion 91*e* forming the refrigerant through-hole 91 in the inner plate 74 is joined to the first outer plate 72 by brazing. Hence the cooling water flow path 100 and the refrigerant through-hole 91 between the inner plate 74 and the first outer plate 72 are separated.

A through-hole forming portion 91*c* forming the refrigerant through-hole 91 in the first outer plate 72 forms a refrigerant discharge port 101*b* together with the inner plate 74. The refrigerant discharge port 101*b* discharges the refrigerant from the refrigerant flow path 101 between the first outer plate 72 and the inner plate 74 to the refrigerant through-hole 91.

Hence the refrigerant flow path 101 between the top plate 70 and the top outer plate 71 and the refrigerant through-hole 91 are separated. The refrigerant through-hole 91 is closed by the top outer plate 71.

Such a refrigerant through-hole 91 communicates with the plurality of refrigerant flow paths 101. The refrigerant through-hole 91 is separated from the plurality of cooling water flow paths 100.

Figure 85:
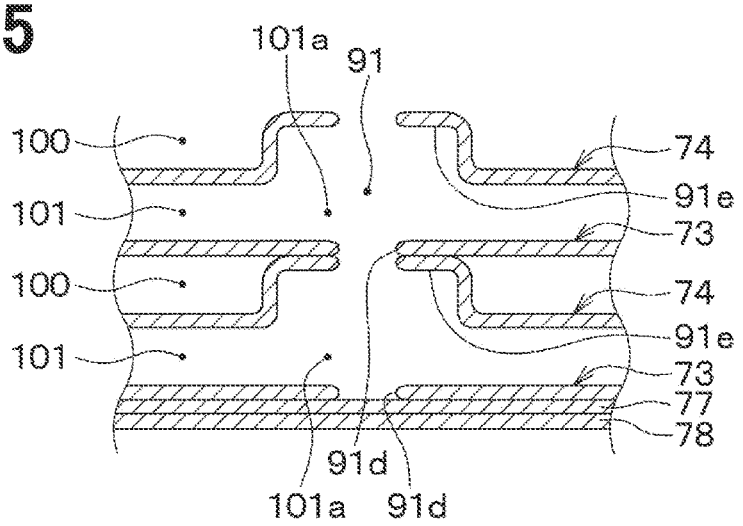
FIG. 85 is a cross-sectional view illustrating the refrigerant through-hole of the heat exchanger body in the heat exchanger according to the fourth embodiment.

As illustrated in FIG. 85, the through-hole forming portion 91*d* forming the refrigerant through-hole 91 in the second outer plate 73 forms the refrigerant introduction port 101*a* together with the inner plate 74. The refrigerant introduction port 101*a* is provided to guide the refrigerant from the refrigerant through-hole 91 to the refrigerant flow path 101.

A through-hole forming portion 91*d* forming the refrigerant through-hole 91 in the inner plate 74 is joined to the second outer plate 73 by brazing. Hence the cooling water flow path 100 and the refrigerant through-hole 91 between the second outer plate 73 and the inner plate 74 are separated.

Here, the refrigerant through-hole 90 of the second outer plate 73 disposed on the other side (the lower side in FIG. 85) in the second direction D2 of the plate stack 10 is closed by the bottom plate 77.

Figure 86:
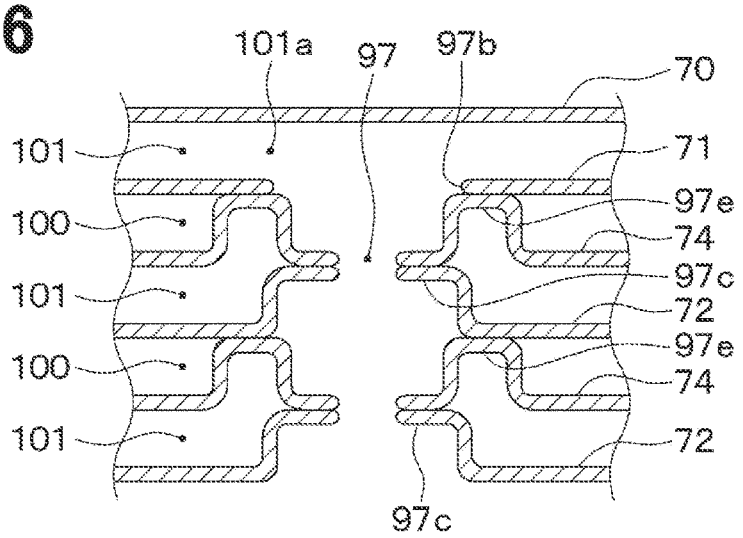
FIG. 86 is a cross-sectional view illustrating the refrigerant through-hole of the heat exchanger body in the heat exchanger according to the fourth embodiment.

As illustrated in FIG. 86, a through-hole forming portion 97*c* forming the refrigerant through-hole 97 in the inner plate 74 is joined to the top outer plate 71 by brazing. Hence the cooling water flow path 100 and the refrigerant through-hole 97 between the inner plate 74 and the top outer plate 71 are separated.

The refrigerant through-hole 97 communicates with the refrigerant flow path 101 between the top plate 70 and the top outer plate 71.

The through-hole forming portion 97*c* forming the refrigerant through-hole 97 in the first outer plate 72 is joined to the inner plate 74 by brazing. Hence the refrigerant flow path 101 between the first outer plate 72 and the inner plate 74 and the refrigerant through-hole 97 are separated.

A through-hole forming portion 97*e* forming the refrigerant through-hole 97 in the inner plate 74 is joined to the first outer plate 72 by brazing. Hence the refrigerant through-hole 97 and the cooling water flow path 100 are separated from each other.

In this manner, the cooling water flow path 100 and the refrigerant flow path 101 between the inner plate 74 and the first outer plate 72 are separated from the refrigerant through-hole 97.

Figure 87:
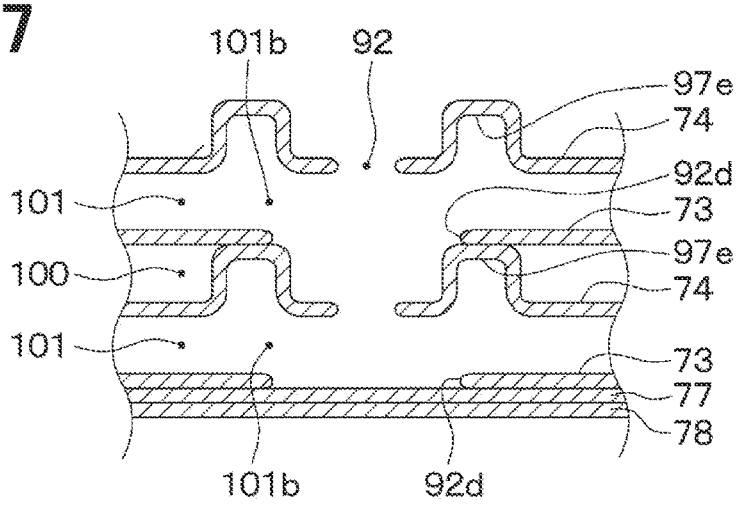
FIG. 87 is a cross-sectional view illustrating the refrigerant through-hole of the heat exchanger body in the heat exchanger according to the fourth embodiment.

As illustrated in FIG. 87, the through-hole forming portion 97*e* forming the refrigerant through-hole 97 in the inner plate 74 forms the refrigerant discharge port 101*b* together with the second outer plate 73. The refrigerant discharge port 101*b* discharges the refrigerant from the refrigerant flow path 101 to the refrigerant through-hole 97.

The through-hole forming portion 97*e* forming the refrigerant through-hole 92 in the inner plate 74 is joined to the second outer plate 73 by brazing. Hence the cooling water flow path 100 and the refrigerant through-hole 92 between the second outer plate 73 and the inner plate 74 are separated.

The refrigerant through-hole 92 formed of the plurality of second outer plates 73 and the plurality of inner plates 74 communicates with the refrigerant through-hole 97 formed of the plurality of first outer plates 72 and the plurality of inner plates 74. One side in the second direction D2 of the refrigerant through-hole 97 (e.g., the upper side in FIG. 86) is closed by the top plate 70.

In the present embodiment as described above, each of the first outer plate 72 and the second outer plate 73 have a common outer shape.

As described above, the first outer plate 72 includes the through-hole forming portions 90*c*, 91*c*, 94*c*, 95*c*, 96*c*, 97*c*. As described above, the second outer plate 73 includes the through-hole forming portions 91*d*, 92*d*, 95*d*, 96*d*.

Hereinafter, for convenience of description, the first outer plate 72 and the second outer plate 73 are collectively referred to as outer plates 72, 73. The through-hole forming portions 90*c*, 91*c*, 94*c*, 95*c*, 96*c*, 97*c* and the through-hole forming portions 91*d*, 92*d*, 95*d*, 96*d* are collectively referred to as a through-hole forming portion 90*c*, . . . , 96*d*. The outer plates 72, 73 of the present embodiment are different types of outer plates by including different combinations of through-hole forming portions among the through-hole forming portions 90*c*, . . . , 96*d*.

Next, the operation of the heat exchanger 1 of the present embodiment will be described.

First, cooling water flows into the cooling water through-hole 96 through the cooling water connector 40*a* and the cooling water inlet 112. The cooling water flowing through the cooling water through-hole 96 is diverted into the plurality of cooling water flow paths 100 between the top plate 70 and the bracket 78. The cooling water thus diverted into the plurality of cooling water flow paths 100 is collected in a cooling water through-hole 95 and discharged through the cooling water outlet 113 and the cooling water connector 40*b*.

On the other hand, the high-pressure refrigerant discharged from the compressor flows into the refrigerant through-hole 90 through the refrigerant connector 30*a* and the refrigerant inlet 110. The high-pressure refrigerant flowing through the refrigerant through-hole 90 is diverted into the plurality of refrigerant flow paths 101. The high-pressure refrigerant thus diverted into the plurality of refrigerant flow paths 101 is collected in the refrigerant through-holes 91.

At this time, the high-pressure refrigerant in the plurality of refrigerant flow paths 101 radiates heat to the cooling water in the cooling water flow path 100.

Thereafter, the refrigerant is diverted from the refrigerant through-hole 91 into a plurality of refrigerant flow paths 101 formed between the second outer plate 73 and the inner plate 74 for each of the second outer plates 73. The high-pressure refrigerant thus diverted into the plurality of refrigerant flow paths 101 is collected in the refrigerant through-holes 92.

At this time, the high-pressure refrigerant in the plurality of refrigerant flow paths 101 radiates heat to the cooling water in the cooling water flow path 100.

Thereafter, the high-pressure refrigerant having passed through the refrigerant through-hole 92 flows through the refrigerant through-hole 97 to the refrigerant flow path 101 between the top plate 70 and the top outer plate 71. The refrigerant flowing through the refrigerant flow path 101 flows to the pressure reducing valve through the refrigerant outlet 111 and the refrigerant connector 30*b*.

Next, a method for manufacturing the heat exchanger 1 of the present embodiment will be described.

First, the top plate 70, the top outer plate 71, the plurality of first outer plates 72, the plurality of second outer plates 73, and the plurality of inner plates 74 are prepared. The bottom plate 77, the bracket 78, the plurality of cooling water fins 79, and the plurality of refrigerant fins 80 are prepared.

In the next step, the top plate 70, the top outer plate 71, . . . , the bracket 78, the plurality of cooling water fins 79, and the plurality of refrigerant fins 80 prepared as described above are stacked and temporarily fixed to form a temporarily fixed plate stack.

In the next step, the refrigerant connectors 30*a*, 30*b* and the cooling water connectors 40*a*, 40*b* are assembled to the temporarily fixed plate stack.

Next, the temporarily fixed plate stack, the refrigerant connectors 30*a*, 30*b*, the cooling water connectors 40*a*, 40*b*, and the receiver connector 50 assembled as described above are integrated by brazing in a high-temperature furnace. As a result, the manufacture of the heat exchanger 1 is completed.

According to the present embodiment described above, the heat exchanger 1 of the present embodiment includes the plate stack 10 and the gas-liquid separator 20. The plate stack 10 is formed with a refrigerant inlet 110 and a refrigerant outlet 111. The refrigerant inlet 110 and the refrigerant outlet 111 are disposed on one side in the second direction D2 with respect to the condensing portion 10A (e.g., the upper side in FIG. 80).

Thereby, as in the first embodiment, it is possible to reduce the number of assembling steps at the time of mounting the heat exchanger 1 on the vehicle. Further, it is possible to improve the mountability of the heat exchanger 1 on the vehicle.

In the present embodiment, the cooling water inlet 112 and the cooling water outlet 113 are disposed on one side in the second direction D2 with respect to the condensing portion 10A (e.g., the upper side in FIG. 81). This can facilitate performing the step of connecting the cooling water pipe to each of the cooling water inlet 112 and the cooling water outlet 113.

In the present embodiment, as described above, while the nested mold for forming the through-hole forming portion is replaced for each different type of outer plate, each of the outer plates 72, 73 is molded using a core or a cavity except for the nested mold among molds as a common component.

As a result, the manufacturing cost can be reduced as compared to a case where the outer plates 72, 73 are molded using a different mold for each outer plate.

Fifth Embodiment

In the fourth embodiment, the example has been described where the condensing portion 10A is formed of the refrigerant flow path 101 through which the refrigerant flows on one side in the third direction D3 and the refrigerant flow path 101 through which the refrigerant flows on the other side in the third direction D3.

Figure 88:
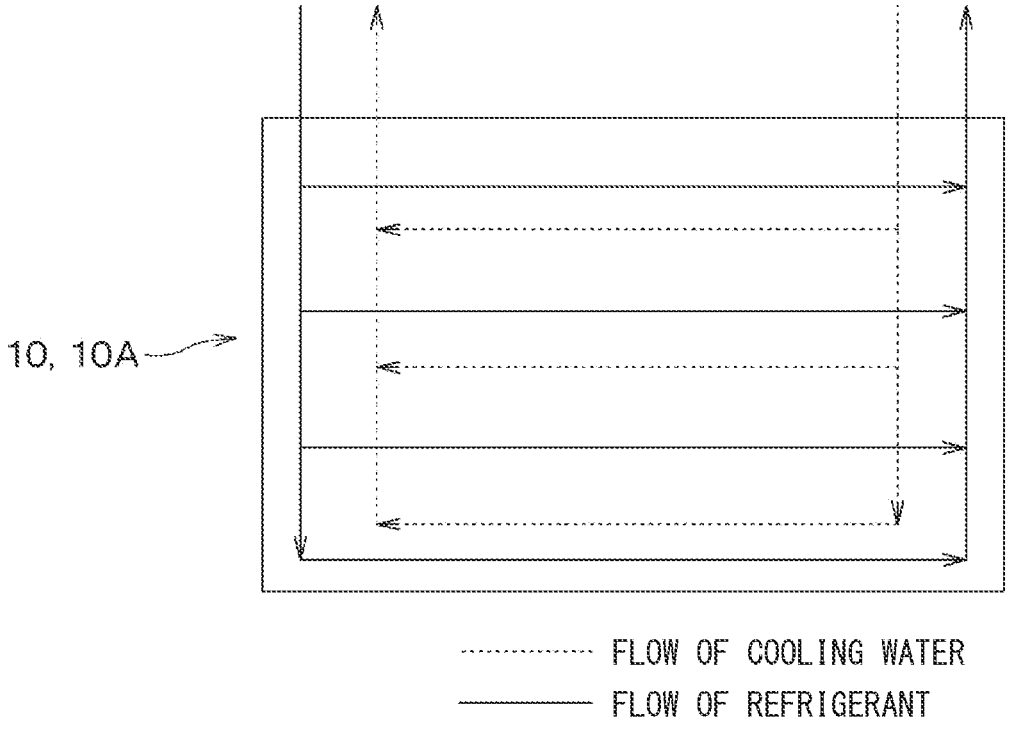
FIG. 88 is a perspective view illustrating an overall configuration of a heat exchanger according to a fifth embodiment.
Figure 89:
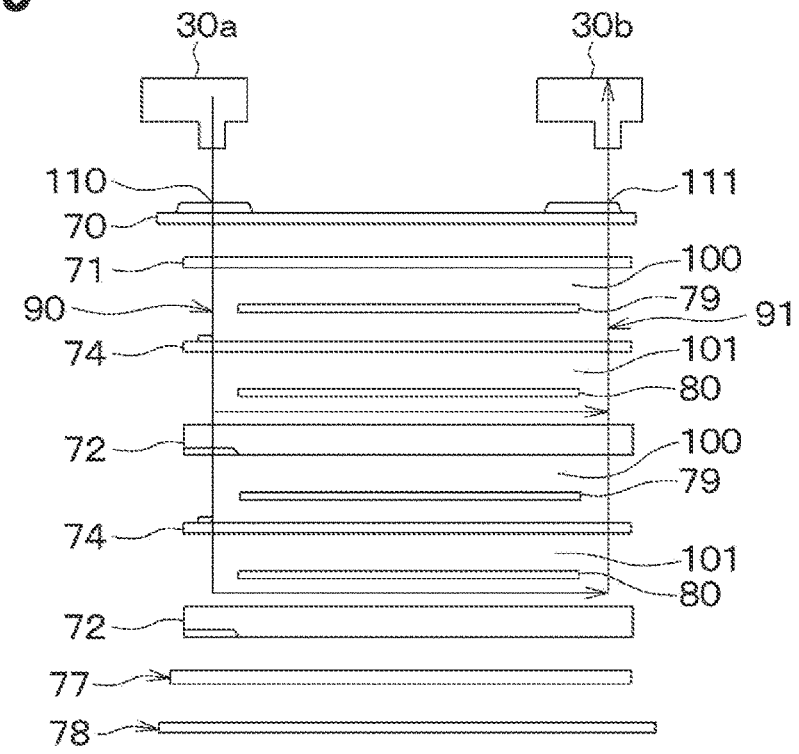
FIG. 89 is a view illustrating a placement relationship between a top plate, a top outer plate, first outer plates, inner plates, and the like constituting a heat exchanger according to the fifth embodiment and refrigerant through-holes.
Figure 90:
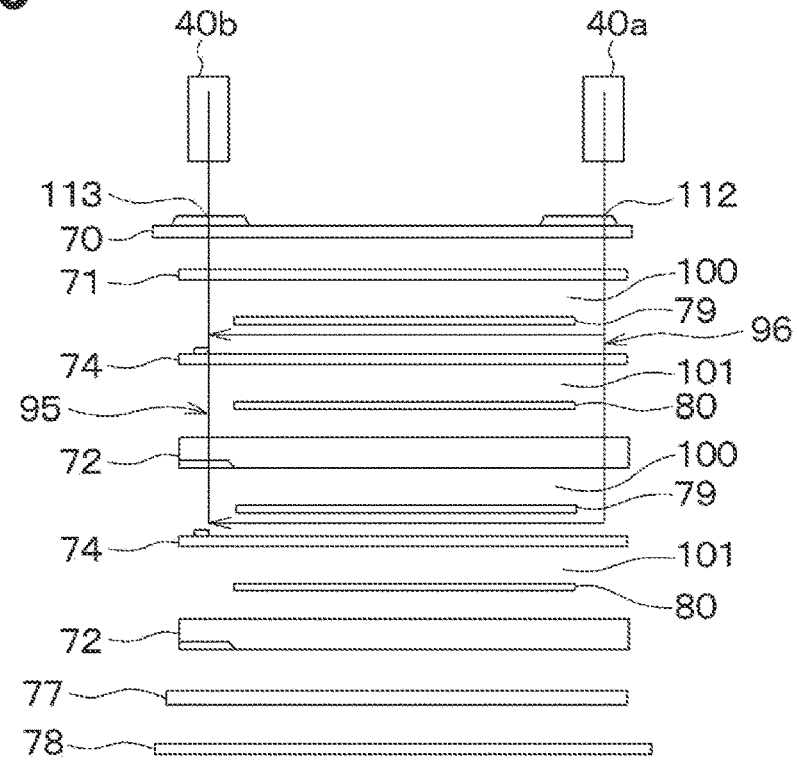
FIG. 90 is a view illustrating a placement relationship between the top plate, the top outer plate, the first outer plates, the inner plates, and the like constituting a heat exchanger according to the fifth embodiment and cooling water through-holes.

However, with reference to FIGS. 88 to 90, a description will be given of the present fifth embodiment in which a condensing portion 10A is formed of the refrigerant flow path 101 through which a refrigerant flows on one side in the third direction D3. In FIGS. 88 to 90, the same reference numerals as those in FIGS. 79 to 81 denote the same components, and the description thereof will be omitted.

As illustrated in FIGS. 88 to 90, the heat exchanger 1 of the present embodiment includes a plate stack 10, refrigerant connectors 30*a*, 30*b*, and cooling water connectors 40*a*, 40*b*. The plate stack 10 of the present embodiment is formed of the condensing portion 10A. As in the first embodiment, the refrigerant connectors 30*a*, 30*b* and the cooling water connectors 40*a*, 40*b* are disposed on one side in the second direction D2 with respect to the condensing portion 10A (e.g., the upper side in FIG. 89).

The plate stack 10 includes a top plate 70, a top outer plate 71, a plurality of first outer plates 72, and a plurality of inner plates 74. In addition, the plate stack 10 is provided with a bottom plate 77, a bracket 78, a plurality of cooling water fins 79, and a plurality of the refrigerant fins 80.

The plate stack 10 is provided with refrigerant through-holes 90, 91 and cooling water through-holes 95, 96. Each of the refrigerant through-holes 90, 91 and the cooling water through-holes 95, 96 penetrates the top plate 70, the top outer plate 71, the plurality of first outer plates 72, and the plurality of inner plates 74 in the second direction D2.

On the other side in the second direction D2 with respect to the top plate 70 and the top outer plate 71 in the plate stack 10 of FIG. 89, the plurality of first outer plates 72 and the plurality of inner plates 74 are alternately arranged one by one on the other side in the second direction D2. Here, the other side in the second direction D2 means, for example, the lower side in FIG. 89.

The through formation portion forming the refrigerant through-hole 90 in the top plate 70 constitutes a refrigerant inlet 110. The through formation portion forming the refrigerant through-hole 91 in the top plate 70 constitutes a refrigerant outlet 111.

The through formation portion forming the cooling water through-hole 96 in the top plate 70 constitutes a cooling water inlet 112. The through formation portion forming the cooling water through-hole 95 in the top plate 70 constitutes a cooling water outlet 113.

The bottom plate 77 and the bracket 78 are disposed on the other side in the second direction D2 with respect to the plurality of first outer plates 72 and the plurality of inner plates 74 in the plate stack 10 (e.g., the lower side in FIG. 89).

The other side in the second direction D2 of the refrigerant through-hole 90 is closed by the bottom plate 77. The other side in the second direction D2 of the refrigerant through-hole 91 is closed by the bottom plate 77. The other side in the second direction D2 of the cooling water through-hole 96 is closed by the bottom plate 77. The other side in the second direction D2 of the cooling water through-hole 95 is closed by the bottom plate 77.

First, in the plate stack 10, one cooling water flow path 100 and one refrigerant flow path 101 are alternately arranged in the second direction D2 on the other side in the second direction D2 with respect to the top plate 70 and the top outer plate 71 (e.g., the lower side in FIG. 89).

As in the fourth embodiment, the refrigerant through-hole 90 communicates with the plurality of refrigerant flow paths 101. As in the fourth embodiment, the refrigerant through-hole 91 communicates with the plurality of refrigerant flow paths 101.

As in the fourth embodiment, the cooling water through-hole 96 communicates with the plurality of cooling water flow paths 100. As in the fourth embodiment, the cooling water through-hole 95 communicates with the plurality of cooling water flow paths 100.

Next, the operation of the heat exchanger 1 of the present embodiment will be described.

First, cooling water flows into the cooling water through-hole 96 through the cooling water connector 40*a* and the cooling water inlet 112. The cooling water flowing through the cooling water through-hole 96 is diverted into the plurality of cooling water flow paths 100 between the top plate 70 and the bracket 78. The cooling water having passed through the plurality of cooling water flow paths 100 is collected in the cooling water through-hole 95 and discharged through the cooling water outlet 113 and the cooling water connector 40*b*.

On the other hand, the high-pressure refrigerant discharged from the compressor flows into the refrigerant through-hole 90 through the refrigerant connector 30*a* and the refrigerant inlet 110. The high-pressure refrigerant flowing through the refrigerant through-hole 90 is diverted into the plurality of refrigerant flow paths 101. The high-pressure refrigerant thus diverted into the plurality of refrigerant flow paths 101 is collected in the refrigerant through-holes 91.

At this time, the high-pressure refrigerant in the plurality of refrigerant flow paths 101 radiates heat to the cooling water in the cooling water flow path 100.

Thereafter, the high-pressure refrigerant flows from the refrigerant through-hole 91 to the refrigerant through-hole 91. The high-pressure refrigerant having passed through the refrigerant through-hole 91 flows from the refrigerant outlet 111 to the pressure reducing valve.

According to the present embodiment described above, the heat exchanger 1 of the present embodiment includes the plate stack 10 and the gas-liquid separator 20. The plate stack 10 is formed with a refrigerant inlet 110 and a refrigerant outlet 111. The refrigerant inlet 110 and the refrigerant outlet 111 are disposed on one side in the second direction D2 with respect to the condensing portion 10A (e.g., the upper side in FIG. 89).

Thereby, as in the first embodiment, it is possible to reduce the number of assembling steps at the time of mounting the heat exchanger 1 on the vehicle. Further, it is possible to improve the mountability of the heat exchanger 1 on the vehicle. In the present embodiment, the cooling water inlet 112 and the cooling water outlet 113 are disposed on one side in the second direction D2 with respect to the condensing portion 10A (e.g., the upper side in FIG. 90). This can facilitate performing the step of connecting the cooling water pipe to each of the cooling water inlet 112 and the cooling water outlet 113.

Other Embodiments (1) In the first to fifth embodiments, the example has been described where the heat exchanger 1 for the in-vehicle air conditioner is used as the heat exchanger of the present disclosure, but instead of this, the heat exchanger 1 to be applied to a device except for the in-vehicle air conditioner may be used as the heat exchanger of the present disclosure.

(2) In the first to fifth embodiments, as illustrated in FIG. 7, the example has been described where the through-hole forming portions 90*c*, 91*c*, 94*c*, 95*c*, 96*c*, 97*c* are disposed in the first outer plate 72.

However, in the first outer plate 72, the through-hole forming portions 90*c*, 91*c*, 94*c*, 95*c*, 96*c*, 97*c* may be disposed as shown in the following (a), (b), (c), (d), (e), (f), and (g).

Figure 91:
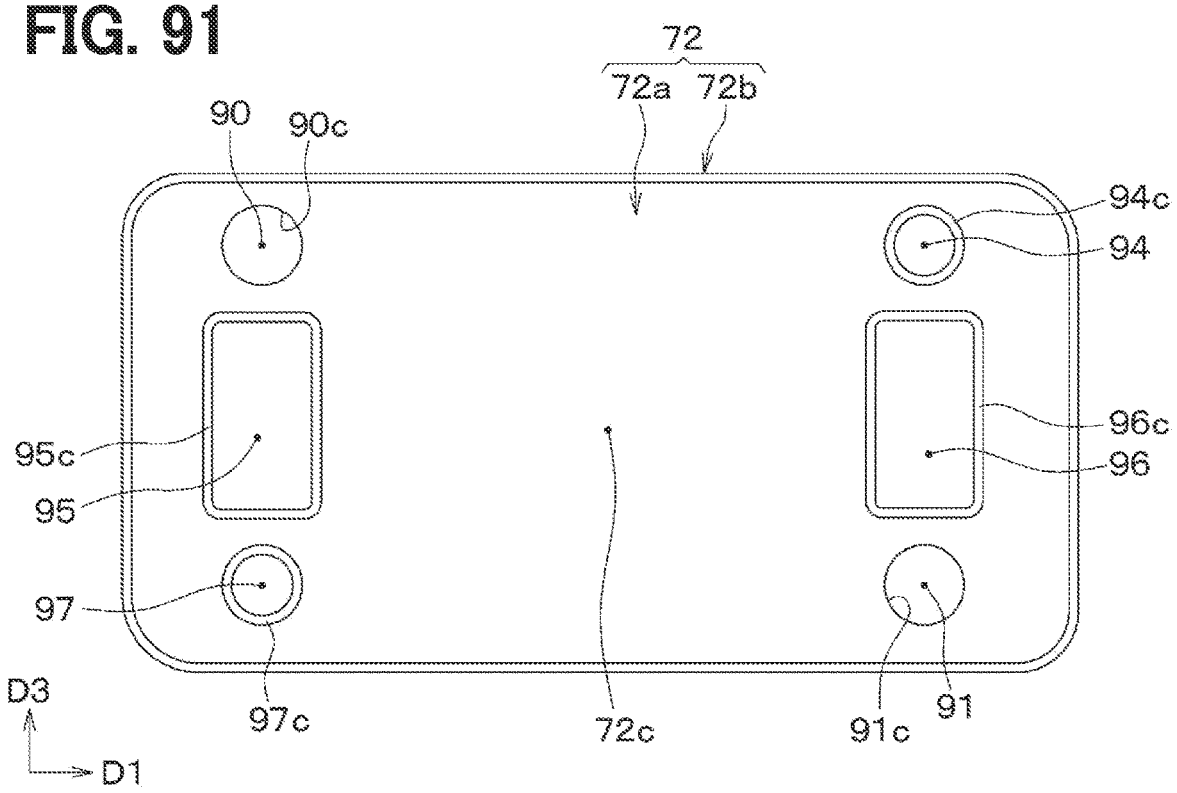
FIG. 91 is a view illustrating a placement relationship of through-hole forming portions of a first outer plate constituting a heat exchanger according to another embodiment.
Figure 92:
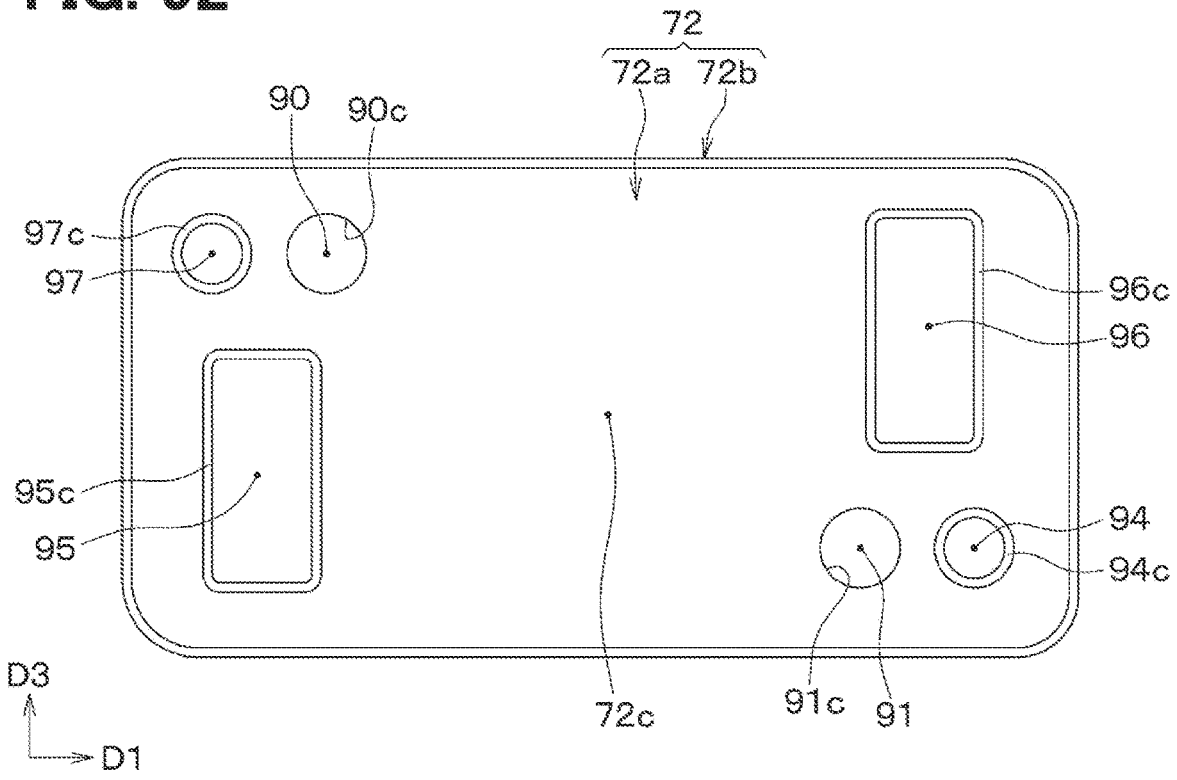
FIG. 92 is a view illustrating a placement relationship of through-hole forming portions of a first outer plate constituting a heat exchanger according to another embodiment.

(a) For example, as illustrated in FIG. 91, the through-hole forming portion 95*c* may be disposed between the through-hole forming portions 90*c*, 97*c*, and the through-hole forming portion 96*c* may be disposed between the through-hole forming portions 91*c* and 94*c*.

(b) As illustrated in FIG. 91, the through-hole forming portions 90*c*, 97*c* may be disposed on one side in the third direction D3 with respect to the through-hole forming portion 95*c*, and the through-hole forming portions 91*c*, 94*c* may be disposed on the other side in the third direction D3 with respect to the through-hole forming portion 96*c*.

(c) The same applies to the first outer plate 72, the plurality of second outer plates 73, the inner plate 74, the first partition outer plate 75, the second partition outer plate 76, and the reverse second outer plate 73A.

(d) Also, in the second outer plate 73B used in the second embodiment, the through-hole forming portions 90*d*, 91*d*, 92*d*, 95*d*, 96*d* may be disposed in positions except for those in FIG. 60.

(e) Also, in the second partition outer plate 76A used in the second embodiment, the through-hole forming portions 90*g*, 92*g*, 94*g*, 95*g*, 96*g* may be disposed in positions except for those in FIG. 61.

(f) In the first outer plate 72A used in the third embodiment, the through-hole forming portions 94*c*, 95*c*, 96*c* may be dispose in positions except for those in FIG. 69.

(g) In the reverse first outer plate 72B used in the third embodiment, the through-hole forming portions 90*c*, 94*c*, 95*c*, 96*c*, 97*c* may be disposed in positions except for those in FIG. 70.

(3) In the second embodiment, the example has been described where the refrigerant inlet 110 and the refrigerant outlet 111 are disposed on one side in the second direction D2 with respect to the condensing portion 10A. However, instead of this, the refrigerant inlet 110 and the refrigerant outlet 111 may be disposed on the other side in the second direction D2 with respect to the condensing portion 10A.

In the fourth embodiment as well, the present invention is not limited to the case where the refrigerant inlet 110 and the refrigerant outlet 111 are disposed on one side in the second direction D2 with respect to the condensing portion 10A, and the refrigerant inlet 110 and the refrigerant outlet 111 may be disposed on the other side in the second direction D2 with respect to the condensing portion 10A.

Similarly, In the fifth embodiment as well, the present invention is not limited to the case where the refrigerant inlet 110 and the refrigerant outlet 111 are disposed on one side in the second direction D2 with respect to the condensing portion 10A, and the refrigerant inlet 110 and the refrigerant outlet 111 may be disposed on the other side in the second direction D2 with respect to the condensing portion 10A.

(4) In the first embodiment and the third embodiment, the example has been described where the refrigerant inlet 110 and the refrigerant outlet 111 are disposed on the opposite side of the subcooling portion 10B with respect to the condensing portion 10A in the plate stack 10.

However, instead of this, the refrigerant inlet 110 and the refrigerant outlet 111 may be disposed on the opposite side of the condensing portion 10A with respect to the subcooling portion 10B in the plate stack 10. That is, the refrigerant inlet 110 and the refrigerant outlet 111 may be disposed on the gas-liquid separator 20 side in the plate stack 10.

In this case, the plate stack 10 is provided with a refrigerant through flow path for guiding the refrigerant flowing from the refrigerant inlet 110 to the condensing portion 10A, and a refrigerant through flow path for guiding the liquid-phase refrigerant flowing from the subcooling portion 10B to the refrigerant outlet 111.

(5) In the first to sixth embodiments, the through-hole forming portion of the plate on the other side in the second direction D2 of the two plates arranged in the second direction D2 constitutes the protrusion (i.e., rib). The protrusion constitutes the cooling water flow path 100 or the refrigerant flow path 101 between the bottoms of the two plates.

For example, in FIG. 29, in the inner plate 74 and the second outer plate 73A arranged in the second direction D2, the through-hole forming portion 94*d* of the second outer plate 73A constitutes the protrusion (i.e., rib). The through-hole forming portion 94*d* forms the refrigerant flow path 101 between the bottom 74*a* of the inner plate 74 and the bottom 73*a* of the second outer plate 73A.

However, instead of this, the through-hole forming portion and the protrusion may be formed in each of the two plates arranged in the second direction D2, and the cooling water flow path 100 or the refrigerant flow path 101 may be formed between the bottoms of the two plates by the respective through-hole forming portions and protrusions.

Figure 93:
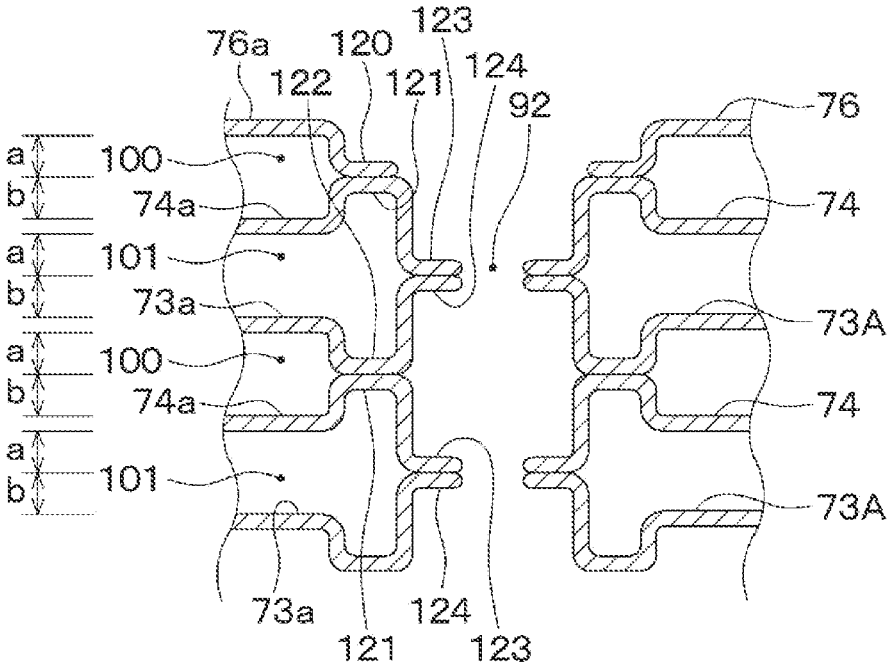
FIG. 93 is a cross-sectional view illustrating a configuration of a heat exchanger according to another embodiment.

FIG. 93 illustrates a specific example of a structure constituting the refrigerant through-hole 92 in the plate stack 10.

A through-hole forming portion 120 forming the refrigerant through-hole 92 in the second partition outer plate 76 is protruded on the other side in the second direction D2 with respect to the bottom 76*a*.

In the inner plate 74, a through-hole forming portion 123 forming the refrigerant through-hole 92 protrudes on the other side in the second direction D2 with respect to the bottom 74*a*. On the outer peripheral side of the through-hole forming portion 123 in the inner plate 74, a protrusion 121 protruding on the one side in the second direction D2 with respect to the bottom 74*a* is provided.

A through-hole forming portion 124 forming the refrigerant through-hole 92 of the second outer plate 73A protrudes on one side in the second direction D2 with respect to the bottom 73*a*. On the outer peripheral side of the through-hole forming portion 124 of the second outer plate 73A, a protrusion 122 protruding to the other side in the second direction D2 with respect to the bottom 73*a* is provided.

Here, the through-hole forming portion 120 in the second partition outer plate 76 and the protrusion 121 of the inner plate 74 are joined to each other to form the cooling water flow path 100 between the bottom 76*a* of the second partition outer plate 76 and the bottom 74*a* of the inner plate 74. A dimension a of the through-hole forming portion 120 in the second direction D2 and a dimension b of the protrusion 121 in the second direction D2 are the same.

The through-hole forming portion 123 of the inner plate 74 and the through-hole forming portion 124 of the second outer plate 73A are joined to form the refrigerant flow path 101 between the bottom 74*a* of the inner plate 74 and the bottom 73*a* of the second outer plate 73A. A dimension a of the through-hole forming portion 123 in the second direction D2 and a dimension b of the through-hole forming portion 124 in the second direction D2 are the same.

The protrusion 122 of the second outer plate 73A and the protrusion 121 of the inner plate 74 are joined to form the cooling water flow path 100 between the bottom 73*a* of the second outer plate 73A and the bottom 74*a* of the inner plate 74. A dimension a of the protrusion 122 in the second direction D2 and a dimension b of the protrusion 121 in the second direction D2 are the same.

In the structure constituting the refrigerant through-holes 91, 92, . . . , 94 except for the refrigerant through-hole 92, similarly to FIG. 94, the cooling water flow path 100 or the refrigerant flow path 101 may be constituted between the bottoms of the two plates by the through-hole forming portions or the protrusions of the two plates.

(6) In the first to sixth embodiments, as illustrated in FIG. 2, the example has been described where the gas-liquid separator 20 is connected to one side in the first direction D1 of the plate stack 10 via the receiver connector 50.

However, instead of this, the gas-liquid separator 20 may be connected to the other side in the first direction D1 of the plate stack 10 via the receiver connector 50.

In this case, the refrigerant connector 30*a* and the cooling water connector 40*b* may be disposed on the other side in the first direction D1 of the plate stack 10. The refrigerant connector 30*b* and the cooling water connector 40*a* may be disposed on one side in the first direction D1 of the plate stack 10.

For example, one side in the first direction D1 is defined as a lower side in the vertical direction, and the other side in the first direction D1 is defined as an upper side in the vertical direction. In this case, the gas-liquid separator 20 is not limited to be connected to the lower side in the vertical direction of the plate stack 10 via the receiver connector 50, and the gas-liquid separator 20 may be connected to the upper side in the vertical direction of the plate stack 10 via the receiver connector 50.

(7) In the first to sixth embodiments, the example has been described where the refrigerant inlet 110 and the refrigerant outlet 111 are provided on the opposite side of the subcooling portion 10B with respect to the condensing portion 10A.

However, instead of this, the refrigerant inlet 110 and the refrigerant outlet 111 may be provided on the opposite side of the condensing portion 10A with respect to the subcooling portion 10B.

(8) In the first to sixth embodiments, the example has been described where the cooling water outlet 113 and the cooling water inlet 112 are provided on the opposite side of the subcooling portion 10B with respect to the condensing portion 10A. However, instead of this, the cooling water outlet 113 and the cooling water inlet 112 may be provided on the opposite side of the condensing portion 10A with respect to the subcooling portion 10B.

(9) In the first to sixth embodiments, the example has been described where the refrigerant flows from one side to the other side in the first direction D1 in the upper refrigerant flow path 101, and the refrigerant flows from the other side to the one side in the first direction D1 in the lower refrigerant flow path 101.

However, instead of this, the refrigerant may flow from the other side to the one side in the first direction D1 in the upper refrigerant flow path 101, and the refrigerant may flow from the one side to the other side in the first direction D1 in the lower refrigerant flow path 101.

Alternatively, the refrigerant may flow from one side to the other side in the first direction D1 in the upper refrigerant flow path 101, and the refrigerant may flow from one side to the other side in the first direction D1 in the lower refrigerant flow path 101.

Alternatively, the refrigerant may flow from the other side in the first direction D1 to one side in the upper refrigerant flow path 101, and the refrigerant may flow from the other side in the first direction D1 to one side in the lower refrigerant flow path 101.

(10) In the first to sixth embodiments, the example has been described where the first outer plate 72 includes the four through-hole forming portions 90*c*, 97*c*, 94*c*, 91*c* in order to form the refrigerant through-holes.

However, the present invention is not limited thereto, and for example, the first outer plate 72 of the condensing portion 10A in FIG. 3 may include three or more through-hole forming portions 90*c*, 94*c*, 91*c* in order to form the refrigerant through-holes.

That is, as the first outer plate 72 of the condensing portion 10A in FIG. 3, the through-hole forming portion 97*c* may not be provided to form the refrigerant through-hole.

(11) In the first to sixth embodiments, the example has been described where the inner plate 74 includes the four through-hole forming portions 90*e*, 97*e*, 94*e*, 91*e* to form the refrigerant through-holes.

However, the present invention is not limited thereto, and for example, the inner plate 74 of the condensing portion 10A in FIG. 3 may include three or more through-hole forming portions 90*e*, 94*e*, 91*e* in order to form the refrigerant through-holes.

Alternatively, the inner plate 74 of the subcooling portion 10B in FIG. 3 may include three or more through-hole forming portions 97*e*, 94*e*, 90*e* in order to form the refrigerant through-hole.

(12) In the first to sixth embodiments, the example has been described where the reverse second outer plate 73A includes the three through-hole forming portions 92*d*, 94*d*, 91*d* in order to form the refrigerant through-holes.

However, the present invention is not limited thereto, and the reverse second outer plate 73A may include four or more through-hole forming portions in order to form the refrigerant through-holes.

(13) In the first embodiment, the example has been described where the heat exchanger 1 includes the condensing portion 10A, the subcooling portion 10B, and the gas-liquid separator 20. However, instead of this, the heat exchanger 1 may include the condensing portion 10A and the subcooling portion 10B among the condensing portion 10A, the subcooling portion 10B, and the gas-liquid separator 20. That is, the heat exchanger 1 may include the condensing portion 10A and the subcooling portion 10B, excluding the gas-liquid separator 20.

(14) In the first to sixth embodiments, the example has been described where the refrigerant flow path 101 is formed between the inner plate 74 and the first outer plate 72 on one side in the second direction D2 with respect to the first outer plate 72 in the condensing portion 10A.

However, instead of this, the refrigerant flow path 101 may be formed between the inner plate 74 and the first outer plate 72 on the other side in the second direction D2 with respect to the first outer plate 72.

(15) In the first to sixth embodiments, the example has been described where the cooling water flow path 100 is formed between the inner plate 74 and the first outer plate 72 on the other side in the second direction D2 with respect to the first outer plate 72 in the condensing portion 10A.

However, instead of this, the cooling water flow path 100 may be formed between the inner plate 74 and the first outer plate 72 on one side in the second direction D2 with respect to the first outer plate 72.

(16) In the first to sixth embodiments described above, in the subcooling portion 10B, the example has been described where the refrigerant flow path 101 is formed between the reverse second outer plate 73A and the inner plate 74 on one side in the second direction D2 with respect to the reverse second outer plate 73A.

However, instead of this, the refrigerant flow path 101 may be formed between the reverse second outer plate 73A and the inner plate 74 on the other side in the second direction D2 with respect to the reverse second outer plate 73A.

(17) In the first to sixth embodiments, the example has been described where the cooling water flow path 100 is formed between the inner plate 74 and the first outer plate 72 on the other side in the second direction D2 with respect to the first outer plate 72 in the condensing portion 10A.

However, instead of this, the cooling water flow path 100 may be formed between the inner plate 74 and the first outer plate 72 on one side in the second direction D2 with respect to the first outer plate 72.

(18) The present disclosure is not limited to the above embodiments and can be changed appropriately. The above embodiments are not unrelated to each other and can be appropriately combined unless the combination is obviously impossible. It goes without saying that in each of the above embodiments, the elements constituting the embodiments are not necessarily essential except for a case where it is explicitly stated that the elements are particularly essential and a case where the elements are considered to be obviously essential in principle. In each of the above embodiments, when the shapes, positional relationships, and the like of the components and the like are referred to, the shapes, positional relationships, and the like are not limited thereto unless otherwise specified or limited to specific shapes, positional relationships, and the like in principle.

Overview

According to a first aspect described in some or all of the first to fifth embodiments and other embodiments, a heat exchanger includes a plate stack that constitutes a condensing portion and a subcooling portion by stacking a plurality of plates.

The condensing portion is formed such that a first refrigerant flow path through which the gas-phase refrigerant flowing into the refrigerant inlet flows and a first heat-medium flow path through which the heat medium flows overlap each other in a stacking direction of the plurality of plates, radiates heat from the gas-phase refrigerant to the heat medium to condense the gas-phase refrigerant, and discharges the gas-phase refrigerant toward the gas-liquid separator.

The gas-liquid separator separates the refrigerant condensed by the condensing portion into a gas-phase refrigerant and a liquid-phase refrigerant and discharges the liquid-phase refrigerant out of the gas-phase refrigerant and the liquid-phase refrigerant.

The subcooling portion is disposed on one side in the stacking direction with respect to the condensing portion, and is formed such that a second refrigerant flow path through which the liquid-phase refrigerant discharged from the gas-liquid separator flows toward the refrigerant outlet and a second heat-medium flow path through which the heat medium flows overlap each other in the stacking direction. The subcooling portion radiates heat from the liquid-phase refrigerant to the heat medium to subcool the liquid-phase refrigerant.

The refrigerant inlet and the refrigerant outlet are disposed on the opposite side of the subcooling portion with respect to the condensing portion or on the opposite side of the condensing portion with respect to the subcooling portion, respectively.

According to a second aspect, the heat medium allowed to flow in via a heat-medium inlet flows through the first heat-medium flow path and the second heat-medium flow path. The heat medium having passed through the first heat-medium flow path and the second heat-medium flow path is discharged from the heat-medium outlet. The heat-medium inlet and the heat-medium outlet are disposed on the opposite side of the subcooling portion with respect to the condensing portion or on the opposite side of the condensing portion with respect to the subcooling portion.

Thus, according to the second aspect, the heat-medium pipe can be connected to the heat-medium inlet and the heat-medium outlet from the side opposite to the subcooling portion with respect to the condensing portion or from the side opposite to the condensing portion with respect to the subcooling portion.

Therefore, in the second aspect, the number of assembling steps can be reduced as compared to a case where one of the heat-medium inlet and the heat-medium outlet is disposed on the opposite side of the subcooling portion with respect to the condensing portion, and the other of the heat-medium inlet and the heat-medium outlet is disposed on the opposite side of the condensing portion with respect to the subcooling portion.

According to a third aspect, each of the refrigerant inlet, the refrigerant outlet, the heat-medium inlet, and the heat-medium outlet is disposed on the opposite side of the subcooling portion with respect to the condensing portion.

Therefore, the number of assembling steps of the refrigerant pipe with respect to the refrigerant inlet and the refrigerant outlet can be reduced, and the number of assembling steps of the heat-medium pipe with respect to the heat-medium inlet and the heat-medium outlet can be reduced.

According to a fourth aspect, the refrigerant inlet is disposed on one side in the intersecting direction of the plate stack, the intersection direction intersecting the stacking direction. The refrigerant outlet is disposed on the other side in the intersecting direction of the plate stack.

According to a fifth aspect, the plate stack includes a discharge port through which the refrigerant having passed through the first heat-medium flow path is discharged toward the gas-liquid separator, and an introduction port through which the liquid-phase refrigerant from the gas-liquid separator is introduced into the second refrigerant flow path. A gas-liquid separator is connected to the plate stack via a discharge port and an introduction port.

According to a sixth aspect, the gas-liquid separator is disposed on the opposite side of the condensing portion with respect to the subcooling portion.

According to a seventh aspect, the condensing portion is disposed on one side in the stacking direction with respect to the first refrigerant flow path and is formed such that the third refrigerant flow path through which the refrigerant having passed through the first refrigerant flow path is allowed to flow toward the gas-liquid separator, and the third heat-medium flow path through which the heat medium flows overlap each other in the stacking direction. The condensing portion radiates heat from the refrigerant flowing through the third refrigerant flow path to the heat medium flowing through the third heat-medium flow path to condense the refrigerant flowing through the third refrigerant flow path.

Accordingly, the refrigerant can be cooled when flowing through the first refrigerant flow path and the third refrigerant flow path. It is thus possible to improve the refrigerant cooling performance for cooling the refrigerant as compared to a case where the third refrigerant flow path is not provided.

According to an eighth aspect, the refrigerant flows on one side in the intersecting direction in one of the first refrigerant flow path and the third refrigerant flow path. The refrigerant flows on the other side in the intersecting direction in the other of the first refrigerant flow path and the third refrigerant flow path except for the one refrigerant flow path.

According to a ninth aspect, the plurality of plates includes the first plate, the second plate, and the third plate stacked in the stacking direction.

The plurality of plates includes a fourth plate, a fifth plate, and a sixth plate disposed on one side in the stacking direction with respect to the first plate, the second plate, and the third plate and stacked in the stacking direction.

The first plate is disposed on the other side in the stacking direction with respect to the second plate. The third plate is disposed on one side in the stacking direction with respect to the second plate. The fourth plate is disposed on the other side in the stacking direction with respect to the fifth plate.

The sixth plate is disposed on one side in the stacking direction with respect to the fifth plate. A first refrigerant flow path is formed between the second plate and one of the first plate and the third plate.

A first heat-medium flow path is formed between the second plate and the other of the first plate and the third plate except for the one plate. A second refrigerant flow path is formed between the fifth plate and one of the fourth plate and the sixth plate.

A second heat-medium flow path is formed between the fifth plate and the other of the fourth plate and the sixth plate except for the one plate.

According to a tenth aspect, the plurality of plates constitutes a first flow path that penetrates the condensing portion to guide the refrigerant from the second refrigerant flow path of the subcooling portion to the refrigerant outlet. The plurality of plates constitute a second flow path that is formed to penetrate the subcooling portion to guide the refrigerant from the first refrigerant flow path of the condensing portion to the gas-liquid separator.

According to an eleventh aspect, the plurality of plates includes a third flow path that is formed in the condensing portion to guide the refrigerant flowing into the refrigerant inlet to the first refrigerant flow path, and a fourth flow path that is formed in the subcooling portion to guide the refrigerant having passed through the second refrigerant flow path to the first flow path.

The plurality of plates constitute a fifth flow path that is formed in the subcooling portion to guide the refrigerant from the gas-liquid separator to the second refrigerant flow path, and a sixth flow path that is formed in the condensing portion to guide the refrigerant having passed through the first refrigerant flow path to the second flow path.

According to a twelfth aspect, the plurality of plates constitute a seventh flow path for guiding the heat medium flowing into the heat-medium inlet to the first heat-medium flow path and the second heat-medium flow path, and an eighth flow path for guiding the heat medium having passed through the first heat-medium flow path and the second heat-medium flow path to the heat-medium outlet.

According to a thirteenth aspect, each of the first plate, the second plate, and the third plate includes at least three flow path forming portions such as a first flow path forming portion that forms a first flow path, a third flow path forming portion that forms a third flow path, and a sixth flow path forming portion that forms a sixth flow path.

Each of the fourth plate, the fifth plate, and the sixth plate includes at least three flow path forming portions such as a second flow path forming portion forming a second flow path, a fourth flow path forming portion forming a fourth flow path, and a fifth flow path forming portion forming a fifth flow path.

Each of the first plate, the second plate, the third plate, the fourth plate, the fifth plate, and the sixth plate includes a seventh flow path forming portion forming a seventh flow path and an eighth flow path forming portion forming an eighth flow path.

According to a fourteenth aspect, each of the second plate and the fifth plate is formed to have a common outer shape. The first flow path forming portion, the second flow path forming portion, the third flow path forming portion, the fourth flow path forming portion, the fifth flow path forming portion, the sixth flow path forming portion, the seventh flow path forming portion, and the eighth flow path forming portion are collectively referred to as a plurality of flow path forming portions. The second plate and the fifth plate constitute different types of plates by including different combinations of flow path forming portions among the plurality of flow path forming portions.

According to a fifteenth aspect, each of the first plate, the third plate, the fourth plate, and the sixth plate is formed of one type of plate.

According to a sixteenth aspect, the first refrigerant flow path is provided with a first heat exchange fin that exchanges heat between the refrigerant in the first refrigerant flow path and the heat medium in the first heat-medium flow path.

A second heat exchange fin that exchanges heat between the refrigerant in the second refrigerant flow path and the heat medium in the second heat-medium flow path is provided in the second refrigerant flow path.

A third heat exchange fin that exchanges heat between the refrigerant in the first refrigerant flow path and the heat medium in the first heat-medium flow path is provided in the first heat-medium flow path.

A fourth heat exchange fin that exchanges heat between the refrigerant in the second refrigerant flow path and the heat medium in the second heat-medium flow path is provided in the second heat-medium flow path.

Further, according to a seventeenth aspect, a heat exchanger includes a plate stack and a gas-liquid separator.

The plate stack includes a first plate, a second plate, and a third plate formed in a plate shape spreading in a first direction and stacked in a second direction intersecting the first direction.

The plate stack includes a fourth plate, a fifth plate, and a sixth plate that are disposed in the second direction with respect to the first plate, the second plate, and the third plate, are formed in a plate shape spreading in the first direction, and are stacked in the second direction.

A first refrigerant flow path through which the refrigerant flowing from the refrigerant inlet flows is formed between the first plate and the second plate, and a first heat-medium flow path through which the heat medium flows is formed between the second plate and the third plate.

The first plate, the second plate, and the third plate constitute a condensing portion that radiates heat from the refrigerant in the first refrigerant flow path to the heat medium in the first heat-medium flow path. The gas-liquid separator separates the refrigerant discharged from the first refrigerant flow path into a gas-phase refrigerant and a liquid-phase refrigerant and discharges the liquid-phase refrigerant out of the gas-phase refrigerant and the liquid-phase refrigerant.

A second refrigerant flow path through which the liquid-phase refrigerant discharged from the gas-liquid separator flows toward a refrigerant outlet is formed between the fourth plate and the fifth plate. A second heat-medium flow path through which the heat medium flows is formed between the fifth plate and the sixth plate.

The fourth plate, the fifth plate, and the sixth plate constitute a subcooling portion that radiates heat from the liquid-phase refrigerant in the second refrigerant flow path to the heat medium in the second heat-medium flow path. The refrigerant inlet and the refrigerant outlet are disposed on the opposite side of the subcooling portion with respect to the condensing portion.

According to an eighteenth aspect, the plate stack includes a seventh plate, an eighth plate, and a ninth plate that are formed in a plate shape spreading in the first direction and stacked in the second direction.

The seventh plate, the eighth plate, and the ninth plate are disposed between the first plate, the second plate, and the third plate and the fourth plate, the fifth plate, and the sixth plate.

A third refrigerant flow path through which the refrigerant from the first refrigerant flow path flows toward the gas-liquid separator is formed between the seventh plate and the eighth plate. A third heat-medium flow path through which the heat medium flows is formed between the eighth plate and the ninth plate.

The seventh plate, the eighth plate, and the ninth plate constitute the condensing portion that radiates heat from the refrigerant in the third refrigerant flow path to the heat medium in the third heat-medium flow path.

Thereby, the refrigerant can be cooled in each of the first refrigerant flow path and the third refrigerant flow path and then allowed to flow into the gas-liquid separator. Therefore, the refrigerant flowing into the gas-liquid separator can further radiate heat.

According to a nineteenth aspect, the refrigerant flows on one side in the first direction in one of the first refrigerant flow path and the third refrigerant flow path, and the refrigerant flows on the other side in the first direction in the other of the first refrigerant flow path and the third heat-medium flow path except for the one refrigerant flow path.

According to a twentieth aspect, the heat exchanger includes a connector. The plate stack includes a discharge port for discharging the refrigerant from the condensing portion and an introduction port for guiding the liquid-phase refrigerant discharged from the gas-liquid separator to the subcooling portion. The connector guides the refrigerant from the discharge port to the gas-liquid separator and guides the liquid-phase refrigerant from the gas-liquid separator to the introduction port.

Thereby, the plate stack and the gas-liquid separator can be connected by the connector.

According to a twenty-first aspect, the first plate, the second plate, and the third plate include a through flow path that penetrates the first plate, the second plate, and the third plate to guide the liquid-phase refrigerant from the second refrigerant flow path to the refrigerant outlet.

According to a twenty-second aspect, a heat exchanger includes a plate stack and a gas-liquid separator. The plate stack includes a first plate, a second plate, and a third plate formed in a plate shape spreading in a first direction and stacked in a second direction intersecting the first direction.

The heat exchanger includes a fourth plate, a fifth plate, and a sixth plate that are disposed on one side in the second direction with respect to the first plate, the second plate, and the third plate, are formed in a plate shape spreading in the first direction, and are stacked in the second direction.

A discharge port and an introduction port are formed in the plate stack.

A first refrigerant flow path through which a refrigerant flowing from a refrigerant inlet flows toward the discharge port is formed between the first plate and the second plate, and a first heat-medium flow path through which a heat medium flows is formed between the second plate and the third plate.

The first plate, the second plate, and the third plate constitute a condensing portion that radiates heat from the refrigerant in the first refrigerant flow path to the heat medium in the first heat-medium flow path.

The gas-liquid separator separates the refrigerant discharged from the condensing portion into a gas-phase refrigerant and a liquid-phase refrigerant and discharges the liquid-phase refrigerant out of the gas-phase refrigerant and the liquid-phase refrigerant toward the introduction port. A second refrigerant flow path through which the liquid-phase refrigerant from the introduction port flows toward a refrigerant outlet is formed between the fourth plate and the fifth plate.

A second heat-medium flow path through which the heat medium flows is formed between the fifth plate and the sixth plate. The fourth plate, the fifth plate, and the sixth plate constitute a subcooling portion that radiates heat from the liquid-phase refrigerant in the second refrigerant flow path to the heat medium in the second heat-medium flow path.

The fourth plate, the fifth plate, and the sixth plate include a first through flow path that penetrates the fourth plate, the fifth plate, and the sixth plate to guide the refrigerant from the first refrigerant flow path to the discharge port.

The first plate, the second plate, and the third plate include a second through flow path that penetrates the first plate, the second plate, and the third plate to guide the liquid-phase refrigerant from the second refrigerant flow path to the refrigerant outlet.

The discharge port and the introduction port are disposed on the opposite side of the condensing portion with respect to the subcooling portion.

According to a twenty-third aspect, the heat exchanger includes a connector for guiding the refrigerant from the discharge port to the gas-liquid separator and guiding the liquid-phase refrigerant from the gas-liquid separator to the introduction port.

Thereby, the plate stack and the gas-liquid separator can be connected by the connector.

According to a twenty-fourth aspect, in the heat exchanger, a first through flow path forming portion forming the first through flow path in the sixth plate is joined to the fifth plate to separate the second through flow path and the second heat-medium flow path.

A second through flow path forming portion forming the first through flow path in the fifth plate is joined to the fourth plate to separate the second through flow path and the second refrigerant flow path. A third through flow path forming portion forming the second through flow path in the third plate is joined to the second plate to separate the second through flow path and the first heat-medium flow path.

A fourth through flow path forming portion forming the second through flow path in the second plate is joined to the first plate to separate the second through flow path and the first refrigerant flow path.

According to a twenty-fifth aspect, in the heat exchanger, the first plate, the second plate, and the third plate are formed with a third through flow path that penetrates the first plate, the second plate, and the third plate to allow the flowing of the refrigerant from the refrigerant inlet through the first refrigerant flow path.

The first plate, the second plate, and the third plate include a fourth through flow path that penetrates the first plate, the second plate, and the third plate to guide the refrigerant from the first refrigerant flow path to the discharge port.

The fourth plate, the fifth plate, and the sixth plate include a fifth through flow path that penetrates the fourth plate, the fifth plate, and the sixth plate to guide the liquid-phase refrigerant from the introduction port to the second refrigerant flow path.

According to a twenty-sixth aspect, in the heat exchanger, a fifth through flow path forming portion forming the third through flow path in the third plate is joined to the second plate to separate the third through flow path and the first heat-medium flow path.

A sixth through flow path forming portion forming the third through flow path in the second plate forms, together with the first plate, a refrigerant introduction port for guiding the refrigerant from the third through flow path to the first refrigerant flow path. A seventh through flow path forming portion forming the fourth through flow path in the third plate is joined to the second plate to separate the fourth through flow path and the first heat-medium flow path.

An eighth through flow path forming portion forming the fourth through flow path in the second plate forms, together with the first plate, a refrigerant discharge port that discharges the refrigerant from the first refrigerant flow path to the fourth through flow path. A ninth through flow path forming portion forming the fifth through flow path in the sixth plate is joined to the fifth plate to separate the fifth through flow path and the second heat-medium flow path.

A tenth through flow path forming portion forming the fifth through flow path in the fifth plate forms, together with the fourth plate, a refrigerant introduction port for guiding the refrigerant from the fifth through flow path to the second refrigerant flow path. An eleventh through flow path forming portion forming the second through flow path in the sixth plate is joined to the fifth plate to separate the second through flow path and the second heat-medium flow path.

A twelfth through flow path forming portion forming the second through flow path in the fifth plate forms, together with the fourth plate, a second discharge port that discharges the refrigerant from the second refrigerant flow path to the second through flow path.

According to a twenty-seventh aspect, in the heat exchanger, the plate stack includes a seventh plate, an eighth plate, and a ninth plate that are formed in a plate shape spreading in the first direction and stacked in the second direction.

The seventh plate, the eighth plate, and the ninth plate are disposed between the first plate, the second plate, and the third plate and the fourth plate, the fifth plate, and the sixth plate. A third refrigerant flow path through which the refrigerant from the first refrigerant flow path flows toward the gas-liquid separator is formed between the seventh plate and the eighth plate.

A third heat-medium flow path through which the heat medium flows is formed between the eighth plate and the ninth plate. The seventh plate, the eighth plate, and the ninth plate constitute the condensing portion that radiates heat from the refrigerant in the third refrigerant flow path to the heat medium in the third heat-medium flow path.

According to a twenty-eighth aspect, in the heat exchanger, the plate stack includes a first partition plate and a second partition plate.

The first partition plate is disposed between the first plate, the second plate, and the third plate and the seventh plate, the eighth plate, and the ninth plate. The second partition plate is disposed between the seventh plate, the eighth plate, the ninth plate, and the fourth plate, the fifth plate, and the sixth plate.

The first partition plate forms a thirteenth through flow path forming portion that forms the fourth through flow path and a fourteenth through flow path forming portion that forms the second through flow path. The second partition plate forms a fifteenth through flow path forming portion that forms the first through flow path and a sixteenth through flow path forming portion that forms the second through flow path.

According to a twenty-ninth aspect, in the heat exchanger, each of the second plate, the first partition plate, the second partition plate, and the fifth plate has a common outer shape.

The second, fourth, sixth, eighth, tenth, twelfth, thirteenth, fourteenth, fifteenth, and sixteenth through flow path forming portions are collectively referred to as a plurality of through flow path forming portions.

The second plate, the first partition plate, the second partition plate, and the fifth plate respectively include different combinations of through flow path forming portions among the plurality of through flow path forming portions to form different types of plates.

According to a thirtieth aspect, a heat exchanger includes a plate stack and a gas-liquid separator. The plate stack includes a first plate, a second plate, and a third plate formed in a plate shape spreading in a first direction and stacked in a second direction intersecting the first direction.

A refrigerant inlet through which a refrigerant flows and a refrigerant outlet through which the refrigerant is discharged are formed in the plate stack.

A first refrigerant flow path through which the refrigerant flowing from the refrigerant inlet flows toward the refrigerant outlet is formed between the first plate and the second plate, and a first heat-medium flow path through which a heat medium flows is formed between the second plate and the third plate.

The first plate, the second plate, and the third plate constitute a condensing portion that radiates heat from the refrigerant in the first refrigerant flow path to the heat medium in the first heat-medium flow path. The refrigerant inlet and the refrigerant outlet are disposed on one side or the other side in the second direction with respect to the condensing portion.

What is claimed is:

1. A heat exchanger comprising:

a plate stack in which a plurality of plates are stacked to form a condensing portion and a subcooling portion, wherein the condensing portion is formed such that a first refrigerant flow path through which a gas-phase refrigerant flowing into a refrigerant inlet flows and a first heat-medium flow path through which a heat medium flows overlap each other in a stacking direction of the plurality of plates, radiates heat from the gas-phase refrigerant to the heat medium to condense the gas-phase refrigerant, and discharges the condensed refrigerant toward a gas-liquid separator, the gas-liquid separator separates the refrigerant condensed by the condensing portion into the gas-phase refrigerant and a liquid-phase refrigerant and discharges the liquid-phase refrigerant out of the gas-phase refrigerant and the liquid-phase refrigerant, the subcooling portion is disposed on one side in the stacking direction with respect to the condensing portion, is formed such that a second refrigerant flow path through which the liquid-phase refrigerant discharged from the gas-liquid separator flows toward a refrigerant outlet and a second heat-medium flow path through which the heat medium flows overlap each other in the stacking direction, and radiates heat from the liquid-phase refrigerant to the heat medium to subcool the liquid-phase refrigerant, each of the refrigerant inlet and the refrigerant outlet is disposed on an opposite side of the subcooling portion with respect to the condensing portion, the heat medium allowed to flow in via a heat-medium inlet flows through the first heat-medium flow path and the second heat-medium flow path, the heat medium passing through the first heat-medium flow path and the second heat-medium flow path is discharged from a heat-medium outlet, the heat-medium inlet and the heat-medium outlet are disposed on the opposite side of the subcooling portion with respect to the condensing portion, the gas-liquid separator is disposed on the opposite side of the condensing portion with respect to the subcooling portion, each of the plurality of plates has a first through hole configured to guide the heat medium flowing into the heat-medium inlet to the first heat-medium flow path and the second heat-medium flow path, and a second through hole configured to guide the heat medium having passed through the first heat-medium flow path and the second heat-medium flow path to the heat-medium outlet, each of the plurality of plates has a plate shape spreading in a first direction and a third direction perpendicular to each other, the first direction being perpendicular to a second direction in which the plurality of plates are stacked with each other, in a plan view of each of the plurality of plates, a center of a through hole defining the refrigerant inlet is positioned within a region defined by an overlap between an area extended toward one side from an external shape of the first through hole in the first direction and an area extended toward one side from an external shape of the second through hole in the third direction, and in a plan view of each of the plurality of plates, a center of a through hole defining the refrigerant outlet is positioned within a region defined by an overlap between an area extended toward the other side from the external shape of the second through hole in the first direction and an area extended toward the other side from the external shape of the first through hole in the third direction.

2. The heat exchanger according to claim 1, wherein the refrigerant inlet is disposed on one side in an intersecting direction of the plate stack, the intersecting direction intersecting the stacking direction, and the refrigerant outlet is disposed on the other side in the intersecting direction of the plate stack.

3. The heat exchanger according to claim 1, wherein the plate stack has a discharge port through which the refrigerant passing through the first heat-medium flow path is discharged toward the gas-liquid separator and an introduction port through which the liquid-phase refrigerant from the gas-liquid separator is introduced into the second refrigerant flow path, and the gas-liquid separator is connected to the plate stack via the discharge port and the introduction port.

4. The heat exchanger according to claim 3, wherein the condensing portion is disposed on the one side in the stacking direction with respect to the first refrigerant flow path, is formed such that a third refrigerant flow path through which the refrigerant having passed through the first refrigerant flow path is allowed to flow toward the gas-liquid separator and a third heat-medium flow path through which the heat medium flows overlap each other in the stacking direction, and radiates heat from the refrigerant flowing through the third refrigerant flow path to the heat medium flowing through the third heat-medium flow path to condense the refrigerant flowing through the third refrigerant flow path.

5. The heat exchanger according to claim 4, wherein the refrigerant flows on the one side in the intersecting direction in one of the first refrigerant flow path and the third refrigerant flow path, and the refrigerant flows on the other side in the intersecting direction in the other of the first refrigerant flow path and the third refrigerant flow path.

6. The heat exchanger according to claim 1, wherein the plurality of plates includes a first plate, a second plate, and a third plate that are stacked in the stacking direction, and a fourth plate, a fifth plate, and a sixth plate that are disposed on the one side in the stacking direction with respect to the first plate, the second plate, and the third plate and are stacked in the stacking direction, the first plate is disposed on the other side in the stacking direction with respect to the second plate, the third plate is disposed on the one side in the stacking direction with respect to the second plate, the fourth plate is disposed on the other side in the stacking direction with respect to the fifth plate, the sixth plate is disposed on the one side in the stacking direction with respect to the fifth plate, the first refrigerant flow path is formed between the second plate and one of the first plate and the third plate, the first heat-medium flow path is formed between the second plate and the other of the first plate and the third plate, the second refrigerant flow path is formed between the fifth plate and one of the fourth plate and the sixth plate, and the second heat-medium flow path is formed between the fifth plate and the other of the fourth plate and the sixth plate.

7. The heat exchanger according to claim 6, wherein the plurality of plates constitute a first flow path that passes through the condensing portion to guide the refrigerant from the second refrigerant flow path of the subcooling portion to the refrigerant outlet, and a second flow path that is formed to penetrate the subcooling portion to guide the refrigerant from the first refrigerant flow path of the condensing portion to the gas-liquid separator.

8. The heat exchanger according to claim 7, wherein the plurality of plates constitute a third flow path that is formed in the condensing portion to guide the refrigerant flowing into the refrigerant inlet to the first refrigerant flow path, a fourth flow path that is formed in the subcooling portion to guide the refrigerant having passed through the second refrigerant flow path to the first flow path, a fifth flow path that is formed in the subcooling portion to guide the refrigerant from the gas-liquid separator to the second refrigerant flow path, and a sixth flow path that is formed in the condensing portion to guide the refrigerant having passed through the first refrigerant flow path to the second flow path.

9. The heat exchanger according to claim 8, wherein the plurality of plates constitute a seventh flow path configured to guide the heat medium flowing into the heat-medium inlet to the first heat-medium flow path and the second heat-medium flow path, and an eighth flow path configured to guide the heat medium having passed through the first heat-medium flow path and the second heat-medium flow path to the heat-medium outlet.

10. The heat exchanger according to claim 9, wherein each of the first plate, the second plate, and the third plate includes at least three flow path forming portions of a first flow path forming portion that forms the first flow path, a third flow path forming portion that forms the third flow path, and a sixth flow path forming portion that forms the sixth flow path, each of the fourth plate, the fifth plate, and the sixth plate includes at least three flow path forming portions of a second flow path forming portion that forms the second flow path, a fourth flow path forming portion that forms the fourth flow path, and a fifth flow path forming portion that forms the fifth flow path, and each of the first plate, the second plate, the third plate, the fourth plate, the fifth plate, and the sixth plate includes a seventh flow path forming portion that forms the seventh flow path, and an eighth flow path forming portion that forms the eighth flow path.

11. The heat exchanger according to claim 10, wherein each of the second plate and the fifth plate is formed to have a common outer shape, and when the first flow path forming portion, the second flow path forming portion, the third flow path forming portion, the fourth flow path forming portion, the fifth flow path forming portion, the sixth flow path forming portion, the seventh flow path forming portion, and the eighth flow path forming portion are collectively referred to as a plurality of flow path forming portions, the second plate and the fifth plate include different combinations of flow path forming portions among the plurality of flow path forming portions to form different types of plates.

12. The heat exchanger according to claim 10, wherein each of the first plate, the third plate, the fourth plate, and the sixth plate is formed of one type of plate.

13. The heat exchanger according to claim 1, wherein a first heat exchange fin that exchanges heat between the refrigerant in the first refrigerant flow path and the heat medium in the first heat-medium flow path, is provided in the first refrigerant flow path, a second heat exchange fin that exchanges heat between the refrigerant in the second refrigerant flow path and the heat medium in the second heat-medium flow path, is provided in the second refrigerant flow path, a third heat exchange fin that exchanges heat between the refrigerant in the first refrigerant flow path and the heat medium in the first heat-medium flow path, is provided in the first heat-medium flow path, and a fourth heat exchange fin that exchanges heat between the refrigerant in the second refrigerant flow path and the heat medium in the second heat-medium flow path, is provided in the second heat-medium flow path.

14. A heat exchanger comprising:

a plate stack; and a gas-liquid separator, wherein the plate stack includes a first plate, a second plate, and a third plate formed in a plate shape spreading in a first direction and stacked in a second direction intersecting the first direction, a fourth plate, a fifth plate, and a sixth plate that are disposed in the second direction with respect to the first plate, the second plate, and the third plate, are formed in a plate shape spreading in the first direction, and are stacked in the second direction, a first refrigerant flow path through which a refrigerant flowing from a refrigerant inlet flows is formed between the first plate and the second plate, and a first heat-medium flow path through which a heat medium flows is formed between the second plate and the third plate, the first plate, the second plate, and the third plate constitute a condensing portion that radiates heat from the refrigerant in the first refrigerant flow path to the heat medium in the first heat-medium flow path, the gas-liquid separator separates the refrigerant discharged from the first refrigerant flow path into a gas-phase refrigerant and a liquid-phase refrigerant and discharges the liquid-phase refrigerant out of the gas-phase refrigerant and the liquid-phase refrigerant, a second refrigerant flow path through which the liquid-phase refrigerant discharged from the gas-liquid separator flows toward a refrigerant outlet is formed between the fourth plate and the fifth plate, a second heat-medium flow path through which the heat medium flows is formed between the fifth plate and the sixth plate, the fourth plate, the fifth plate, and the sixth plate constitute a subcooling portion that radiates heat from the liquid-phase refrigerant in the second refrigerant flow path to the heat medium in the second heat-medium flow path, the refrigerant inlet and the refrigerant outlet are disposed on an opposite side of the subcooling portion with respect to the condensing portion, the first plate, the second plate, and the third plate include a through flow path that penetrates the first plate, the second plate, and the third plate to guide the liquid-phase refrigerant from the second refrigerant flow path to the refrigerant outlet, the through flow path is located on one side in the first direction in the first plate, the second plate, and the third plate, the plate stack has a first through hole configured to guide the heat medium flowing into the heat-medium inlet to the first heat-medium flow path and the second heat-medium flow path, and a second through hole configured to guide the heat medium having passed through the first heat-medium flow path and the second heat-medium flow path to the heat-medium outlet, the plate shape of the plate stack spreads in the first direction and a third direction perpendicular to each other, in a plan view of the plate stack, a center of a through hole defining the refrigerant inlet is positioned within a region defined by an overlap between an area extended toward one side from an external shape of the first through hole in the first direction and an area extended toward one side from an external shape of the second through hole in the third direction, and in a plan view of the plate stack, a center of a through hole defining the refrigerant outlet is positioned within a region defined by an overlap between an area extended toward the other side from the external shape of the second through hole in the first direction and an area extended toward the other side from the external shape of the first through hole in the third direction.

15. The heat exchanger according to claim 14, wherein the plate stack includes a seventh plate, an eighth plate, and a ninth plate that are formed in a plate shape spreading in the first direction and stacked in the second direction, the seventh plate, the eighth plate, and the ninth plate are disposed between the first plate, the second plate, and the third plate and the fourth plate, the fifth plate, and the sixth plate, a third refrigerant flow path through which the refrigerant from the first refrigerant flow path flows toward the gas-liquid separator is formed between the seventh plate and the eighth plate, a third heat-medium flow path through which the heat medium flows is formed between the eighth plate and the ninth plate, and the seventh plate, the eighth plate, and the ninth plate constitute the condensing portion that radiates heat from the refrigerant in the third refrigerant flow path to the heat medium in the third heat-medium flow path.

16. The heat exchanger according to claim 15, wherein the refrigerant flows on one side in the first direction in one of the first refrigerant flow path and the third refrigerant flow path, and the refrigerant flows on the other side in the first direction in the other of the first refrigerant flow path and the third heat-medium flow path.

17. The heat exchanger according to claim 14, further comprising a connector, wherein the plate stack includes a discharge port configured to discharge the refrigerant from the condensing portion and an introduction port configured to guide the liquid-phase refrigerant discharged from the gas-liquid separator to the subcooling portion, and the connector guides the refrigerant from the discharge port to the gas-liquid separator and guides the liquid-phase refrigerant from the gas-liquid separator to the introduction port.

18. A heat exchanger comprising:

a plate stack; and a gas-liquid separator, wherein the plate stack includes a first plate, a second plate, and a third plate formed in a plate shape spreading in a first direction and stacked in a second direction intersecting the first direction, a fourth plate, a fifth plate, and a sixth plate that are disposed on one side in the second direction with respect to the first plate, the second plate, and the third plate, are formed in a plate shape spreading in the first direction, and are stacked in the second direction, a discharge port and an introduction port are formed in the plate stack, a first refrigerant flow path through which a refrigerant flowing from a refrigerant inlet flows toward the discharge port is formed between the first plate and the second plate, and a first heat-medium flow path through which a heat medium flows is formed between the second plate and the third plate, the first plate, the second plate, and the third plate constitute a condensing portion that radiates heat from the refrigerant in the first refrigerant flow path to the heat medium in the first heat-medium flow path, the gas-liquid separator separates the refrigerant discharged from the condensing portion into a gas-phase refrigerant and a liquid-phase refrigerant and discharges the liquid-phase refrigerant out of the gas-phase refrigerant and the liquid-phase refrigerant toward the introduction port, a second refrigerant flow path through which the liquid-phase refrigerant from the introduction port flows toward a refrigerant outlet is formed between the fourth plate and the fifth plate, a second heat-medium flow path through which the heat medium flows is formed between the fifth plate and the sixth plate, the fourth plate, the fifth plate, and the sixth plate constitute a subcooling portion that radiates heat from the liquid-phase refrigerant in the second refrigerant flow path to the heat medium in the second heat-medium flow path, the fourth plate, the fifth plate, and the sixth plate include a first through flow path that penetrates the fourth plate, the fifth plate, and the sixth plate to guide the refrigerant from the first refrigerant flow path to the discharge port, the first plate, the second plate, and the third plate include a second through flow path that penetrates the first plate, the second plate, and the third plate to guide the liquid-phase refrigerant from the second refrigerant flow path to the refrigerant outlet, the discharge port and the introduction port are disposed on an opposite side of the condensing portion with respect to the subcooling portion, the first through flow path is located on one side in the first direction in the fourth plate, the fifth plate, and the sixth plate, the second through flow path is disposed on the other side in the first direction in the first plate, the second plate, and the third plate, the plate stack has a first through hole configured to guide the heat medium flowing into the heat-medium inlet to the first heat-medium flow path and the second heat-medium flow path, and a second through hole configured to guide the heat medium having passed through the first heat-medium flow path and the second heat-medium flow path to the heat-medium outlet, the plate shape of the plate stack spreads in the first direction and a third direction perpendicular to each other, in a plan view of the plate stack, a center of a through hole defining the refrigerant inlet is positioned within a region defined by an overlap between an area extended toward one side from an external shape of the first through hole in the first direction and an area extended toward one side from an external shape of the second through hole in the third direction, and in a plan view of the plate stack, a center of a through hole defining the refrigerant outlet is positioned within a region defined by an overlap between an area extended toward the other side from the external shape of the second through hole in the first direction and an area extended toward the other side from the external shape of the first through hole in the third direction.

19. The heat exchanger according to claim 18, further comprising a connector configured to guide the refrigerant from the discharge port to the gas-liquid separator and to guide the liquid-phase refrigerant from the gas-liquid separator to the introduction port.

20. The heat exchanger according to claim 18, wherein a first through flow path forming portion forming the first through flow path in the sixth plate is joined to the fifth plate to separate the second through flow path and the second heat-medium flow path, a second through flow path forming portion forming the first through flow path in the fifth plate is joined to the fourth plate to separate the second through flow path and the second refrigerant flow path, a third through flow path forming portion forming the second through flow path in the third plate is joined to the second plate to separate the second through flow path and the first heat-medium flow path, and a fourth through flow path forming portion forming the second through flow path in the second plate is joined to the first plate to separate the second through flow path and the first refrigerant flow path.

21. The heat exchanger according to claim 20, wherein the first plate, the second plate, and the third plate are formed with a third through flow path that penetrates the first plate, the second plate, and the third plate to allow flowing of the refrigerant from the refrigerant inlet through the first refrigerant flow path, the first plate, the second plate, and the third plate include a fourth through flow path that penetrates the first plate, the second plate, and the third plate to guide the refrigerant from the first refrigerant flow path to the discharge port, and the fourth plate, the fifth plate, and the sixth plate include a fifth through flow path that penetrates the fourth plate, the fifth plate, and the sixth plate to guide the liquid-phase refrigerant from the introduction port to the second refrigerant flow path.

22. The heat exchanger according to claim 21, wherein a fifth through flow path forming portion forming the third through flow path in the third plate is joined to the second plate to separate the third through flow path and the first heat-medium flow path, a sixth through flow path forming portion forming the third through flow path in the second plate forms, together with the first plate, a first refrigerant introduction port configured to guide the refrigerant from the third through flow path to the first refrigerant flow path, a seventh through flow path forming portion forming the fourth through flow path in the third plate is joined to the second plate to separate the fourth through flow path and the first heat-medium flow path, an eighth through flow path forming portion forming the fourth through flow path in the second plate forms, together with the first plate, a refrigerant discharge port that discharges the refrigerant from the first refrigerant flow path to the fourth through flow path, a ninth through flow path forming portion forming the fifth through flow path in the sixth plate is joined to the fifth plate to separate the fifth through flow path and the second heat-medium flow path, a tenth through flow path forming portion forming the fifth through flow path in the fifth plate forms, together with the fourth plate, a second refrigerant introduction port configured to guide the refrigerant from the fifth through flow path to the second refrigerant flow path, an eleventh through flow path forming portion forming the second through flow path in the sixth plate is joined to the fifth plate to separate the second through flow path and the second heat-medium flow path, and a twelfth through flow path forming portion forming the second through flow path in the fifth plate forms, together with the fourth plate, a second discharge port that discharges the refrigerant from the second refrigerant flow path to the second through flow path.

23. The heat exchanger according to claim 22, wherein the plate stack includes a seventh plate, an eighth plate, and a ninth plate that are formed in a plate shape spreading in the first direction and stacked in the second direction, the seventh plate, the eighth plate, and the ninth plate are disposed between the first plate, the second plate, and the third plate and the fourth plate, the fifth plate, and the sixth plate, a third refrigerant flow path through which the refrigerant from the first refrigerant flow path flows toward the gas-liquid separator is formed between the seventh plate and the eighth plate, a third heat-medium flow path through which the heat medium flows is formed between the eighth plate and the ninth plate, and the seventh plate, the eighth plate, and the ninth plate constitute the condensing portion that radiates heat from the refrigerant in the third refrigerant flow path to the heat medium in the third heat-medium flow path.

24. The heat exchanger according to claim 23, wherein the plate stack includes a first partition plate and a second partition plate, the first partition plate is disposed between the first plate, the second plate, and the third plate and the seventh plate, the eighth plate, and the ninth plate, the second partition plate is disposed between the seventh plate, the eighth plate, and the ninth plate and the fourth plate, the fifth plate, and the sixth plate, and the first partition plate forms a thirteenth through flow path forming portion that forms the fourth through flow path and a fourteenth through flow path forming portion that forms the second through flow path, and the second partition plate forms a fifteenth through flow path forming portion that forms the first through flow path and a sixteenth through flow path forming portion that forms the second through flow path.

25. The heat exchanger according to claim 24, wherein each of the second plate, the first partition plate, the second partition plate, and the fifth plate has a common outer shape, and when the second through flow path forming portion, the fourth through flow path forming portion, the sixth through flow path forming portion, the eighth through flow path forming portion, the tenth through flow path forming portion, the twelfth through flow path forming portion, the thirteenth through flow path forming portion, the fourteenth through flow path forming portion, the fifteenth through flow path forming portion, and the sixteenth through flow path forming portion are collectively referred to as a plurality of through flow path forming portions, the second plate, the first partition plate, the second partition plate, and the fifth plate respectively include different combinations of through flow path forming portions among the plurality of through flow path forming portions to form different types of plates.

* * * * *